US011589172B2

(12) United States Patent
Qi et al.

(10) Patent No.: US 11,589,172 B2
(45) Date of Patent: Feb. 21, 2023

(54) SYSTEMS AND METHODS FOR SUPPRESSING SOUND LEAKAGE

(71) Applicant: SHENZHEN SHOKZ CO., LTD., Guangdong (CN)

(72) Inventors: Xin Qi, Shenzhen (CN); Fengyun Liao, Shenzhen (CN); Lei Zhang, Shenzhen (CN)

(73) Assignee: SHENZHEN SHOKZ CO., LTD., Shenzhen (CN)

( * ) Notice: Subject to any disclaimer, the term of this patent is extended or adjusted under 35 U.S.C. 154(b) by 40 days.

(21) Appl. No.: 17/219,859

(22) Filed: Mar. 31, 2021

(65) Prior Publication Data

US 2021/0219069 A1 Jul. 15, 2021

Related U.S. Application Data

(63) Continuation-in-part of application No. 17/074,762, filed on Oct. 20, 2020, now Pat. No. 11,197,106, and (Continued)

(30) Foreign Application Priority Data

Jan. 6, 2014 (CN) ..... 201410005804.0

(51) Int. Cl.
*H04R 25/00* (2006.01)
*H04R 1/28* (2006.01)
(Continued)

(52) U.S. Cl.
CPC ..... *H04R 25/505* (2013.01); *G10K 9/13* (2013.01); *G10K 9/22* (2013.01); *G10K 11/175* (2013.01);
(Continued)

(58) Field of Classification Search
CPC .... H04R 25/505; H04R 1/2811; H04R 9/066; H04R 2460/13; H04R 17/00;
(Continued)

(56) References Cited

U.S. PATENT DOCUMENTS 4,987,597 A 1/1991 Haertl
8,141,678 B2 3/2012 Ikeyama et al.
(Continued)

FOREIGN PATENT DOCUMENTS

CN 105575000 A 5/2016
JP H06261389 A 9/1994
(Continued)

OTHER PUBLICATIONS

The Extended European Search Report in European Application No. 18933628.2 dated Jul. 28, 2021, 8 pages.
(Continued)

*Primary Examiner* — Matthew A Eason
(74) *Attorney, Agent, or Firm* — Metis IP LLC

(57) ABSTRACT

A speaker comprises a housing, a transducer residing inside the housing, and at least one sound guiding hole located on the housing. The transducer generates vibrations. The vibrations produce a sound wave inside the housing and cause a leaked sound wave spreading outside the housing from a portion of the housing. The at least one sound guiding hole guides the sound wave inside the housing through the at least one sound guiding hole to an outside of the housing. The guided sound wave interferes with the leaked sound wave in a target region. The interference at a specific frequency relates to a distance between the at least one sound guiding hole and the portion of the housing.

20 Claims, 39 Drawing Sheets

Related U.S. Application Data a continuation-in-part of application No. 16/822,151, filed on Mar. 18, 2020, now Pat. No. 11,373,671, said application No. 17/074,762 is a continuation-in-part of application No. 16/813,915, filed on Mar. 10, 2020, now Pat. No. 10,848,878, which is a continuation of application No. 16/419,049, filed on May 22, 2019, now Pat. No. 10,616,696, which is a continuation of application No. 16/180,020, filed on Nov. 5, 2018, now Pat. No. 10,334,372, said application No. 16/822,151 is a continuation of application No. PCT/CN2018/105161, filed on Sep. 12, 2018, said application No. 16/180,020 is a continuation of application No. 15/650,909, filed on Jul. 16, 2017, now Pat. No. 10,149,071, which is a continuation of application No. 15/109,831, filed as application No. PCT/CN2014/094065 on Dec. 17, 2014, now Pat. No. 9,729,978.

(51) Int. Cl.

| | |
|---|---|
| ***H04R 9/06*** | (2006.01) |
| ***G10K 9/13*** | (2006.01) |
| ***G10K 9/22*** | (2006.01) |
| ***G10K 11/178*** | (2006.01) |
| ***G10K 11/26*** | (2006.01) |
| ***G10K 11/175*** | (2006.01) |
| *H04R 17/00* | (2006.01) |

(52) U.S. Cl.

CPC ..... *G10K 11/178* (2013.01); *G10K 11/26* (2013.01); *H04R 1/2811* (2013.01); *H04R 9/066* (2013.01); *G10K 2210/3216* (2013.01); *H04R 1/2876* (2013.01); *H04R 17/00* (2013.01); *H04R 2460/13* (2013.01)

(58) Field of Classification Search

CPC ..... H04R 1/2876; G10K 9/13; G10K 9/22; G10K 11/26; G10K 11/175; G10K 11/178; G10K 2210/3216

See application file for complete search history.

(56) References Cited

U.S. PATENT DOCUMENTS

| | | | | |
|---|---|---|---|---|
| 9,084,048 | B1 | 7/2015 | Gottlieb | |
| 9,226,075 | B2 | 12/2015 | Lee | |
| 10,897,677 | B2 | 1/2021 | Walraevens et al. | |
| 11,197,106 | B2 | 12/2021 | Qi et al. | |
| 2008/0174665 | A1 | 7/2008 | Enstad et al. | |
| 2009/0060224 | A1 | 3/2009 | Hayakawa | |
| 2009/0095613 | A1 | 4/2009 | Lin | |
| 2009/0226004 | A1 | 9/2009 | Sørensen | |
| 2010/0272289 | A1 | 10/2010 | Kornagel et al. | |
| 2010/0322428 | A1 | 12/2010 | Fukui et al. | |
| 2011/0150262 | A1 | 6/2011 | Nakama et al. | |
| 2012/0020501 | A1* | 1/2012 | Lee | H04R 1/1016 381/151 |
| 2012/0070022 | A1 | 3/2012 | Saiki | |
| 2013/0185085 | A1 | 7/2013 | Tsujino et al. | |
| 2014/0009008 | A1 | 1/2014 | Li et al. | |
| 2014/0064533 | A1 | 3/2014 | Kasic, II | |
| 2015/0256656 | A1* | 9/2015 | Horii | H04M 1/0202 455/575.1 |
| 2016/0037243 | A1 | 2/2016 | Lippert et al. | |
| 2016/0127839 | A1 | 5/2016 | French et al. | |
| 2017/0006385 | A1 | 1/2017 | Kim | |
| 2018/0146284 | A1 | 5/2018 | Benattar et al. | |
| 2020/0367008 | A1 | 11/2020 | Walsh et al. | |
| 2021/0099027 | A1 | 4/2021 | Larsson et al. | |
| 2021/0219059 | A1 | 7/2021 | Qi et al. | |

FOREIGN PATENT DOCUMENTS

| | | | |
|---|---|---|---|
| JP | 2010078941 | A | 4/2010 |
| JP | 2011034500 | A | 2/2011 |
| JP | 2012019322 | A | 1/2012 |
| JP | 2013153604 | A | 8/2013 |
| KR | 20050030183 | A | 3/2005 |

OTHER PUBLICATIONS

Notice of Reasons for Rejection in Japanese Application No. 2021-514610 dated Apr. 26, 2022, 7 pages.

The Second Office Action in Chinese Application No. 201711240909.4 dated Dec. 21, 2020, 32 pages.

Jiang, Jiuchun et al., Functions of Charging Station Monitoring System, Electric Vehicle Charging Technology and System, 2017, 6 pages.

Notice of Reasons for Rejection in Japanese Application No. 2020529730 dated Jun. 22, 2021, 9 pages.

Notice of Preliminary Rejection in Korean Application No. 10-2022-7010046 dated Jun. 20, 2022, 15 pages.

Notice of Allowance in Japanese Application No. 2021-514610 dated Aug. 16, 2022, 4 pages.

* cited by examiner

SYSTEMS AND METHODS FOR SUPPRESSING SOUND LEAKAGE

CROSS-REFERENCE TO RELATED APPLICATIONS

The present application is a continuation-in-part of U.S. patent application Ser. No. 17/074,762 filed on Oct. 20, 2020, which is a continuation-in-part of U.S. patent application Ser. No. 16/813,915 (now U.S. Pat. No. 10,848,878) filed on Mar. 10, 2020, which is a continuation of U.S. patent application Ser. No. 16/419,049 (now U.S. Pat. No. 10,616,696) filed on May 22, 2019, which is a continuation of U.S. patent application Ser. No. 16/180,020 (now U.S. Pat. No. 10,334,372) filed on Nov. 5, 2018, which is a continuation of U.S. patent application Ser. No. 15/650,909 (now U.S. Pat. No. 10,149,071) filed on Jul. 16, 2017, which is a continuation of U.S. patent application Ser. No. 15/109,831 (now U.S. Pat. No. 9,729,978) filed on Jul. 6, 2016, which is a U.S. National Stage entry under 35 U.S.C. § 371 of International Application No. PCT/CN2014/094065, filed on Dec. 17, 2014, designating the United States of America, which claims priority to Chinese Patent Application No. 201410005804.0, filed on Jan. 6, 2014; the present application is also a continuation-in-part of U.S. patent application Ser. No. 16/822,151 filed on Mar. 18, 2020, which is a continuation of International Application No. PCT/CN2018/105161 filed on Sep. 12, 2018. Each of the above-referenced applications is hereby incorporated by reference.

FIELD OF THE DISCLOSURE

This application relates to a bone conduction device, and more specifically, relates to methods and systems for reducing sound leakage by a bone conduction device.

BACKGROUND

A bone conduction speaker, which may be also called a vibration speaker, may push human tissues and bones to stimulate the auditory nerve in cochlea and enable people to hear sound. The bone conduction speaker is also called a bone conduction headphone.

An exemplary structure of a bone conduction speaker based on the principle of the bone conduction speaker is shown in FIGS. 1A and 1B. The bone conduction speaker may include an open housing 110, a vibration board 121, a transducer 122, and a linking component 123. The transducer 122 may transduce electrical signals to mechanical vibrations. The vibration board 121 may be connected to the transducer 122 and vibrate synchronically with the transducer 122. The vibration board 121 may stretch out from the opening of the housing 110 and contact with human skin to pass vibrations to auditory nerves through human tissues and bones, which in turn enables people to hear sound. The linking component 123 may reside between the transducer 122 and the housing 110, configured to fix the vibrating transducer 122 inside the housing 110. To minimize its effect on the vibrations generated by the transducer 122, the linking component 123 may be made of an elastic material.

However, the mechanical vibrations generated by the transducer 122 may not only cause the vibration board 121 to vibrate, but may also cause the housing 110 to vibrate through the linking component 123. Accordingly, the mechanical vibrations generated by the bone conduction speaker may push human tissues through the bone board 121, and at the same time a portion of the vibrating board

121 and the housing 110 that are not in contact with human issues may nevertheless push air. Air sound may thus be generated by the air pushed by the portion of the vibrating board 121 and the housing 110. The air sound may be called "sound leakage." In some cases, sound leakage is harmless. However, sound leakage should be avoided as much as possible if people intend to protect privacy when using the bone conduction speaker or try not to disturb others when listening to music.

Attempting to solve the problem of sound leakage, Korean patent KR10-2009-0082999 discloses a bone conduction speaker of a dual magnetic structure and double-frame. As shown in FIG. 2, the speaker disclosed in the patent includes: a first frame 210 with an open upper portion and a second frame 220 that surrounds the outside of the first frame 210. The second frame 220 is separately placed from the outside of the first frame 210. The first frame 210 includes a movable coil 230 with electric signals, an inner magnetic component 240, an outer magnetic component 250, a magnet field formed between the inner magnetic component 240, and the outer magnetic component 250. The inner magnetic component 240 and the out magnetic component 250 may vibrate by the attraction and repulsion force of the coil 230 placed in the magnet field. A vibration board 260 connected to the moving coil 230 may receive the vibration of the moving coil 230. A vibration unit 270 connected to the vibration board 260 may pass the vibration to a user by contacting with the skin. As described in the patent, the second frame 220 surrounds the first frame 210, in order to use the second frame 220 to prevent the vibration of the first frame 210 from dissipating the vibration to outsides, and thus may reduce sound leakage to some extent.

However, in this design, since the second frame 220 is fixed to the first frame 210, vibrations of the second frame 220 are inevitable. As a result, sealing by the second frame 220 is unsatisfactory. Furthermore, the second frame 220 increases the whole volume and weight of the speaker, which in turn increases the cost, complicates the assembly process, and reduces the speaker's reliability and consistency.

SUMMARY

The embodiments of the present application disclose methods and system of reducing sound leakage of a bone conduction speaker.

In one aspect, the embodiments of the present application disclose a method of reducing sound leakage of a bone conduction speaker, including: providing a bone conduction speaker including a vibration board fitting human skin and passing vibrations, a transducer, and a housing, wherein at least one sound guiding hole is located in at least one portion of the housing; the transducer drives the vibration board to vibrate; the housing vibrates, along with the vibrations of the transducer, and pushes air, forming a leaked sound wave transmitted in the air; the air inside the housing is pushed out of the housing through the at least one sound guiding hole, interferes with the leaked sound wave, and reduces an amplitude of the leaked sound wave.

In some embodiments, one or more sound guiding holes may locate in an upper portion, a central portion, and/or a lower portion of a sidewall and/or the bottom of the housing.

In some embodiments, a damping layer may be applied in the at least one sound guiding hole in order to adjust the phase and amplitude of the guided sound wave through the at least one sound guiding hole.

In some embodiments, sound guiding holes may be configured to generate guided sound waves having a same phase that reduce the leaked sound wave having a same wavelength; sound guiding holes may be configured to generate guided sound waves having different phases that reduce the leaked sound waves having different wavelengths.

In some embodiments, different portions of a same sound guiding hole may be configured to generate guided sound waves having a same phase that reduce the leaked sound wave having same wavelength. In some embodiments, different portions of a same sound guiding hole may be configured to generate guided sound waves having different phases that reduce leaked sound waves having different wavelengths.

In another aspect, the embodiments of the present application disclose a bone conduction speaker, including a housing, a vibration board and a transducer, wherein: the transducer is configured to generate vibrations and is located inside the housing; the vibration board is configured to be in contact with skin and pass vibrations; at least one sound guiding hole may locate in at least one portion on the housing, and preferably, the at least one sound guiding hole may be configured to guide a sound wave inside the housing, resulted from vibrations of the air inside the housing, to the outside of the housing, the guided sound wave interfering with the leaked sound wave and reducing the amplitude thereof.

In some embodiments, the at least one sound guiding hole may locate in the sidewall and/or bottom of the housing.

In some embodiments, preferably, the at least one sound guiding sound hole may locate in the upper portion and/or lower portion of the sidewall of the housing.

In some embodiments, preferably, the sidewall of the housing is cylindrical and there are at least two sound guiding holes located in the sidewall of the housing, which are arranged evenly or unevenly in one or more circles. Alternatively, the housing may have a different shape.

In some embodiments, preferably, the sound guiding holes have different heights along the axial direction of the cylindrical sidewall.

In some embodiments, preferably, there are at least two sound guiding holes located in the bottom of the housing. In some embodiments, the sound guiding holes are distributed evenly or unevenly in one or more circles around the center of the bottom. Alternatively or additionally, one sound guiding hole is located at the center of the bottom of the housing.

In some embodiments, preferably, the sound guiding hole is a perforative hole. In some embodiments, there may be a damping layer at the opening of the sound guiding hole.

In some embodiments, preferably, the guided sound waves through different sound guiding holes and/or different portions of a same sound guiding hole have different phases or a same phase.

In some embodiments, preferably, the damping layer is a tuning paper, a tuning cotton, a nonwoven fabric, a silk, a cotton, a sponge, or a rubber.

In some embodiments, preferably, the shape of a sound guiding hole is circle, ellipse, quadrangle, rectangle, or linear. In some embodiments, the sound guiding holes may have a same shape or different shapes.

In some embodiments, preferably, the transducer includes a magnetic component and a voice coil. Alternatively, the transducer includes piezoelectric ceramic.

The design disclosed in this application utilizes the principles of sound interference, by placing sound guiding holes in the housing, to guide sound wave(s) inside the housing to the outside of the housing, the guided sound wave(s) interfering with the leaked sound wave, which is formed when the housing's vibrations push the air outside the housing. The guided sound wave(s) reduces the amplitude of the leaked sound wave and thus reduces the sound leakage. The design not only reduces sound leakage, but is also easy to implement, doesn't increase the volume or weight of the bone conduction speaker, and barely increase the cost of the product.

The meanings of the mark numbers in the figures are as followed:

110, open housing; 121, vibration board; 122, transducer; 123, linking component; 210, first frame; 220, second frame; 230, moving coil; 240, inner magnetic component; 250, outer magnetic component; 260; vibration board; 270, vibration unit; 10, housing; 11, sidewall; 12, bottom; 21, vibration board; 22, transducer; 23, linking component; 24, elastic component; 30, sound guiding hole.

DETAILED DESCRIPTION

Followings are some further detailed illustrations about this disclosure. The following examples are for illustrative purposes only and should not be interpreted as limitations of the claimed disclosure. There are a variety of alternative techniques and procedures available to those of ordinary skill in the art, which would similarly permit one to successfully perform the intended disclosure. In addition, the figures just show the structures relative to this disclosure, not the whole structure.

Figure 1A:
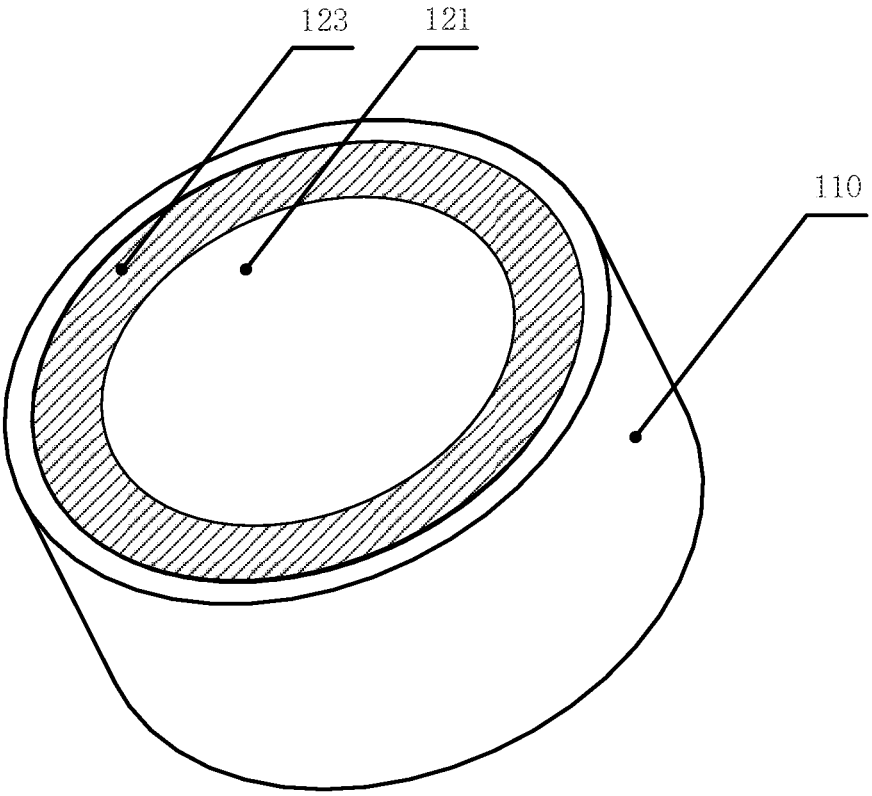
FIGS. 1A and 1B are schematic structures illustrating a bone conduction speaker of prior art.
Figure 1B:
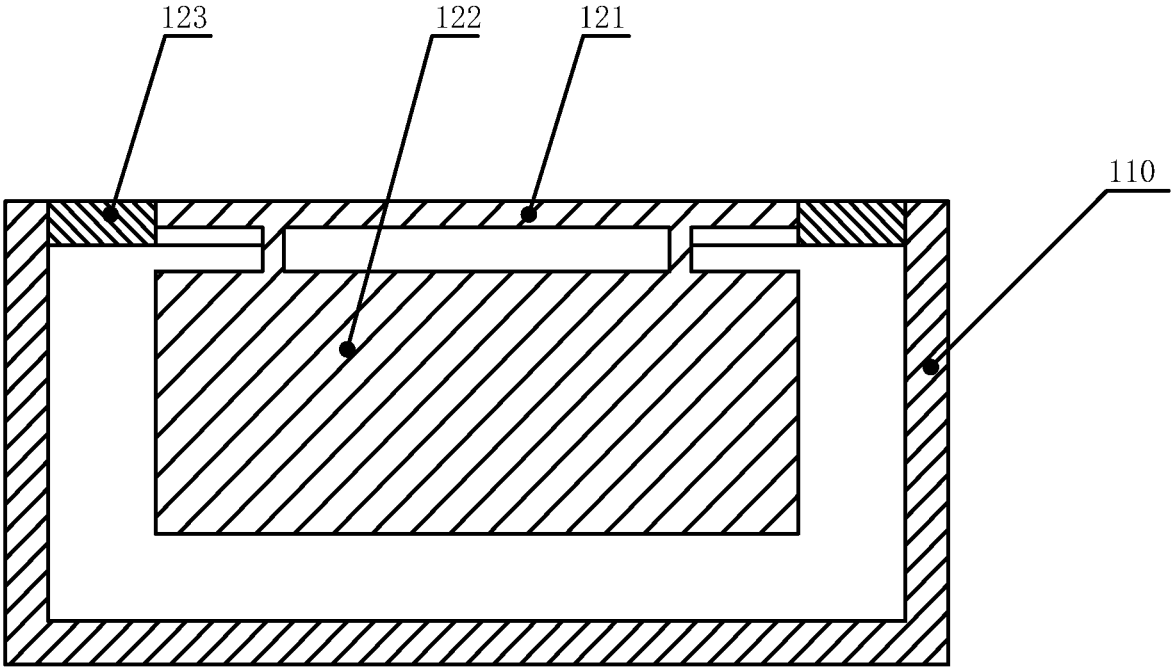
Figure 2:
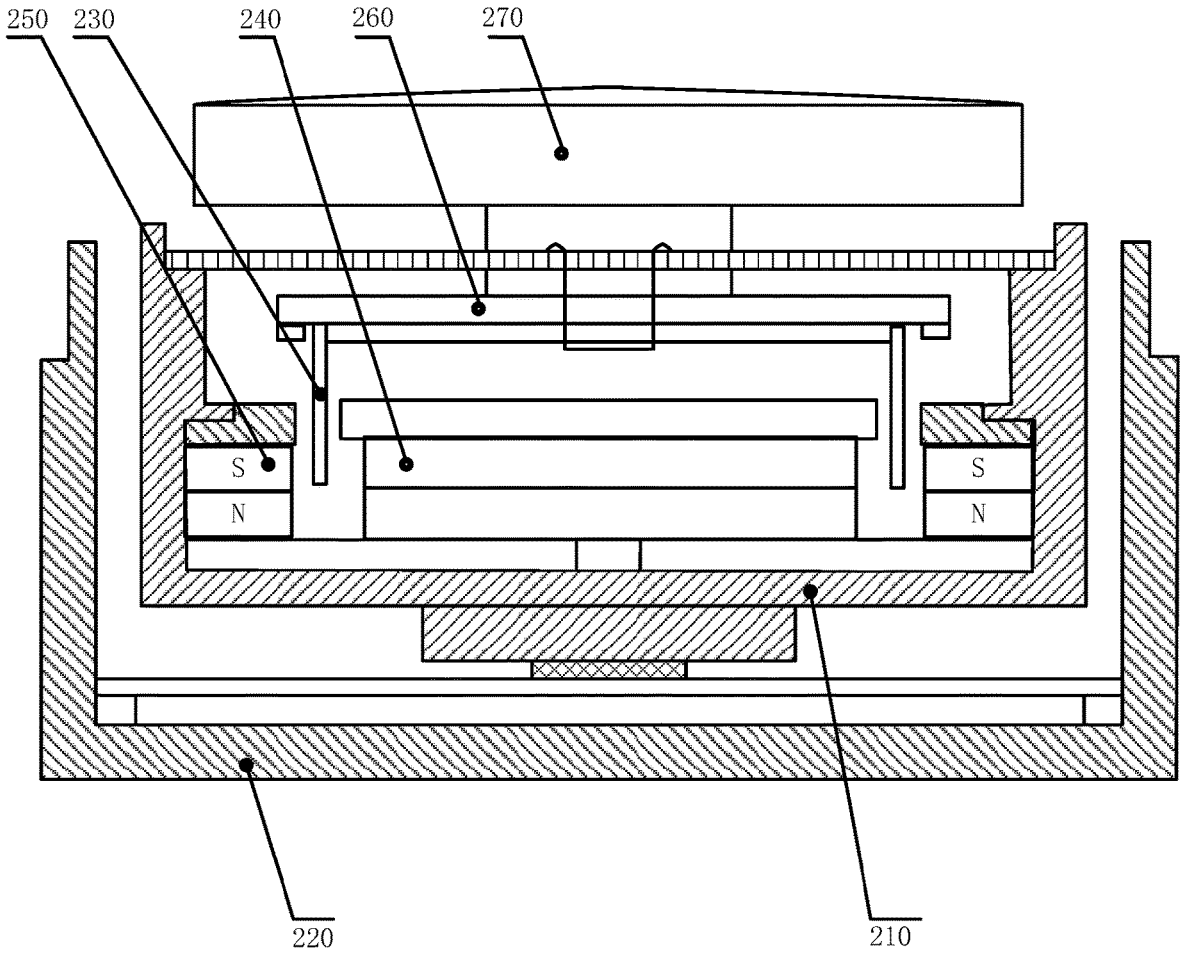
FIG. 2 is a schematic structure illustrating another bone conduction speaker of prior art.
Figure 3:
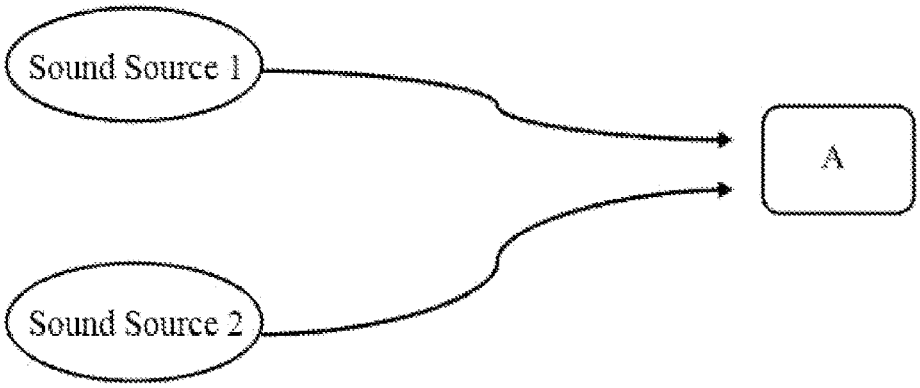
FIG. 3 illustrates the principle of sound interference according to some embodiments of the present disclosure.

To explain the scheme of the embodiments of this disclosure, the design principles of this disclosure will be introduced here. FIG. 3 illustrates the principles of sound interference according to some embodiments of the present disclosure. Two or more sound waves may interfere in the space based on, for example, the frequency and/or amplitude of the waves. Specifically, the amplitudes of the sound waves with the same frequency may be overlaid to generate a strengthened wave or a weakened wave. As shown in FIG. 3, sound source 1 and sound source 2 have the same frequency and locate in different locations in the space. The sound waves generated from these two sound sources may encounter in an arbitrary point A. If the phases of the sound wave 1 and sound wave 2 are the same at point A, the amplitudes of the two sound waves may be added, generating a strengthened sound wave signal at point A; on the other hand, if the phases of the two sound waves are opposite at point A, their amplitudes may be offset, generating a weakened sound wave signal at point A.

This disclosure applies above-noted the principles of sound wave interference to a bone conduction speaker and disclose a bone conduction speaker that can reduce sound leakage.

Embodiment One

Figure 4A:
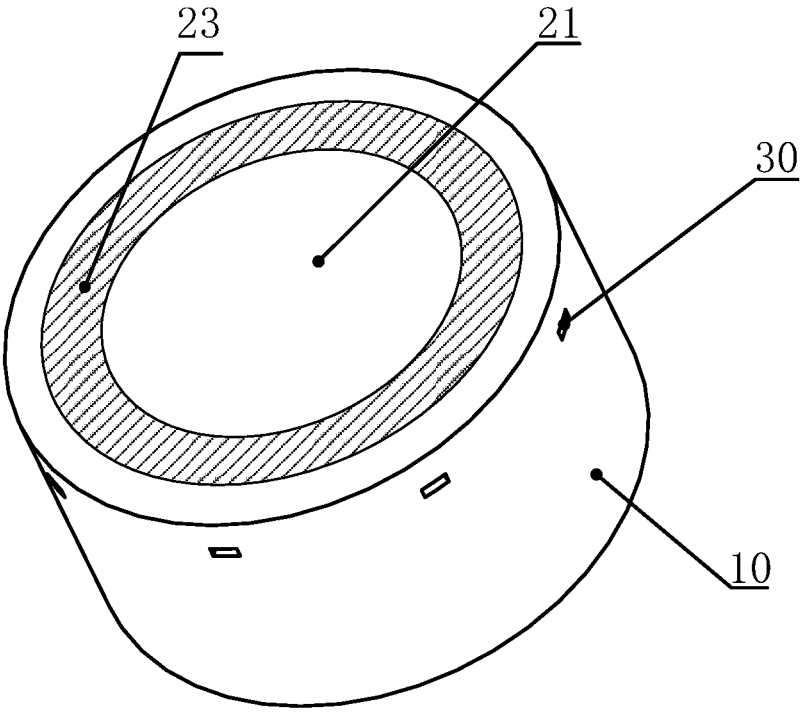
FIGS. 4A and 4B are schematic structures of an exemplary bone conduction speaker according to some embodiments of the present disclosure.
Figure 4B:
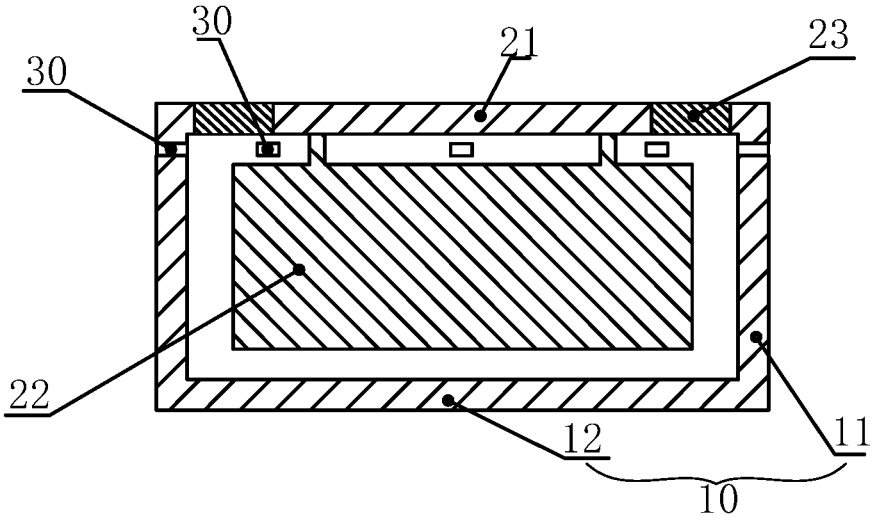

FIGS. 4A and 4B are schematic structures of an exemplary bone conduction speaker. The bone conduction speaker may include a housing 10, a vibration board 21, and a transducer 22. The transducer 22 may be inside the housing 10 and configured to generate vibrations. The housing 10 may have one or more sound guiding holes 30. The sound guiding hole(s) 30 may be configured to guide sound waves inside the housing 10 to the outside of the housing 10. In some embodiments, the guided sound waves may form interference with leaked sound waves generated by the vibrations of the housing 10, so as to reducing the amplitude of the leaked sound. The transducer 22 may be configured to convert an electrical signal to mechanical vibrations. For example, an audio electrical signal may be transmitted into a voice coil that is placed in a magnet, and the electromagnetic interaction may cause the voice coil to vibrate based on the audio electrical signal. As another example, the transducer 22 may include piezoelectric ceramics, shape changes of which may cause vibrations in accordance with electrical signals received.

Furthermore, the vibration board 21 may be connected to the transducer 22 and configured to vibrate along with the transducer 22. The vibration board 21 may stretch out from the opening of the housing 10, and touch the skin of the user and pass vibrations to auditory nerves through human tissues and bones, which in turn enables the user to hear sound. The linking component 23 may reside between the transducer 22 and the housing 10, configured to fix the vibrating transducer 122 inside the housing. The linking component 23 may include one or more separate components, or may be integrated with the transducer 22 or the housing 10. In some embodiments, the linking component 23 is made of an elastic material.

The transducer 22 may drive the vibration board 21 to vibrate. The transducer 22, which resides inside the housing 10, may vibrate. The vibrations of the transducer 22 may drives the air inside the housing 10 to vibrate, producing a sound wave inside the housing 10, which can be referred to as "sound wave inside the housing." Since the vibration board 21 and the transducer 22 are fixed to the housing 10 via the linking component 23, the vibrations may pass to the housing 10, causing the housing 10 to vibrate synchronously. The vibrations of the housing 10 may generate a leaked sound wave, which spreads outwards as sound leakage.

The sound wave inside the housing and the leaked sound wave are like the two sound sources in FIG. 3. In some embodiments, the sidewall 11 of the housing 10 may have one or more sound guiding holes 30 configured to guide the sound wave inside the housing 10 to the outside. The guided sound wave through the sound guiding hole(s) 30 may interfere with the leaked sound wave generated by the vibrations of the housing 10, and the amplitude of the leaked sound wave may be reduced due to the interference, which may result in a reduced sound leakage. Therefore, the design of this embodiment can solve the sound leakage problem to some extent by making an improvement of setting a sound guiding hole on the housing, and not increasing the volume and weight of the bone conduction speaker.

In some embodiments, one sound guiding hole 30 is set on the upper portion of the sidewall 11. As used herein, the upper portion of the sidewall 11 refers to the portion of the sidewall 11 starting from the top of the sidewall (contacting with the vibration board 21) to about the ⅓ height of the sidewall.

Figure 4C:
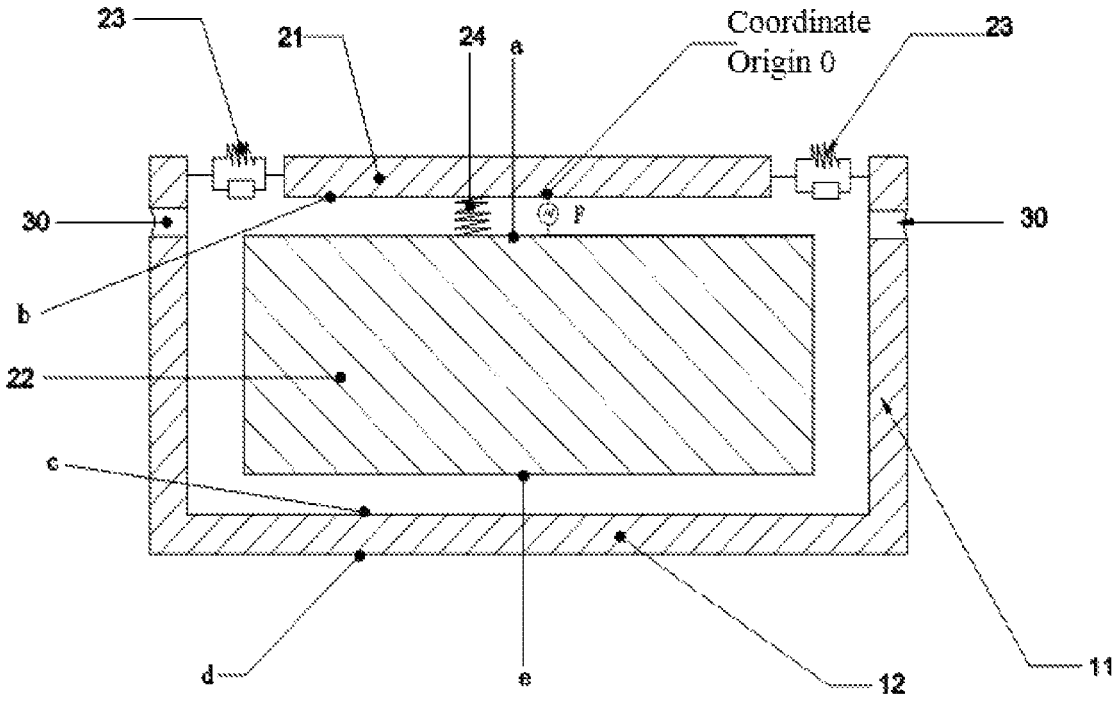
FIG. 4C is a schematic structure of the bone conduction speaker according to some embodiments of the present disclosure.

FIG. 4C is a schematic structure of the bone conduction speaker illustrated in FIGS. 4A-4B. The structure of the bone conduction speaker is further illustrated with mechanics elements illustrated in FIG. 4C. As shown in FIG. 4C, the linking component 23 between the sidewall 11 of the housing 10 and the vibration board 21 may be represented by an elastic element 23 and a damping element in the parallel connection. The linking relationship between the vibration board 21 and the transducer 22 may be represented by an elastic element 24.

Outside the housing 10, the sound leakage reduction is proportional to $$(\iint_{S_{hole}} P ds - \iint_{S_{housing}} P_d ds), \tag{1}$$

wherein $S_{hole}$ is the area of the opening of the sound guiding hole 30, $S_{housing}$ is the area of the housing 10 (e.g., the sidewall 11 and the bottom 12) that is not in contact with human face.

The pressure inside the housing may be expressed as $$P = P_a + P_b + P_c + P_e, \tag{2}$$

wherein $P_a$, $P_b$, $P_c$ and $P_e$ are the sound pressures of an arbitrary point inside the housing 10 generated by side a, side b, side c and side e (as illustrated in FIG. 4C), respectively. As used herein, side a refers to the upper surface of the transducer 22 that is close to the vibration board 21, side b refers to the lower surface of the vibration board 21 that is close to the transducer 22, side c refers to the inner upper surface of the bottom 12 that is close to the transducer 22, and side e refers to the lower surface of the transducer 22 that is close to the bottom 12.

The center of the side b, O point, is set as the origin of the space coordinates, and the side b can be set as the z=plane, so $P_a$, $P_b$, $P_c$ and $P_e$ may be expressed as follows:

$$P_a(x, y, z) = -j\omega\rho_0 \int\int_{S_a} W_a(x'_a, y'_a) \cdot \frac{e^{jkR(x'_a, y'_a)}}{4\pi R(x'_a, y'_a)} dx'_a dy'_a - P_{aR}, \tag{3}$$

$$P_b(x, y, z) = -j\omega\rho_0 \int\int_{S_b} W_b(x', y') \cdot \frac{e^{jkR(x', y')}}{4\pi R(x', y')} dx' dy' - P_{bR}, \tag{4}$$

$$P_c(x, y, z) = -j\omega\rho_0 \int\int_{S_c} W_c(x'_c, y'_c) \cdot \frac{e^{jkR(x'_c, y'_c)}}{4\pi R(x'_c, y'_c)} dx'_c dy'_c - P_{cR}, \tag{5}$$

$$P_e(x, y, z) = -j\omega\rho_0 \int\int_{S_e} W_e(x'_e, y'_e) \cdot \frac{e^{jkR(x'_e, y'_e)}}{4\pi R(x'_e, y'_e)} dx'_e dy'_e - P_{eR}, \tag{6}$$

wherein $R(x', y') = \sqrt{(x-x')^2 + (y-y')^2 + z^2}$ is the distance between an observation point (x, y, z) and a point on side b (x', y', 0); $S_a$, $S_b$, $S_c$ and $S_e$ are the areas of side a, side b, side c and side e, respectively;

$R(x'_a, y'_a) = \sqrt{(x-x_a')^2 + (y-y_a')^2 + (z-z_a')^2}$ is the distance between the observation point (x, y, z) and a point on side a ($x'_a$, $y'_a$, $z_a$);

$R(x'_c, y'_c) = \sqrt{(x-x_c')^2 + (y-y_c')^2 + (z-z_c')^2}$ is the distance between the observation point (x, y, z) and a point on side a ($x'_c$, $y'_c$, $z_c$);

$R(x'_e, y'_e) = \sqrt{(x-x_e')^2 + (y-y_e')^2 + (z-z_e')^2}$ is the distance between the observation point (x, y, z) and a point on side a ($x'_e$, $y'_e$, $z_e$);

$k = \omega/u$ (u is the velocity of sound) is wave number, $\rho_0$ is an air density, ω is an angular frequency of vibration.

$P_{aR}$, $P_{bR}$, $P_{cR}$ and $P_{eR}$ are acoustic resistances of air, which respectively are:

$$P_{aR} = A \cdot \frac{z_a \cdot r + j\omega \cdot z_a \cdot r'}{\varphi} + \delta, \tag{7}$$

$$P_{bR} = A \cdot \frac{z_b \cdot r + j\omega \cdot z_b \cdot r'}{\varphi} + \delta, \tag{8}$$

$$P_{cR} = A \cdot \frac{z_c \cdot r + j\omega \cdot z_c \cdot r'}{\varphi} + \delta, \tag{9}$$

$$P_{eR} = A \cdot \frac{z_e \cdot r + j\omega \cdot z_e \cdot r'}{\varphi} + \delta, \tag{10}$$

wherein r is the acoustic resistance per unit length, r' is the sound quality per unit length, $z_a$ is the distance between the observation point and side a, $z_b$ is the distance between the observation point and side b, $z_c$ is the distance between the observation point and side c, $z_e$ is the distance between the observation point and side e.

$W_a(x, y)$, $W_b(x, y)$, $W_c(x, y)$, $W_e(x, y)$ and $W_d(x, y)$ are the sound source power per unit area of side a, side b, side c, side e and side d, respectively, which can be derived from following formulas (11):

$$F_e = F_a = F - k_1 \cos \omega t - \iint_{S_a} W_a(x,y) dxdy - \iint_{S_e} W_e(x,y) dxdy - f$$

$$F_b = -F + k_1 \cos \omega t + \iint_{S_b} W_b(x,y) dxdy - \iint_{S_e} W_e(x,y) dxdy - L$$

$$F_c = F_d = F_b - k_2 \cos \omega t - \iint_{S_c} W_c(x,y) dxdy - f - y$$

$$F_d = F_b - k_2 \cos \omega t - \iint_{S_d} W_d(x,y) dxdy \tag{11}$$

wherein F is the driving force generated by the transducer 22, $F_a$, $F_b$, $F_c$, $F_d$, and $F_e$ are the driving forces of side a, side b, side c, side d and side e, respectively. As used herein, side d is the outside surface of the bottom 12. $S_d$ is the region of side d, f is the viscous resistance formed in the small gap of the sidewalls, and $f = \eta \Delta S(dv/dy)$.

L is the equivalent load on human face when the vibration board acts on the human face, γ is the energy dissipated on elastic element 24, $k_1$ and $k_2$ are the elastic coefficients of elastic element 23 and elastic element 24 respectively, η is the fluid viscosity coefficient, dv/dy is the velocity gradient of fluid, Δs is the cross-section area of a subject (board), A is the amplitude, φ is the region of the sound field, and δ is a high order minimum (which is generated by the incompletely symmetrical shape of the housing).

The sound pressure of an arbitrary point outside the housing, generated by the vibration of the housing 10 is expressed as:

$$P_d = -j\omega\rho_0 \int\int W_d(x'_d, y'_d) \cdot \frac{e^{jkR(x'_d, y'_d)}}{4\pi R(x'_d, y'_d)} dx'_d dy'_d, \tag{12}$$

wherein $R(x'_d, y'_d) = \sqrt{(x-x_d')^2 + (y-y_d')^2 + (z-z_d')^2}$ is the distance between the observation point (x, y, z) and a point on side d ($x'_d$, $y'_d$, $z'_d$).

$P_a$, $P_b$, $P_c$ and $P_e$ are functions of the position, when we set a hole on an arbitrary position in the housing, if the area of the hole is $S_{hole}$, the sound pressure of the hole is $\iint_{S_{hole}} Pds$.

In the meanwhile, because the vibration board 21 fits human tissues tightly, the power it gives out is absorbed all by human tissues, so the only side that can push air outside the housing to vibrate is side d, thus forming sound leakage. As described elsewhere, the sound leakage is resulted from the vibrations of the housing 10. For illustrative purposes, the sound pressure generated by the housing 10 may be expressed as $\iint_{S_{housing}} P_d ds$.

The leaked sound wave and the guided sound wave interference may result in a weakened sound wave, i.e., to make $\iint_{S_{hole}} Pds$ and $\iint_{S_{housing}} P_d ds$ have the same value but opposite directions, and the sound leakage may be reduced. In some embodiments, $\iint_{S_{hole}} Pds$ may be adjusted to reduce the sound leakage. Since $\iint_{S_{hole}} Pds$ corresponds to information of phases and amplitudes of one or more holes, which further relates to dimensions of the housing of the bone conduction speaker, the vibration frequency of the transducer, the position, shape, quantity and/or size of the sound guiding holes and whether there is damping inside the holes. Thus, the position, shape, and quantity of sound guiding holes, and/or damping materials may be adjusted to reduce sound leakage.

According to the formulas above, a person having ordinary skill in the art would understand that the effectiveness of reducing sound leakage is related to the dimensions of the housing of the bone conduction speaker, the vibration frequency of the transducer, the position, shape, quantity and size of the sound guiding hole(s) and whether there is damping inside the sound guiding hole(s). Accordingly, various configurations, depending on specific needs, may be obtained by choosing specific position where the sound guiding hole(s) is located, the shape and/or quantity of the sound guiding hole(s) as well as the damping material.

Figure 5:
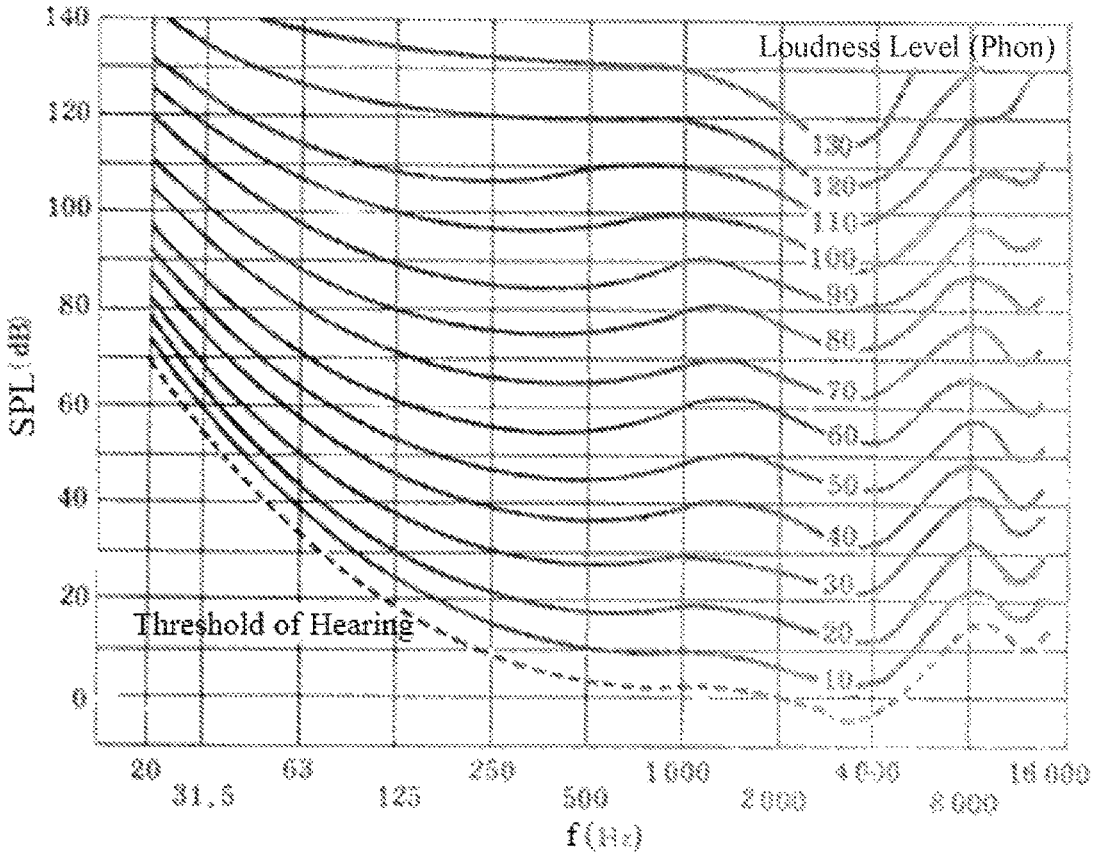
FIG. 5 is a diagram illustrating the equal-loudness contour curves according to some embodiments of the present disclosure.

FIG. 5 is a diagram illustrating the equal-loudness contour curves according to some embodiments of the present disclose. The horizontal coordinate is frequency, while the vertical coordinate is sound pressure level (SPL). As used herein, the SPL refers to the change of atmospheric pressure after being disturbed, i.e., a surplus pressure of the atmospheric pressure, which is equivalent to an atmospheric pressure added to a pressure change caused by the disturbance. As a result, the sound pressure may reflect the amplitude of a sound wave. In FIG. 5, on each curve, sound pressure levels corresponding to different frequencies are different, while the loudness levels felt by human ears are the same. For example, each curve is labeled with a number representing the loudness level of said curve. According to the loudness level curves, when volume (sound pressure amplitude) is lower, human ears are not sensitive to sounds of high or low frequencies; when volume is higher, human ears are more sensitive to sounds of high or low frequencies. Bone conduction speakers may generate sound relating to different frequency ranges, such as 1000 Hz~4000 Hz, or 1000 Hz~4000 Hz, or 1000 Hz~3500 Hz, or 1000 Hz~3000 Hz, or 1500 Hz~3000 Hz. The sound leakage within the above-mentioned frequency ranges may be the sound leakage aimed to be reduced with a priority.

Figure 4D:
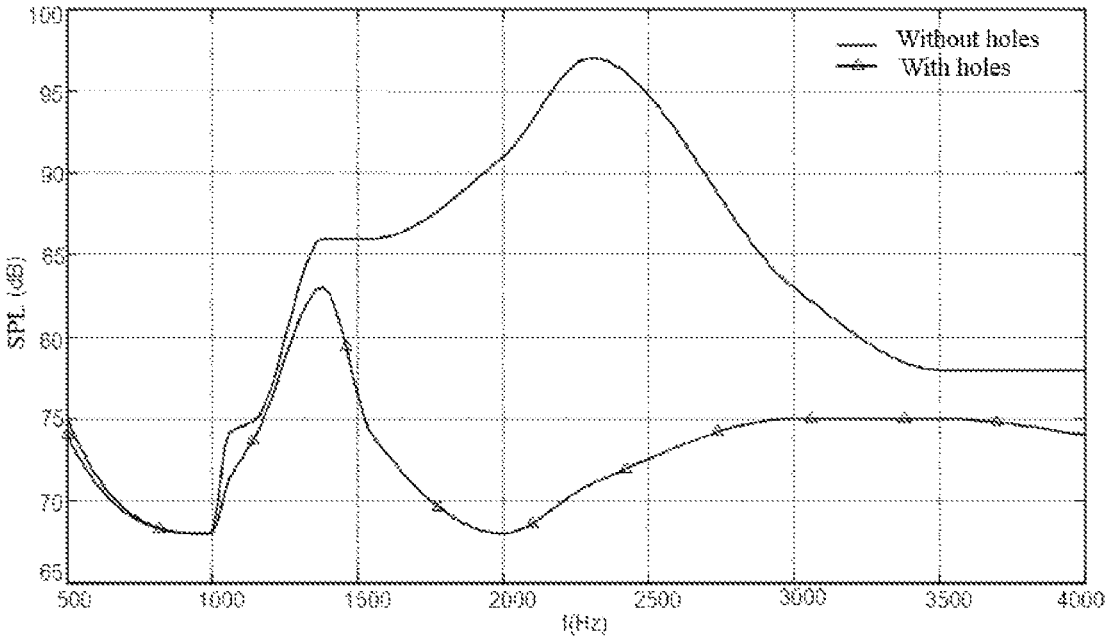
FIG. 4D is a diagram illustrating reduced sound leakage of the bone conduction speaker according to some embodiments of the present disclosure.

FIG. 4D is a diagram illustrating the effect of reduced sound leakage according to some embodiments of the present disclosure, wherein the test results and calculation results are close in the above range. The bone conduction speaker being tested includes a cylindrical housing, which includes a sidewall and a bottom, as described in FIGS. 4A and 4B. The cylindrical housing is in a cylinder shape having a radius of 22 mm, the sidewall height of 14 mm, and a plurality of sound guiding holes being set on the upper portion of the sidewall of the housing. The openings of the sound guiding holes are rectangle. The sound guiding holes are arranged evenly on the sidewall. The target region where the sound leakage is to be reduced is 50 cm away from the outside of the bottom of the housing. The distance of the leaked sound wave spreading to the target region and the distance of the sound wave spreading from the surface of the transducer 20 through the sound guiding holes 30 to the target region have a difference of about 180 degrees in phase. As shown, the leaked sound wave is reduced in the target region dramatically or even be eliminated.

According to the embodiments in this disclosure, the effectiveness of reducing sound leakage after setting sound guiding holes is very obvious. As shown in FIG. 4D, the bone conduction speaker having sound guiding holes greatly reduce the sound leakage compared to the bone conduction speaker without sound guiding holes.

In the tested frequency range, after setting sound guiding holes, the sound leakage is reduced by about 10 dB on average. Specifically, in the frequency range of 1500 Hz~3000 Hz, the sound leakage is reduced by over 10 dB. In the frequency range of 2000 Hz~2500 Hz, the sound leakage is reduced by over 20 dB compared to the scheme without sound guiding holes.

A person having ordinary skill in the art can understand from the above-mentioned formulas that when the dimensions of the bone conduction speaker, target regions to reduce sound leakage and frequencies of sound waves differ, the position, shape and quantity of sound guiding holes also need to adjust accordingly.

For example, in a cylinder housing, according to different needs, a plurality of sound guiding holes may be on the sidewall and/or the bottom of the housing. Preferably, the sound guiding hole may be set on the upper portion and/or lower portion of the sidewall of the housing. The quantity of the sound guiding holes set on the sidewall of the housing is no less than two. Preferably, the sound guiding holes may be arranged evenly or unevenly in one or more circles with respect to the center of the bottom. In some embodiments, the sound guiding holes may be arranged in at least one circle. In some embodiments, one sound guiding hole may be set on the bottom of the housing. In some embodiments, the sound guiding hole may be set at the center of the bottom of the housing.

The quantity of the sound guiding holes can be one or more. Preferably, multiple sound guiding holes may be set symmetrically on the housing. In some embodiments, there are 6-8 circularly arranged sound guiding holes.

The openings (and cross sections) of sound guiding holes may be circle, ellipse, rectangle, or slit. Slit generally means slit along with straight lines, curve lines, or arc lines. Different sound guiding holes in one bone conduction speaker may have same or different shapes.

A person having ordinary skill in the art can understand that, the sidewall of the housing may not be cylindrical, the sound guiding holes can be arranged asymmetrically as needed. Various configurations may be obtained by setting different combinations of the shape, quantity, and position of the sound guiding. Some other embodiments along with the figures are described as follows.

In some embodiments, the leaked sound wave may be generated by a portion of the housing 10. The portion of the housing may be the sidewall 11 of the housing 10 and/or the bottom 12 of the housing 10. Merely by way of example, the leaked sound wave may be generated by the bottom 12 of the housing 10. The guided sound wave output through the sound guiding hole(s) 30 may interfere with the leaked sound wave generated by the portion of the housing 10. The interference may enhance or reduce a sound pressure level of the guided sound wave and/or leaked sound wave in the target region.

In some embodiments, the portion of the housing 10 that generates the leaked sound wave may be regarded as a first sound source (e.g., the sound source 1 illustrated in FIG. 3), and the sound guiding hole(s) 30 or a part thereof may be regarded as a second sound source (e.g., the sound source 2 illustrated in FIG. 3). Merely for illustration purposes, if the size of the sound guiding hole on the housing 10 is small, the sound guiding hole may be approximately regarded as a point sound source. In some embodiments, any number or count of sound guiding holes provided on the housing 10 for outputting sound may be approximated as a single point sound source. Similarly, for simplicity, the portion of the housing 10 that generates the leaked sound wave may also be approximately regarded as a point sound source. In some embodiments, both the first sound source and the second sound source may approximately be regarded as point sound sources (also referred to as two-point sound sources).

Figure 4E:
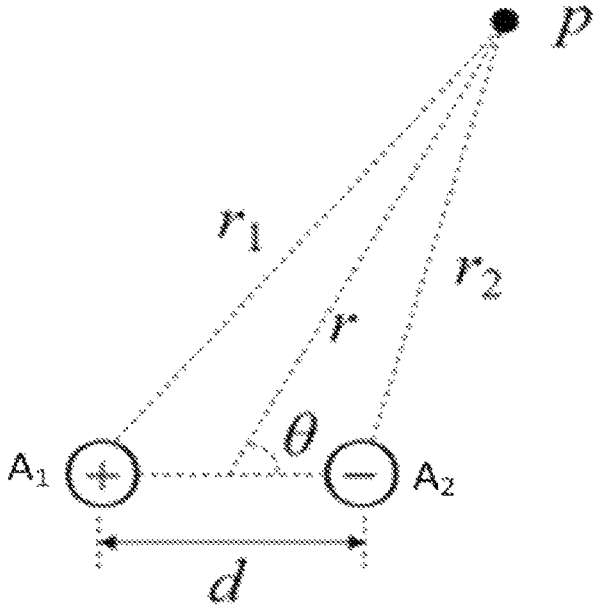
FIG. 4E is a schematic diagram illustrating exemplary two-point sound sources according to some embodiments of the present disclosure.

FIG. 4E is a schematic diagram illustrating exemplary two-point sound sources according to some embodiments of the present disclosure. The sound field pressure p generated by a single point sound source may satisfy Equation (13):

$$p = \frac{j\omega\rho_0}{4\pi r} Q_0 \exp j(\omega t - kr), \tag{13}$$

where ω denotes an angular frequency, $\rho_0$ denotes an air density, r denotes a distance between a target point and the sound source, $Q_0$ denotes a volume velocity of the sound source, and k denotes a wave number. It may be concluded that the magnitude of the sound field pressure of the sound field of the point sound source is inversely proportional to the distance to the point sound source.

It should be noted that, the sound guiding hole(s) for outputting sound as a point sound source may only serve as an explanation of the principle and effect of the present disclosure, and the shape and/or size of the sound guiding hole(s) may not be limited in practical applications. In some embodiments, if the area of the sound guiding hole is large, the sound guiding hole may also be equivalent to a planar sound source. Similarly, if an area of the portion of the housing 10 that generates the leaked sound wave is large (e.g., the portion of the housing 10 is a vibration surface or a sound radiation surface), the portion of the housing 10 may also be equivalent to a planar sound source. For those skilled in the art, without creative activities, it may be known that sounds generated by structures such as sound guiding holes, vibration surfaces, and sound radiation surfaces may be equivalent to point sound sources at the spatial scale discussed in the present disclosure, and may have consistent sound propagation characteristics and the same mathematical description method. Further, for those skilled in the art, without creative activities, it may be known that the acoustic effect achieved by the two-point sound sources may also be implemented by alternative acoustic structures. According to actual situations, the alternative acoustic structures may be modified and/or combined discretionarily, and the same acoustic output effect may be achieved.

The two-point sound sources may be formed such that the guided sound wave output from the sound guiding hole(s) may interfere with the leaked sound wave generated by the portion of the housing 10. The interference may reduce a sound pressure level of the leaked sound wave in the surrounding environment (e.g., the target region). For convenience, the sound waves output from an acoustic output device (e.g., the bone conduction speaker) to the surrounding environment may be referred to as far-field leakage since it may be heard by others in the environment. The sound waves output from the acoustic output device to the ears of the user may also be referred to as near-field sound since a distance between the bone conduction speaker and the user may be relatively short. In some embodiments, the sound waves output from the two-point sound sources may have a same frequency or frequency range (e.g., 800 Hz, 1000 Hz, 1500 Hz, 3000 Hz, etc.). In some embodiments, the sound waves output from the two-point sound sources may have a certain phase difference. In some embodiments, the sound guiding hole includes a damping layer. The damping layer may be, for example, a tuning paper, a tuning cotton, a nonwoven fabric, a silk, a cotton, a sponge, or a rubber. The damping layer may be configured to adjust the phase of the guided sound wave in the target region. The acoustic output device described herein may include a bone conduction speaker or an air conduction speaker. For example, a portion of the housing (e.g., the bottom of the housing) of the bone conduction speaker may be treated as one of the two-point sound sources, and at least one sound guiding holes of the bone conduction speaker may be treated as the other one of the two-point sound sources. As another example, one sound guiding hole of an air conduction speaker may be treated as one of the two-point sound sources, and another sound guiding hole of the air conduction speaker may be treated as the other one of the two-point sound sources. It should be noted that, although the construction of two-point sound sources may be different in bone conduction speaker and air conduction speaker, the principles of the interference between the various constructed two-point sound sources are the same. Thus, the equivalence of the two-point sound sources in a bone conduction speaker disclosed elsewhere in the present disclosure is also applicable for an air conduction speaker.

In some embodiments, when the position and phase difference of the two-point sound sources meet certain conditions, the acoustic output device may output different sound effects in the near field (for example, the position of the user's ear) and the far field. For example, if the phases of the point sound sources corresponding to the portion of the housing 10 and the sound guiding hole(s) are opposite, that is, an absolute value of the phase difference between the two-point sound sources is 180 degrees, the far-field leakage may be reduced according to the principle of reversed phase cancellation.

In some embodiments, the interference between the guided sound wave and the leaked sound wave at a specific frequency may relate to a distance between the sound guiding hole(s) and the portion of the housing 10. For example, if the sound guiding hole(s) are set at the upper portion of the sidewall of the housing 10 (as illustrated in FIG. 4A), the distance between the sound guiding hole(s) and the portion of the housing 10 may be large. Correspondingly, the frequencies of sound waves generated by such two-point sound sources may be in a mid-low frequency range (e.g., 1500-2000 Hz, 1500-2500 Hz, etc.). Referring to FIG. 4D, the interference may reduce the sound pressure level of the leaked sound wave in the mid-low frequency range (i.e., the sound leakage is low).

Merely by way of example, the low frequency range may refer to frequencies in a range below a first frequency threshold. The high frequency range may refer to frequencies in a range exceed a second frequency threshold. The first frequency threshold may be lower than the second frequency threshold. The mid-low frequency range may refer to frequencies in a range between the first frequency threshold and the second frequency threshold. For example, the first frequency threshold may be 1000 Hz, and the second frequency threshold may be 3000 Hz. The low frequency range may refer to frequencies in a range below 1000 Hz, the high frequency range may refer to frequencies in a range above 3000 Hz, and the mid-low frequency range may refer to frequencies in a range of 1000-2000 Hz, 1500-2500 Hz, etc. In some embodiments, a middle frequency range, a mid-high frequency range may also be determined between the first frequency threshold and the second frequency threshold. In some embodiments, the mid-low frequency range and the low frequency range may partially overlap. The mid-high frequency range and the high frequency range may partially overlap. For example, the mid-high frequency range may refer to frequencies in a range above 3000 Hz, and the mid-low frequency range may refer to frequencies in a range of 2800-3500 Hz. It should be noted that the low frequency range, the mid-low frequency range, the middle frequency range, the mid-high frequency range, and/or the high frequency range may be set flexibly according to different situations, and are not limited herein.

In some embodiments, the frequencies of the guided sound wave and the leaked sound wave may be set in a low frequency range (e.g., below 800 Hz, below 1200 Hz, etc.). In some embodiments, the amplitudes of the sound waves generated by the two-point sound sources may be set to be different in the low frequency range. For example, the amplitude of the guided sound wave may be smaller than the amplitude of the leaked sound wave. In this case, the interference may not reduce sound pressure of the near-field sound in the low-frequency range. The sound pressure of the near-field sound may be improved in the low-frequency range. The volume of the sound heard by the user may be improved.

In some embodiments, the amplitude of the guided sound wave may be adjusted by setting an acoustic resistance structure in the sound guiding hole(s) 30. The material of the acoustic resistance structure disposed in the sound guiding hole 30 may include, but not limited to, plastics (e.g., high-molecular polyethylene, blown nylon, engineering plastics, etc.), cotton, nylon, fiber (e.g., glass fiber, carbon fiber, boron fiber, graphite fiber, graphene fiber, silicon carbide fiber, or aramid fiber), other single or composite materials, other organic and/or inorganic materials, etc. The thickness of the acoustic resistance structure may be 0.005 mm, 0.01 mm, 0.02 mm, 0.5 mm, 1 mm, 2 mm, etc. The structure of the acoustic resistance structure may be in a shape adapted to the shape of the sound guiding hole. For example, the acoustic resistance structure may have a shape of a cylinder, a sphere, a cubic, etc. In some embodiments, the materials, thickness, and structures of the acoustic resistance structure may be modified and/or combined to obtain a desirable acoustic resistance structure. In some embodiments, the acoustic resistance structure may be implemented by the damping layer.

In some embodiments, the amplitude of the guided sound wave output from the sound guiding hole may be relatively low (e.g., zero or almost zero). The difference between the guided sound wave and the leaked sound wave may be maximized, thus achieving a relatively large sound pressure in the near field. In this case, the sound leakage of the acoustic output device having sound guiding holes may be almost the same as the sound leakage of the acoustic output device without sound guiding holes in the low frequency range (e.g., as shown in FIG. 4D).

Embodiment Two

Figure 6:
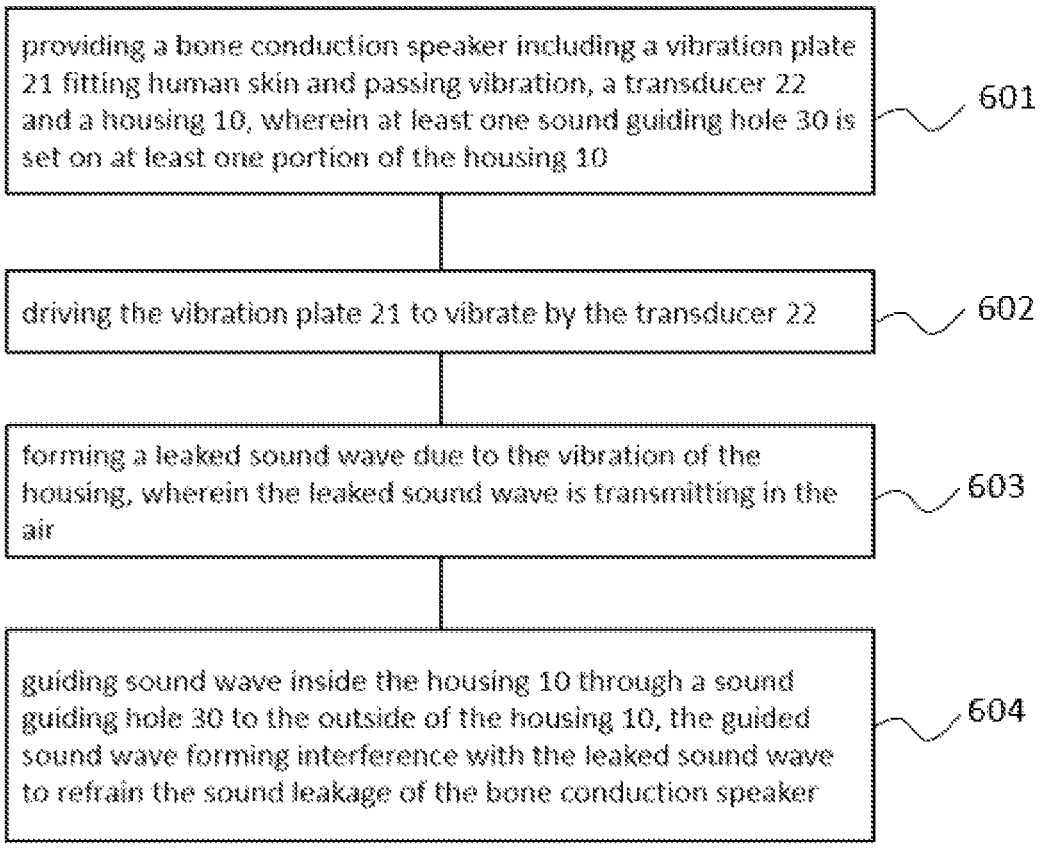
FIG. 6 is a flow chart of an exemplary method of reducing sound leakage of a bone conduction speaker according to some embodiments of the present disclosure.

FIG. 6 is a flowchart of an exemplary method of reducing sound leakage of a bone conduction speaker according to some embodiments of the present disclosure. At 601, a bone conduction speaker including a vibration plate 21 touching human skin and passing vibrations, a transducer 22, and a housing 10 is provided. At least one sound guiding hole 30 is arranged on the housing 10. At 602, the vibration plate 21 is driven by the transducer 22, causing the vibration 21 to vibrate. At 603, a leaked sound wave due to the vibrations of the housing is formed, wherein the leaked sound wave transmits in the air. At 604, a guided sound wave passing through the at least one sound guiding hole 30 from the inside to the outside of the housing 10. The guided sound wave interferes with the leaked sound wave, reducing the sound leakage of the bone conduction speaker.

The sound guiding holes 30 are preferably set at different positions of the housing 10.

The effectiveness of reducing sound leakage may be determined by the formulas and method as described above, based on which the positions of sound guiding holes may be determined.

A damping layer is preferably set in a sound guiding hole 30 to adjust the phase and amplitude of the sound wave transmitted through the sound guiding hole 30.

In some embodiments, different sound guiding holes may generate different sound waves having a same phase to reduce the leaked sound wave having the same wavelength. In some embodiments, different sound guiding holes may generate different sound waves having different phases to reduce the leaked sound waves having different wavelengths.

In some embodiments, different portions of a sound guiding hole 30 may be configured to generate sound waves having a same phase to reduce the leaked sound waves with the same wavelength. In some embodiments, different portions of a sound guiding hole 30 may be configured to generate sound waves having different phases to reduce the leaked sound waves with different wavelengths.

Additionally, the sound wave inside the housing may be processed to basically have the same value but opposite phases with the leaked sound wave, so that the sound leakage may be further reduced.

Embodiment Three

Figure 7A:
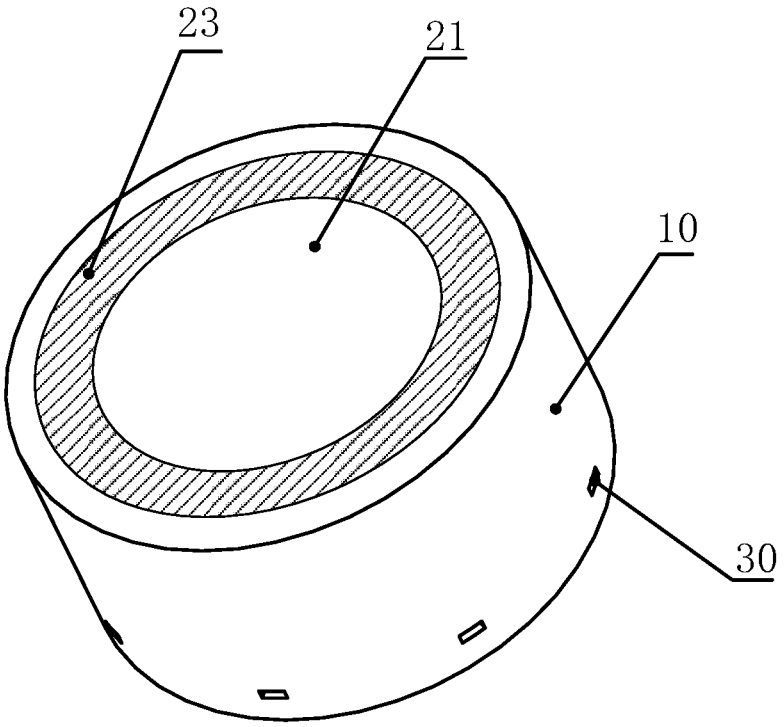
FIGS. 7A and 7B are schematic structures of an exemplary bone conduction speaker according to some embodiments of the present disclosure.
Figure 7B:
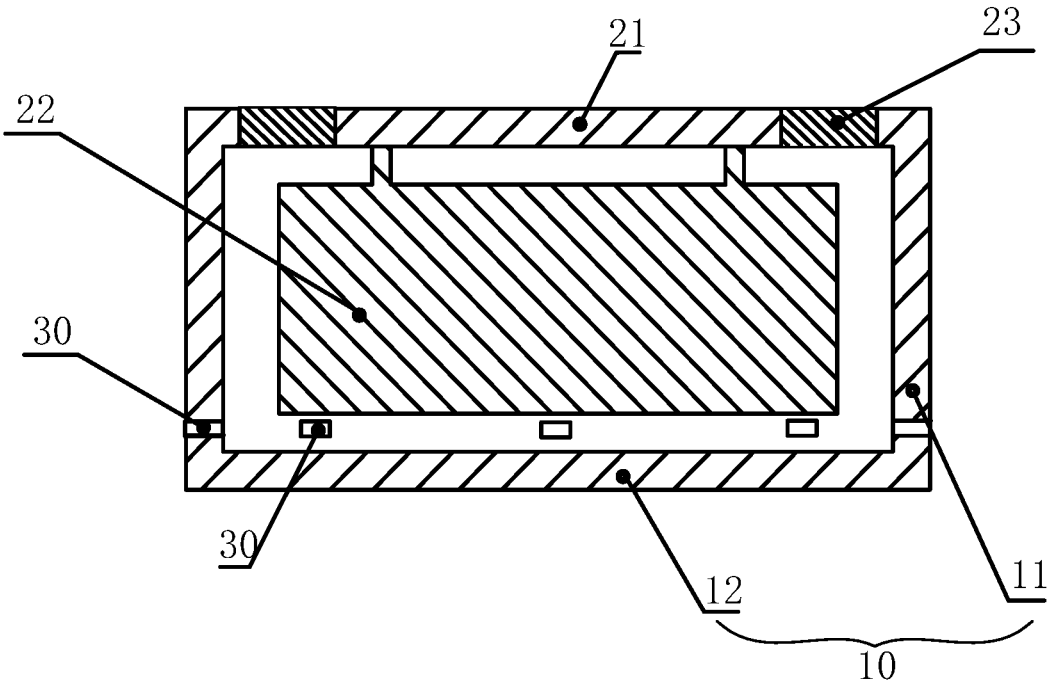

FIGS. 7A and 7B are schematic structures illustrating an exemplary bone conduction speaker according to some embodiments of the present disclosure. The bone conduction speaker may include an open housing 10, a vibration board 21, and a transducer 22. The housing 10 may cylindrical and have a sidewall and a bottom. A plurality of sound guiding holes 30 may be arranged on the lower portion of the sidewall (i.e., from about the ⅔ height of the sidewall to the bottom). The quantity of the sound guiding holes 30 may be 8, the openings of the sound guiding holes 30 may be rectangle. The sound guiding holes 30 may be arranged evenly or evenly in one or more circles on the sidewall of the housing 10.

In the embodiment, the transducer 22 is preferably implemented based on the principle of electromagnetic transduction. The transducer may include components such as magnetizer, voice coil, and etc., and the components may locate inside the housing and may generate synchronous vibrations with a same frequency.

Figure 7C:
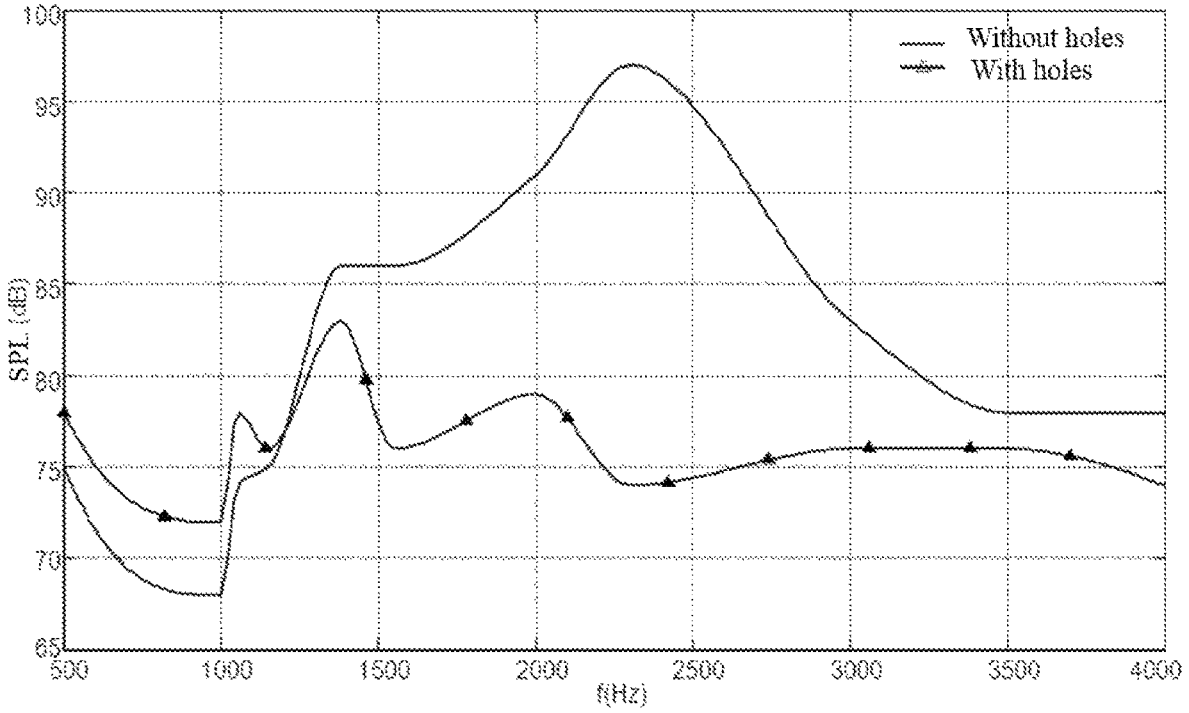
FIG. 7C is a diagram illustrating reduced sound leakage of a bone conduction speaker according to some embodiments of the present disclosure.

FIG. 7C is a diagram illustrating reduced sound leakage according to some embodiments of the present disclosure. In the frequency range of 1400 Hz~4000 Hz, the sound leakage is reduced by more than 5 dB, and in the frequency range of 2250 Hz~2500 Hz, the sound leakage is reduced by more than 20 dB.

In some embodiments, the sound guiding hole(s) at the lower portion of the sidewall of the housing 10 may also be approximately regarded as a point sound source. In some embodiments, the sound guiding hole(s) at the lower portion of the sidewall of the housing 10 and the portion of the housing 10 that generates the leaked sound wave may constitute two-point sound sources. The two-point sound sources may be formed such that the guided sound wave output from the sound guiding hole(s) at the lower portion of the sidewall of the housing 10 may interfere with the leaked sound wave generated by the portion of the housing 10. The interference may reduce a sound pressure level of the leaked sound wave in the surrounding environment (e.g., the target region) at a specific frequency or frequency range.

In some embodiments, the sound waves output from the two-point sound sources may have a same frequency or frequency range (e.g., 1000 Hz, 2500 Hz, 3000 Hz, etc.). In some embodiments, the sound waves output from the first two-point sound sources may have a certain phase difference. In this case, the interference between the sound waves generated by the first two-point sound sources may reduce a sound pressure level of the leaked sound wave in the target region. When the position and phase difference of the first two-point sound sources meet certain conditions, the acoustic output device may output different sound effects in the near field (for example, the position of the user's ear) and the far field. For example, if the phases of the first two-point sound sources are opposite, that is, an absolute value of the phase difference between the first two-point sound sources is 180 degrees, the far-field leakage may be reduced.

In some embodiments, the interference between the guided sound wave and the leaked sound wave may relate to frequencies of the guided sound wave and the leaked sound wave and/or a distance between the sound guiding hole(s) and the portion of the housing 10. For example, if the sound guiding hole(s) are set at the lower portion of the sidewall of the housing 10 (as illustrated in FIG. 7A), the distance between the sound guiding hole(s) and the portion of the housing 10 may be small. Correspondingly, the frequencies of sound waves generated by such two-point sound sources may be in a high frequency range (e.g., above 3000 Hz, above 3500 Hz, etc.). Referring to FIG. 7C, the interference may reduce the sound pressure level of the leaked sound wave in the high frequency range.

Embodiment Four

Figure 8A:
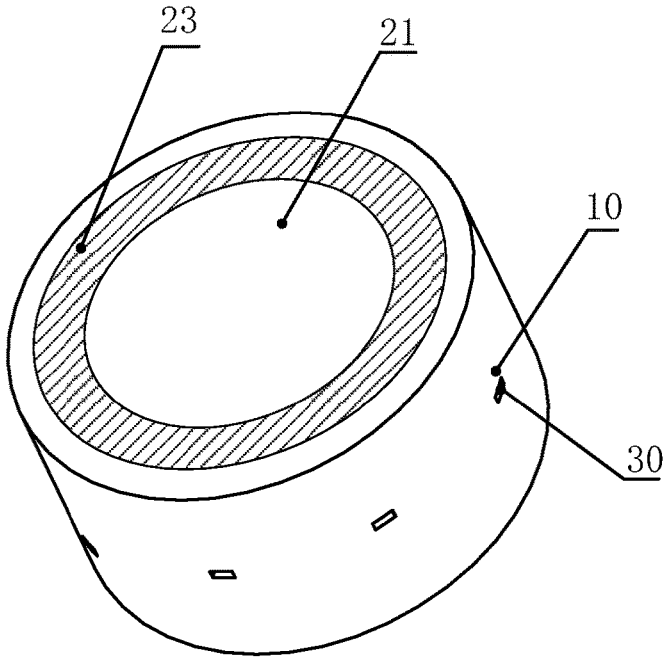
FIGS. 8A and 8B are schematic structure of an exemplary bone conduction speaker according to some embodiments of the present disclosure.
Figure 8B:
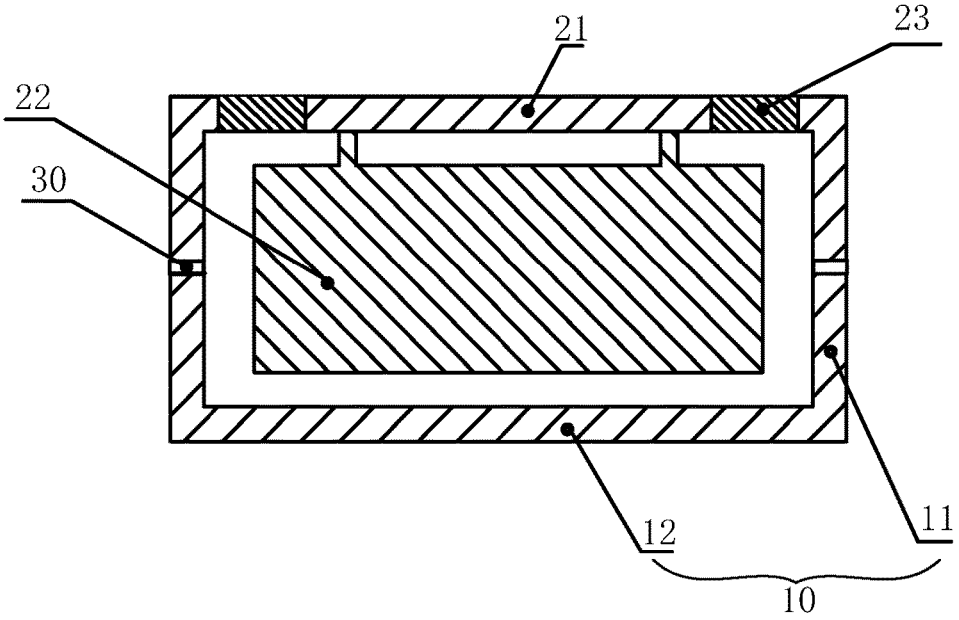

FIGS. 8A and 8B are schematic structures illustrating an exemplary bone conduction speaker according to some embodiments of the present disclosure. The bone conduction speaker may include an open housing 10, a vibration board 21, and a transducer 22. The housing 10 is cylindrical and have a sidewall and a bottom. The sound guiding holes 30 may be arranged on the central portion of the sidewall of the housing (i.e., from about the ⅓ height of the sidewall to the ⅔ height of the sidewall). The quantity of the sound guiding holes 30 may be 8, and the openings (and cross sections) of the sound guiding hole 30 may be rectangle. The sound guiding holes 30 may be arranged evenly or unevenly in one or more circles on the sidewall of the housing 10.

In the embodiment, the transducer 21 may be implemented preferably based on the principle of electromagnetic transduction. The transducer 21 may include components such as magnetizer, voice coil, etc., which may be placed inside the housing and may generate synchronous vibrations with the same frequency.

Figure 8C:
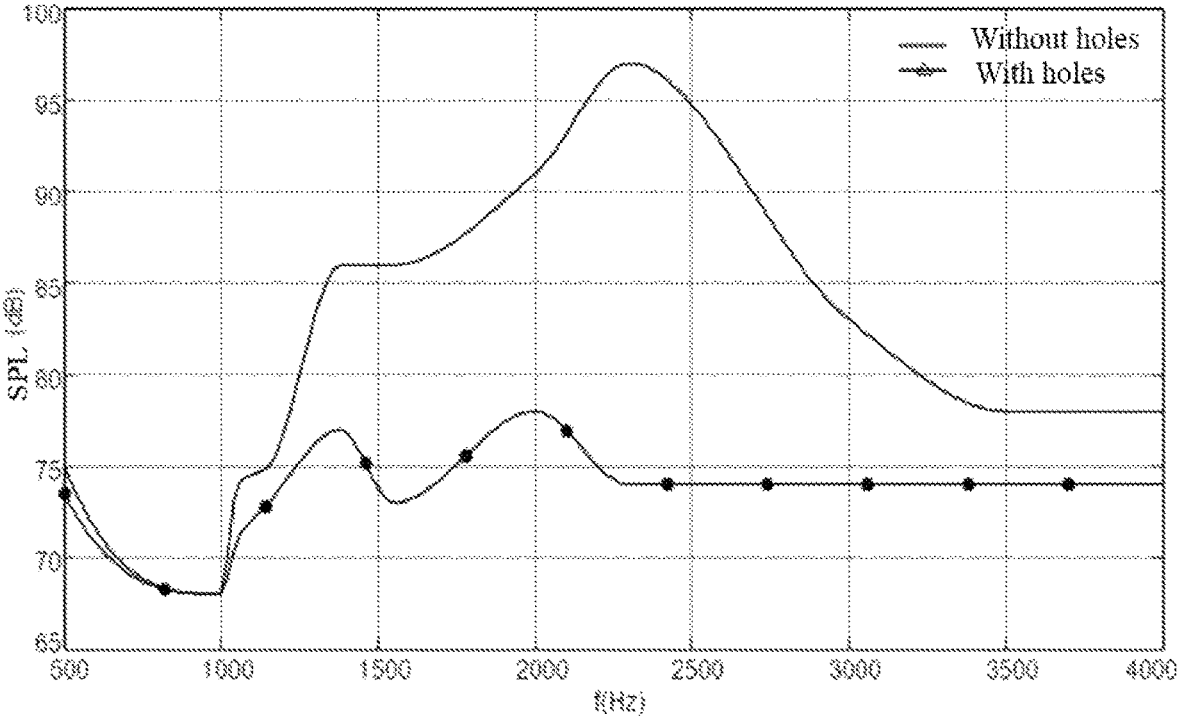
FIG. 8C is a diagram illustrating reduced sound leakage of a bone conduction speaker according to some embodiments of the present disclosure.

FIG. 8C is a diagram illustrating reduced sound leakage. In the frequency range of 1000 Hz~4000 Hz, the effectiveness of reducing sound leakage is great. For example, in the frequency range of 1400 Hz~2900 Hz, the sound leakage is reduced by more than 10 dB; in the frequency range of 2200 Hz~2500 Hz, the sound leakage is reduced by more than 20 dB.

It's illustrated that the effectiveness of reduced sound leakage can be adjusted by changing the positions of the sound guiding holes, while keeping other parameters relating to the sound guiding holes unchanged.

Embodiment Five

Figure 9A:
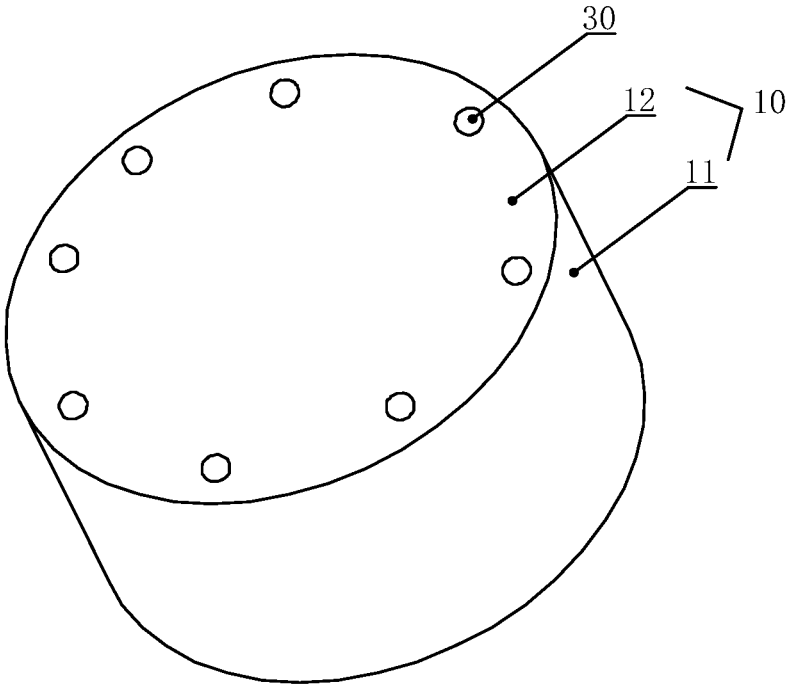
FIGS. 9A and 9B are schematic structures of an exemplary bone conduction speaker according to some embodiments of the present disclosure.
Figure 9B:
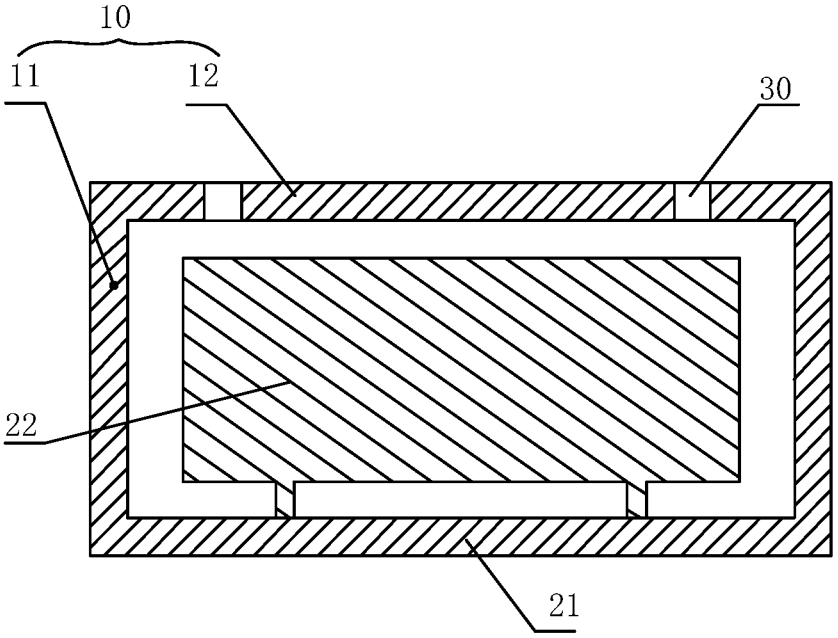

FIGS. 9A and 9B are schematic structures of an exemplary bone conduction speaker according to some embodiments of the present disclosure. The bone conduction speaker may include an open housing 10, a vibration board 21 and a transducer 22. The housing 10 is cylindrical, with a sidewall and a bottom. One or more perforative sound guiding holes 30 may be along the circumference of the bottom. In some embodiments, there may be 8 sound guiding holes 30 arranged evenly of unevenly in one or more circles on the bottom of the housing 10. In some embodiments, the shape of one or more of the sound guiding holes 30 may be rectangle.

In the embodiment, the transducer 21 may be implemented preferably based on the principle of electromagnetic transduction. The transducer 21 may include components such as magnetizer, voice coil, etc., which may be placed inside the housing and may generate synchronous vibration with the same frequency.

Figure 9C:
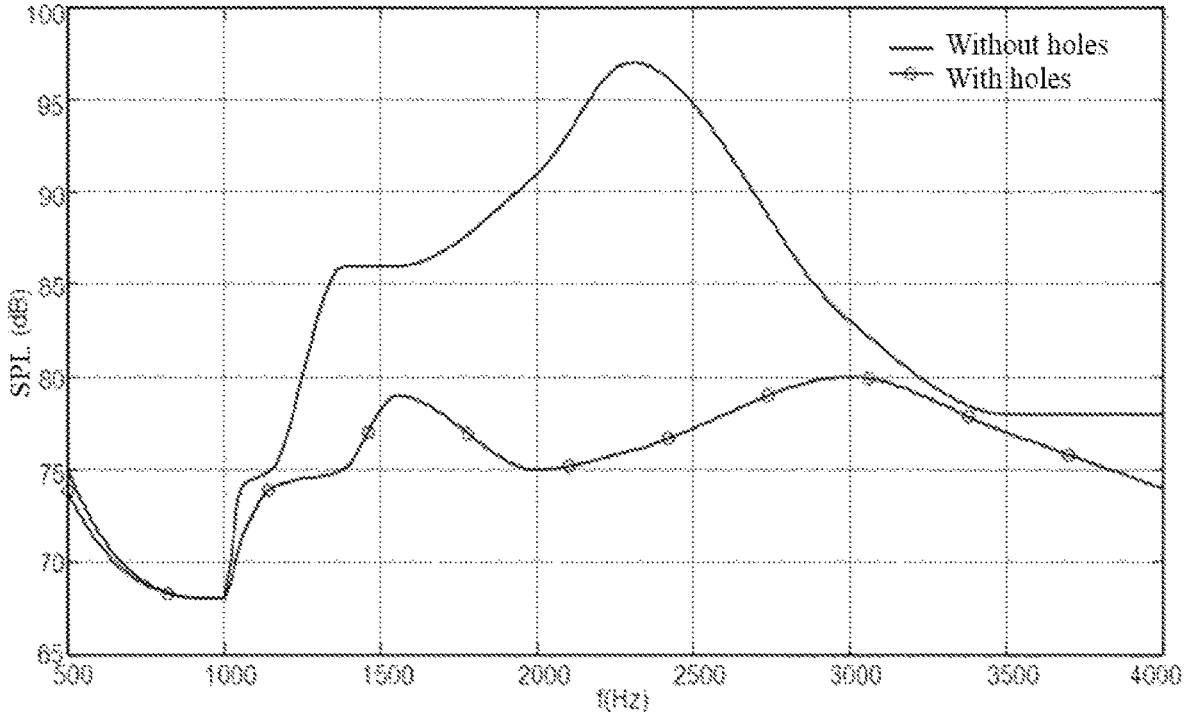
FIG. 9C is a diagram illustrating reduced sound leakage of a bone conduction speaker according to some embodiments of the present disclosure.

FIG. 9C is a diagram illustrating the effect of reduced sound leakage. In the frequency range of 1000 Hz~3000 Hz, the effectiveness of reducing sound leakage is outstanding. For example, in the frequency range of 1700 Hz~2700 Hz, the sound leakage is reduced by more than 10 dB; in the frequency range of 2200 Hz~2400 Hz, the sound leakage is reduced by more than 20 dB.

Embodiment Six

Figure 10A:
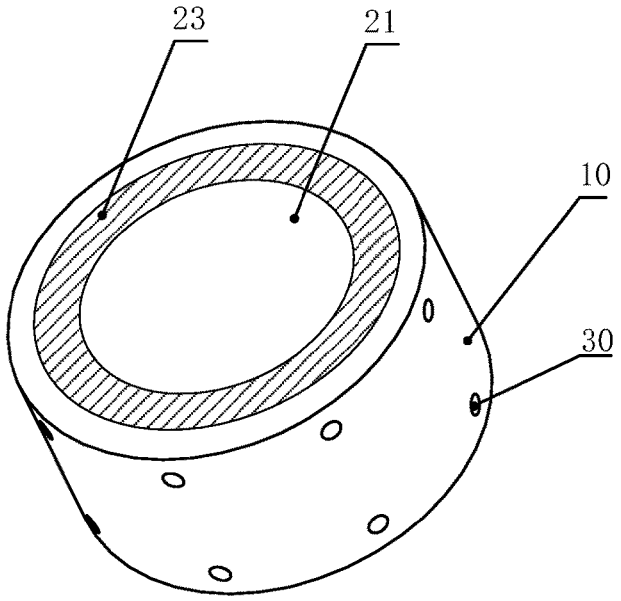
FIGS. 10A and 10B are schematic structures of an exemplary bone conduction speaker according to some embodiments of the present disclosure.
Figure 10B:
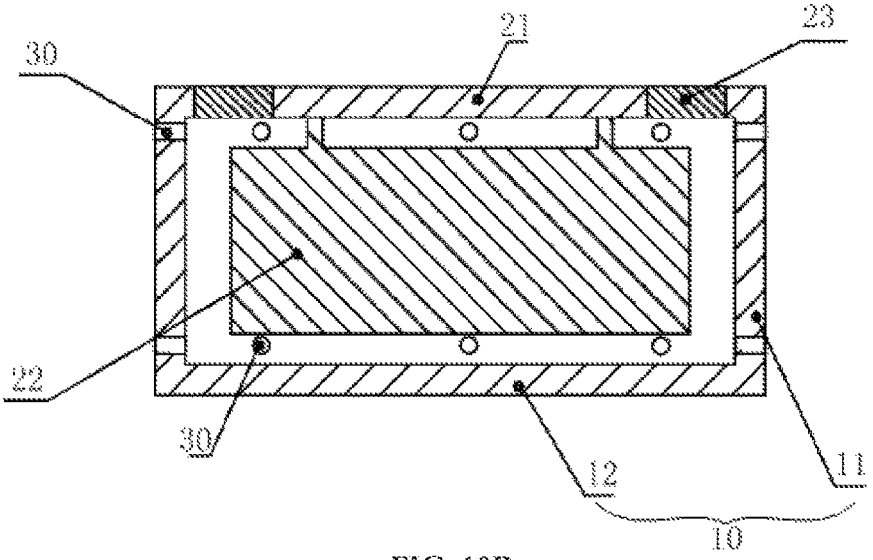

FIGS. 10A and 10B are schematic structures of an exemplary bone conduction speaker according to some embodiments of the present disclosure. The bone conduction speaker may include an open housing 10, a vibration board 21 and a transducer 22. One or more perforative sound guiding holes 30 may be arranged on both upper and lower portions of the sidewall of the housing 10. The sound guiding holes 30 may be arranged evenly or unevenly in one or more circles on the upper and lower portions of the sidewall of the housing 10. In some embodiments, the quantity of sound guiding holes 30 in every circle may be 8, and the upper portion sound guiding holes and the lower portion sound guiding holes may be symmetrical about the central cross section of the housing 10. In some embodiments, the shape of the sound guiding hole 30 may be circle.

The shape of the sound guiding holes on the upper portion and the shape of the sound guiding holes on the lower portion may be different; One or more damping layers may be arranged in the sound guiding holes to reduce leaked sound waves of the same wave length (or frequency), or to reduce leaked sound waves of different wave lengths.

Figure 10C:
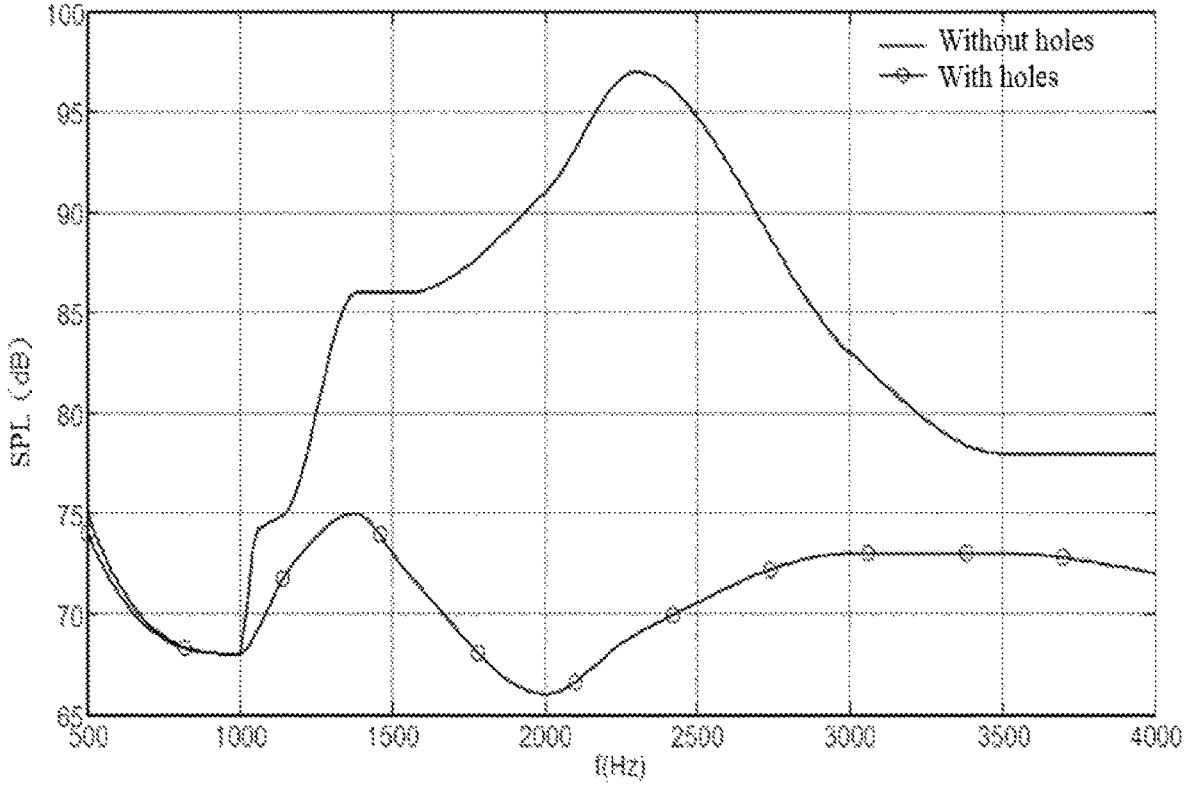
FIG. 10C is a diagram illustrating reduced sound leakage of a bone conduction speaker according to some embodiments of the present disclosure.

FIG. 10C is a diagram illustrating the effect of reducing sound leakage according to some embodiments of the present disclosure. In the frequency range of 1000 Hz~4000 Hz, the effectiveness of reducing sound leakage is outstanding. For example, in the frequency range of 1600 Hz~2700 Hz, the sound leakage is reduced by more than 15 dB; in the frequency range of 2000 Hz~2500 Hz, where the effectiveness of reducing sound leakage is most outstanding, the sound leakage is reduced by more than 20 dB. Compared to embodiment three, this scheme has a relatively balanced effect of reduced sound leakage on various frequency range, and this effect is better than the effect of schemes where the height of the holes are fixed, such as schemes of embodiment three, embodiment four, embodiment five, and so on.

In some embodiments, the sound guiding hole(s) at the upper portion of the sidewall of the housing 10 (also referred to as first hole(s)) may be approximately regarded as a point sound source. In some embodiments, the first hole(s) and the portion of the housing 10 that generates the leaked sound wave may constitute two-point sound sources (also referred to as first two-point sound sources). As for the first two-point sound sources, the guided sound wave generated by the first hole(s) (also referred to as first guided sound wave) may interfere with the leaked sound wave or a portion thereof generated by the portion of the housing 10 in a first region. In some embodiments, the sound waves output from the first two-point sound sources may have a same frequency (e.g., a first frequency). In some embodiments, the sound waves output from the first two-point sound sources may have a certain phase difference. In this case, the interference between the sound waves generated by the first two-point sound sources may reduce a sound pressure level of the leaked sound wave in the target region. When the position and phase difference of the first two-point sound sources meet certain conditions, the acoustic output device may output different sound effects in the near field (for example, the position of the user's ear) and the far field. For example, if the phases of the first two-point sound sources are opposite, that is, an absolute value of the phase difference between the first two-point sound sources is 180 degrees, the far-field leakage may be reduced according to the principle of reversed phase cancellation.

In some embodiments, the sound guiding hole(s) at the lower portion of the sidewall of the housing 10 (also referred to as second hole(s)) may also be approximately regarded as another point sound source. Similarly, the second hole(s) and the portion of the housing 10 that generates the leaked sound wave may also constitute two-point sound sources (also referred to as second two-point sound sources). As for the second two-point sound sources, the guided sound wave generated by the second hole(s) (also referred to as second guided sound wave) may interfere with the leaked sound wave or a portion thereof generated by the portion of the housing 10 in a second region. The second region may be the same as or different from the first region. In some embodiments, the sound waves output from the second two-point sound sources may have a same frequency (e.g., a second frequency).

In some embodiments, the first frequency and the second frequency may be in certain frequency ranges. In some embodiments, the frequency of the guided sound wave output from the sound guiding hole(s) may be adjustable. In some embodiments, the frequency of the first guided sound wave and/or the second guided sound wave may be adjusted by one or more acoustic routes. The acoustic routes may be coupled to the first hole(s) and/or the second hole(s). The first guided sound wave and/or the second guided sound wave may be propagated along the acoustic route having a specific frequency selection characteristic. That is, the first guided sound wave and the second guided sound wave may be transmitted to their corresponding sound guiding holes via different acoustic routes. For example, the first guided sound wave and/or the second guided sound wave may be propagated along an acoustic route with a low-pass characteristic to a corresponding sound guiding hole to output guided sound wave of a low frequency. In this process, the high frequency component of the sound wave may be absorbed or attenuated by the acoustic route with the low-pass characteristic. Similarly, the first guided sound wave and/or the second guided sound wave may be propagated along an acoustic route with a high-pass characteristic to the corresponding sound guiding hole to output guided sound wave of a high frequency. In this process, the low frequency component of the sound wave may be absorbed or attenuated by the acoustic route with the high-pass characteristic.

Figure 10D:
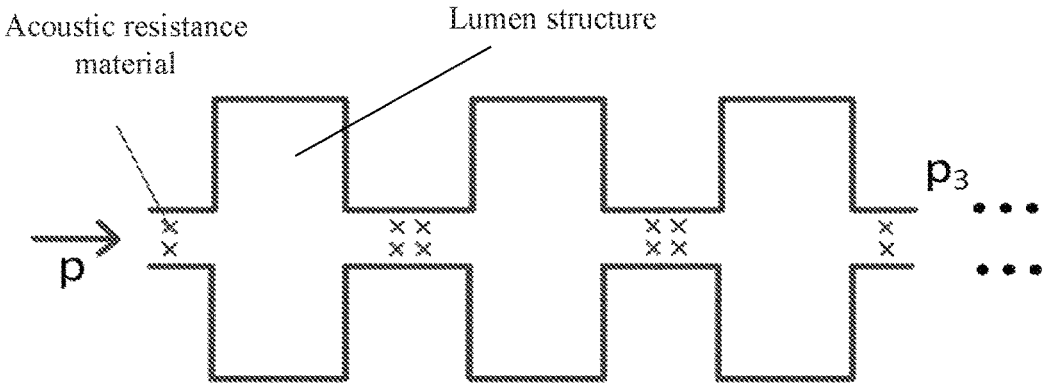
FIG. 10D is a schematic diagram illustrating an acoustic route according to some embodiments of the present disclosure.
Figure 10E:
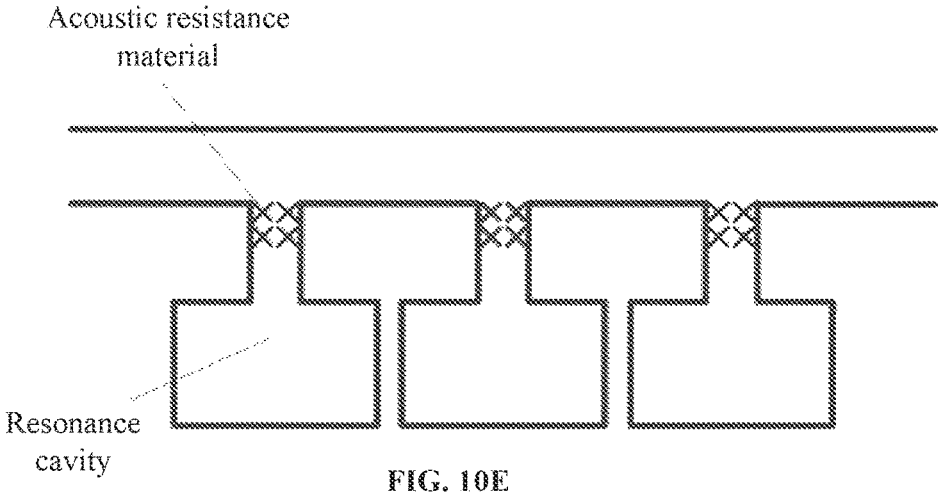
FIG. 10E is a schematic diagram illustrating another acoustic route according to some embodiments of the present disclosure.
Figure 10F:
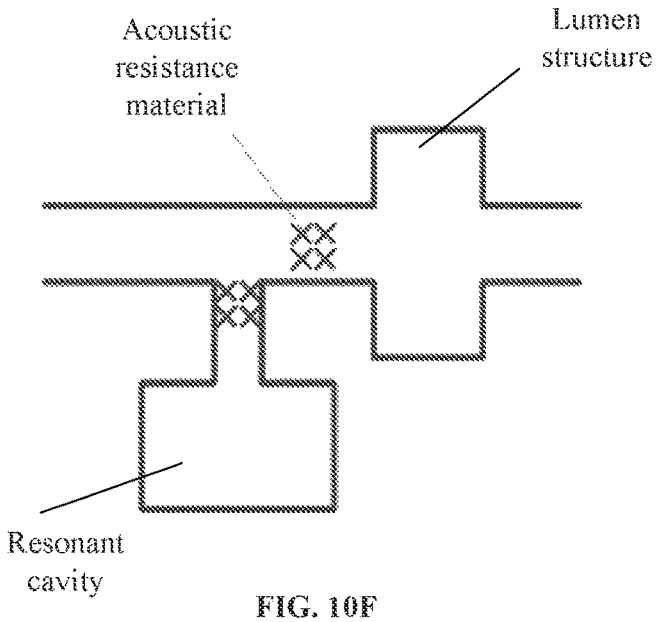
FIG. 10F is a schematic diagram illustrating a further acoustic route according to some embodiments of the present disclosure.

FIG. 10D is a schematic diagram illustrating an acoustic route according to some embodiments of the present disclosure. FIG. 10E is a schematic diagram illustrating another acoustic route according to some embodiments of the present disclosure. FIG. 10F is a schematic diagram illustrating a further acoustic route according to some embodiments of the present disclosure. In some embodiments, structures such as a sound tube, a sound cavity, a sound resistance, etc., may be set in the acoustic route for adjusting frequencies for the sound waves (e.g., by filtering certain frequencies). It should be noted that FIGS. 10D-10F may be provided as examples of the acoustic routes, and not intended be limiting.

As shown in FIG. 10D, the acoustic route may include one or more lumen structures. The one or more lumen structures may be connected in series. An acoustic resistance material may be provided in each of at least one of the one or more lumen structures to adjust acoustic impedance of the entire structure to achieve a desirable sound filtering effect. For example, the acoustic impedance may be in a range of 5 MKS Rayleigh to 500 MKS Rayleigh. In some embodiments, a high-pass sound filtering, a low-pass sound filtering, and/or a band-pass filtering effect of the acoustic route may be achieved by adjusting a size of each of at least one of the one or more lumen structures and/or a type of acoustic resistance material in each of at least one of the one or more lumen structures. The acoustic resistance materials may include, but not limited to, plastic, textile, metal, permeable material, woven material, screen material or mesh material, porous material, particulate material, polymer material, or the like, or any combination thereof. By setting the acoustic routes of different acoustic impedances, the acoustic output from the sound guiding holes may be acoustically filtered. In this case, the guided sound waves may have different frequency components.

As shown in FIG. 10E, the acoustic route may include one or more resonance cavities. The one or more resonance cavities may be, for example, Helmholtz cavity. In some embodiments, a high-pass sound filtering, a low-pass sound filtering, and/or a band-pass filtering effect of the acoustic route may be achieved by adjusting a size of each of at least one of the one or more resonance cavities and/or a type of acoustic resistance material in each of at least one of the one or more resonance cavities.

As shown in FIG. 10F, the acoustic route may include a combination of one or more lumen structures and one or more resonance cavities. In some embodiments, a high-pass sound filtering, a low-pass sound filtering, and/or a band-pass filtering effect of the acoustic route may be achieved by adjusting a size of each of at least one of the one or more lumen structures and one or more resonance cavities and/or a type of acoustic resistance material in each of at least one of the one or more lumen structures and one or more resonance cavities. It should be noted that the structures exemplified above may be for illustration purposes, various acoustic structures may also be provided, such as a tuning net, tuning cotton, etc.

In some embodiments, the interference between the leaked sound wave and the guided sound wave may relate to frequencies of the guided sound wave and the leaked sound wave and/or a distance between the sound guiding hole(s) and the portion of the housing 10. In some embodiments, the portion of the housing that generates the leaked sound wave may be the bottom of the housing 10. The first hole(s) may have a larger distance to the portion of the housing 10 than the second hole(s). In some embodiments, the frequency of the first guided sound wave output from the first hole(s) (e.g., the first frequency) and the frequency of second guided sound wave output from second hole(s) (e.g., the second frequency) may be different.

In some embodiments, the first frequency and second frequency may associate with the distance between the at least one sound guiding hole and the portion of the housing 10 that generates the leaked sound wave. In some embodiments, the first frequency may be set in a low frequency range. The second frequency may be set in a high frequency range. The low frequency range and the high frequency range may or may not overlap.

In some embodiments, the frequency of the leaked sound wave generated by the portion of the housing 10 may be in a wide frequency range. The wide frequency range may include, for example, the low frequency range and the high frequency range or a portion of the low frequency range and the high frequency range. For example, the leaked sound wave may include a first frequency in the low frequency range and a second frequency in the high frequency range. In some embodiments, the leaked sound wave of the first frequency and the leaked sound wave of the second frequency may be generated by different portions of the housing 10. For example, the leaked sound wave of the first frequency may be generated by the sidewall of the housing 10, the leaked sound wave of the second frequency may be generated by the bottom of the housing 10. As another example, the leaked sound wave of the first frequency may be generated by the bottom of the housing 10, the leaked sound wave of the second frequency may be generated by the sidewall of the housing 10. In some embodiments, the frequency of the leaked sound wave generated by the portion of the housing 10 may relate to parameters including the mass, the damping, the stiffness, etc., of the different portion of the housing 10, the frequency of the transducer 22, etc.

In some embodiments, the characteristics (amplitude, frequency, and phase) of the first two-point sound sources and the second two-point sound sources may be adjusted via various parameters of the acoustic output device (e.g., electrical parameters of the transducer 22, the mass, stiffness, size, structure, material, etc., of the portion of the housing 10, the position, shape, structure, and/or number (or count) of the sound guiding hole(s) so as to form a sound field with a particular spatial distribution. In some embodiments, a frequency of the first guided sound wave is smaller than a frequency of the second guided sound wave.

A combination of the first two-point sound sources and the second two-point sound sources may improve sound effects both in the near field and the far field.

Referring to FIGS. 4D, 7C, and 10C, by designing different two-point sound sources with different distances, the sound leakage in both the low frequency range and the high frequency range may be properly suppressed. In some embodiments, the closer distance between the second two-point sound sources may be more suitable for suppressing the sound leakage in the far field, and the relative longer distance between the first two-point sound sources may be more suitable for reducing the sound leakage in the near field. In some embodiments, the amplitudes of the sound waves generated by the first two-point sound sources may be set to be different in the low frequency range. For example, the amplitude of the guided sound wave may be smaller than the amplitude of the leaked sound wave. In this case, the sound pressure level of the near-field sound may be improved. The volume of the sound heard by the user may be increased.

Embodiment Seven

Figure 11A:
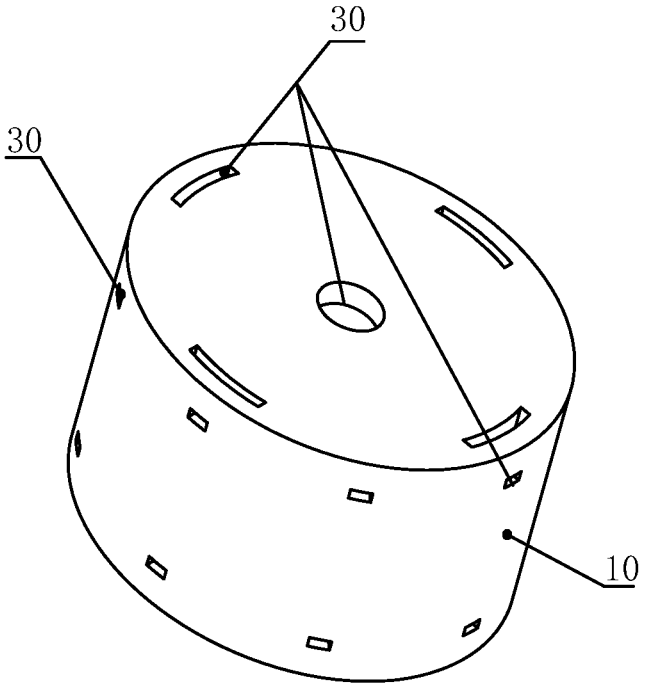
FIGS. 11A and 11B are schematic structures of an exemplary bone conduction speaker according to some embodiments of the present disclosure.
Figure 11B:
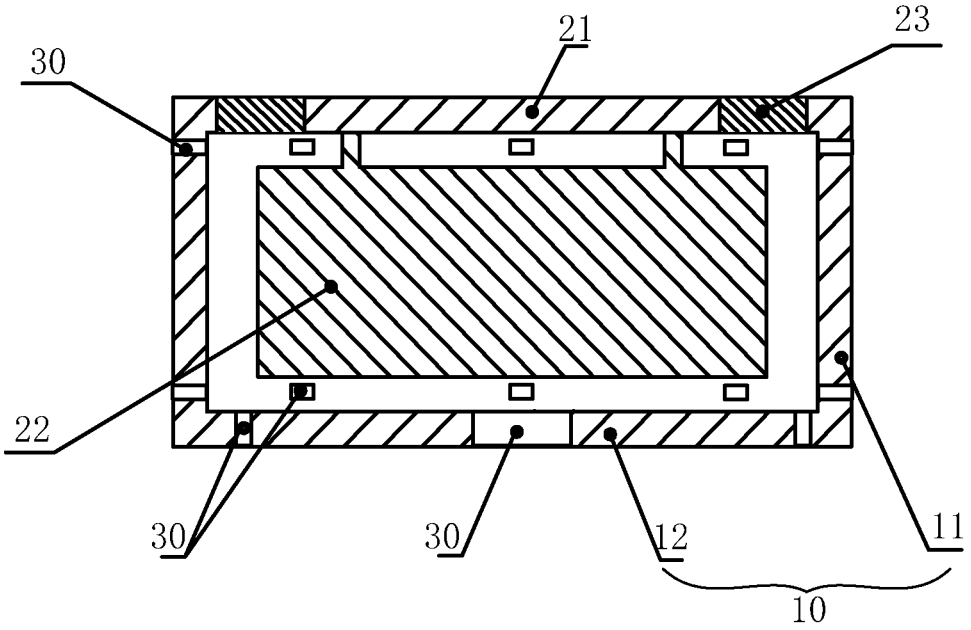

FIGS. 11A and 11B are schematic structures illustrating a bone conduction speaker according to some embodiments of the present disclosure. The bone conduction speaker may include an open housing 10, a vibration board 21 and a transducer 22. One or more perforative sound guiding holes 30 may be set on upper and lower portions of the sidewall of the housing 10 and on the bottom of the housing 10. The sound guiding holes 30 on the sidewall are arranged evenly or unevenly in one or more circles on the upper and lower portions of the sidewall of the housing 10. In some embodiments, the quantity of sound guiding holes 30 in every circle may be 8, and the upper portion sound guiding holes and the lower portion sound guiding holes may be symmetrical about the central cross section of the housing 10. In some embodiments, the shape of the sound guiding hole 30 may be rectangular. There may be four sound guiding holds 30 on the bottom of the housing 10. The four sound guiding holes 30 may be linear-shaped along arcs, and may be arranged evenly or unevenly in one or more circles with respect to the center of the bottom. Furthermore, the sound guiding holes 30 may include a circular perforative hole on the center of the bottom.

Figure 11C:
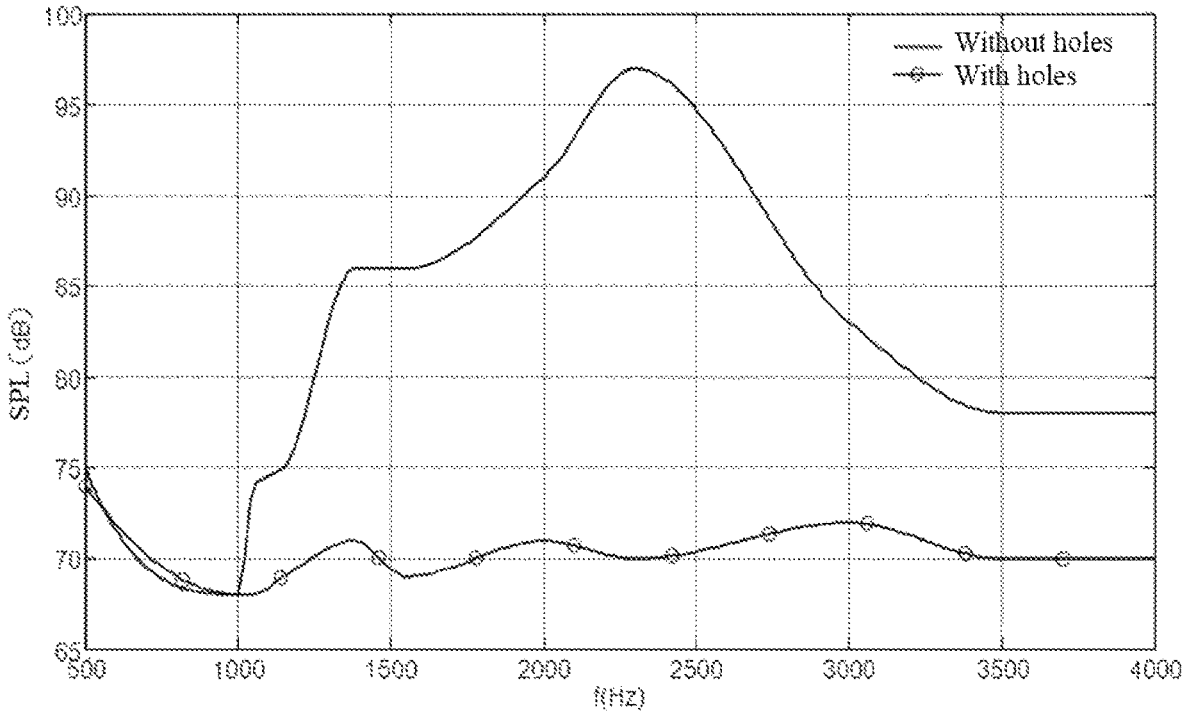
FIG. 11C is a diagram illustrating reduced sound leakage of a bone conduction speaker according to some embodiments of the present disclosure.

FIG. 11C is a diagram illustrating the effect of reducing sound leakage of the embodiment. In the frequency range of 1000 Hz~4000 Hz, the effectiveness of reducing sound leakage is outstanding. For example, in the frequency range of 1300 Hz~3000 Hz, the sound leakage is reduced by more than 10 dB; in the frequency range of 2000 Hz~2700 Hz, the sound leakage is reduced by more than 20 dB. Compared to embodiment three, this scheme has a relatively balanced effect of reduced sound leakage within various frequency range, and this effect is better than the effect of schemes where the height of the holes are fixed, such as schemes of embodiment three, embodiment four, embodiment five, and etc. Compared to embodiment six, in the frequency range of 1000 Hz~1700 Hz and 2500 Hz~4000 Hz, this scheme has a better effect of reduced sound leakage than embodiment six.

Embodiment Eight

Figure 12A:
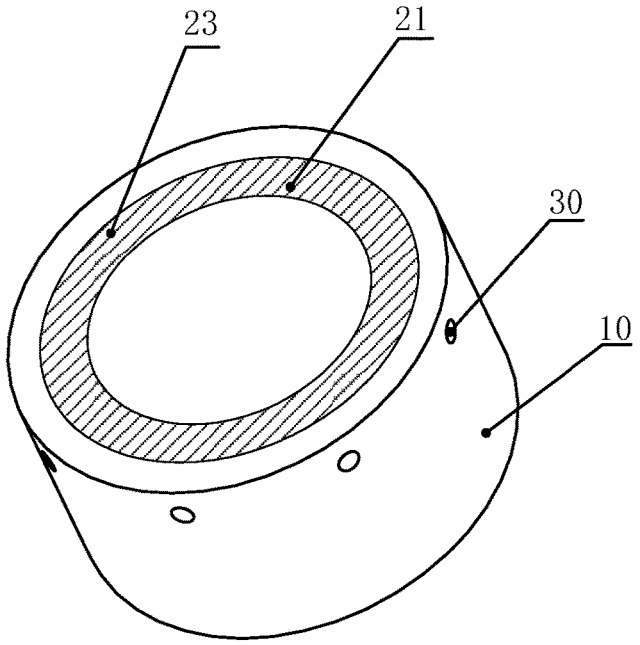
FIGS. 12A and 12B are schematic structures of an exemplary bone conduction speaker according to some embodiments of the present disclosure.
Figure 12B:
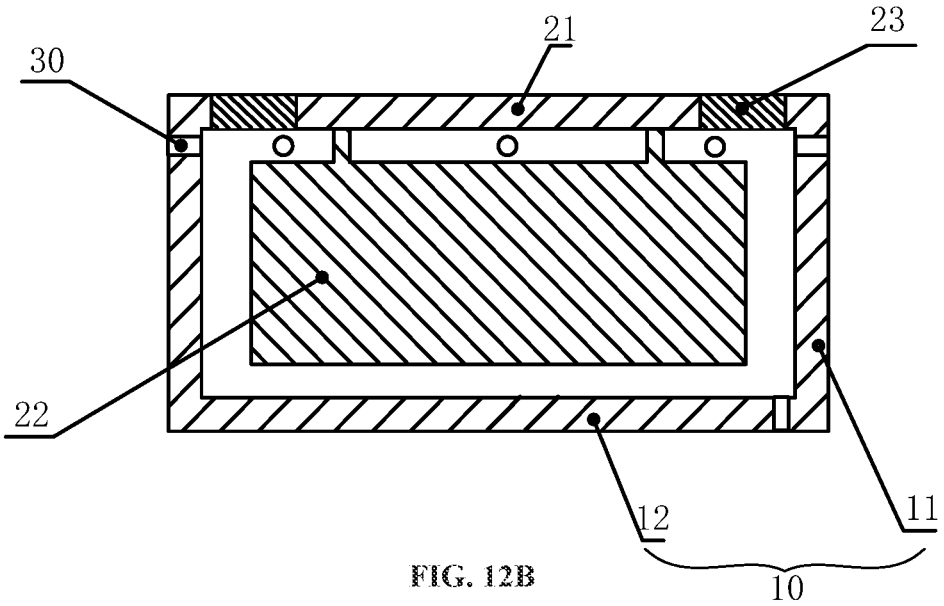

FIGS. 12A and 12B are schematic structures illustrating a bone conduction speaker according to some embodiments of the present disclosure. The bone conduction speaker may include an open housing 10, a vibration board 21 and a transducer 22. A perforative sound guiding hole 30 may be set on the upper portion of the sidewall of the housing 10. One or more sound guiding holes may be arranged evenly or unevenly in one or more circles on the upper portion of the sidewall of the housing 10. There may be 8 sound guiding holes 30, and the shape of the sound guiding holes 30 may be circle.

After comparison of calculation results and test results, the effectiveness of this embodiment is basically the same with that of embodiment one, and this embodiment can effectively reduce sound leakage.

Embodiment Nine

Figure 13A:
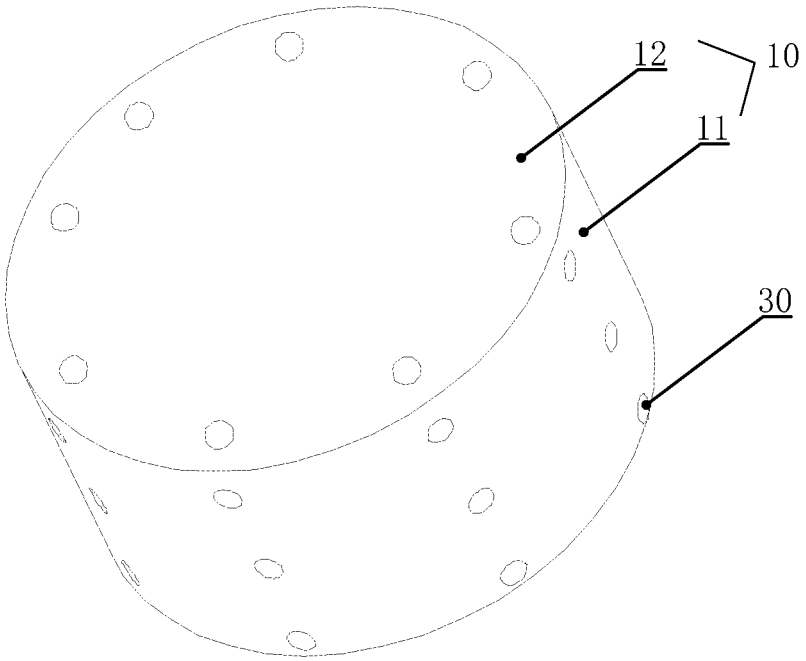
FIGS. 13A and 13B are schematic structures of an exemplary bone conduction speaker according to some embodiments of the present disclosure.
Figure 13B:
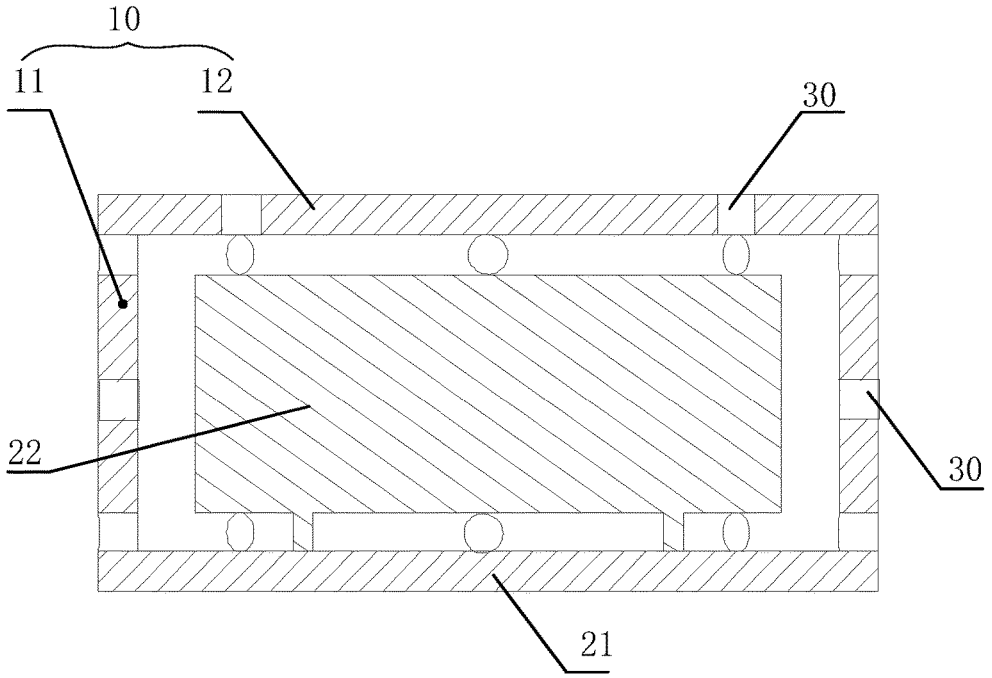

FIGS. 13A and 13B are schematic structures illustrating a bone conduction speaker according to some embodiments of the present disclosure. The bone conduction speaker may include an open housing 10, a vibration board 21 and a transducer 22.

The difference between this embodiment and the above-described embodiment three is that to reduce sound leakage to greater extent, the sound guiding holes 30 may be arranged on the upper, central and lower portions of the sidewall 11. The sound guiding holes 30 are arranged evenly or unevenly in one or more circles. Different circles are formed by the sound guiding holes 30, one of which is set along the circumference of the bottom 12 of the housing 10. The size of the sound guiding holes 30 are the same.

The effect of this scheme may cause a relatively balanced effect of reducing sound leakage in various frequency ranges compared to the schemes where the position of the holes are fixed. The effect of this design on reducing sound leakage is relatively better than that of other designs where the heights of the holes are fixed, such as embodiment three, embodiment four, embodiment five, etc.

Embodiment Ten

The sound guiding holes 30 in the above embodiments may be perforative holes without shields.

In order to adjust the effect of the sound waves guided from the sound guiding holes, a damping layer (not shown in the figures) may locate at the opening of a sound guiding hole 30 to adjust the phase and/or the amplitude of the sound wave.

There are multiple variations of materials and positions of the damping layer. For example, the damping layer may be made of materials which can damp sound waves, such as tuning paper, tuning cotton, nonwoven fabric, silk, cotton, sponge or rubber. The damping layer may be attached on the inner wall of the sound guiding hole 30, or may shield the sound guiding hole 30 from outside.

More preferably, the damping layers corresponding to different sound guiding holes 30 may be arranged to adjust the sound waves from different sound guiding holes to generate a same phase. The adjusted sound waves may be used to reduce leaked sound wave having the same wavelength. Alternatively, different sound guiding holes 30 may be arranged to generate different phases to reduce leaked sound wave having different wavelengths (i.e., leaked sound waves with specific wavelengths).

In some embodiments, different portions of a same sound guiding hole can be configured to generate a same phase to reduce leaked sound waves on the same wavelength (e.g., using a pre-set damping layer with the shape of stairs or steps). In some embodiments, different portions of a same sound guiding hole can be configured to generate different phases to reduce leaked sound waves on different wavelengths.

The above-described embodiments are preferable embodiments with various configurations of the sound guiding hole(s) on the housing of a bone conduction speaker, but a person having ordinary skills in the art can understand that the embodiments don't limit the configurations of the sound guiding hole(s) to those described in this application.

In the past bone conduction speakers, the housing of the bone conduction speakers is closed, so the sound source inside the housing is sealed inside the housing. In the embodiments of the present disclosure, there can be holes in proper positions of the housing, making the sound waves inside the housing and the leaked sound waves having substantially same amplitude and substantially opposite phases in the space, so that the sound waves can interfere with each other and the sound leakage of the bone conduction speaker is reduced. Meanwhile, the volume and weight of the speaker do not increase, the reliability of the product is not comprised, and the cost is barely increased. The designs disclosed herein are easy to implement, reliable, and effective in reducing sound leakage.

Figure 38:
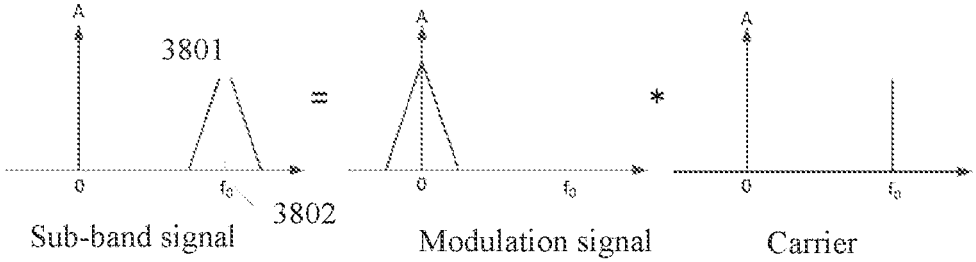
FIG. 38 is a schematic diagram illustrating an exemplary signal modulation process according to some embodiments of the present disclosure.
Figure 39:
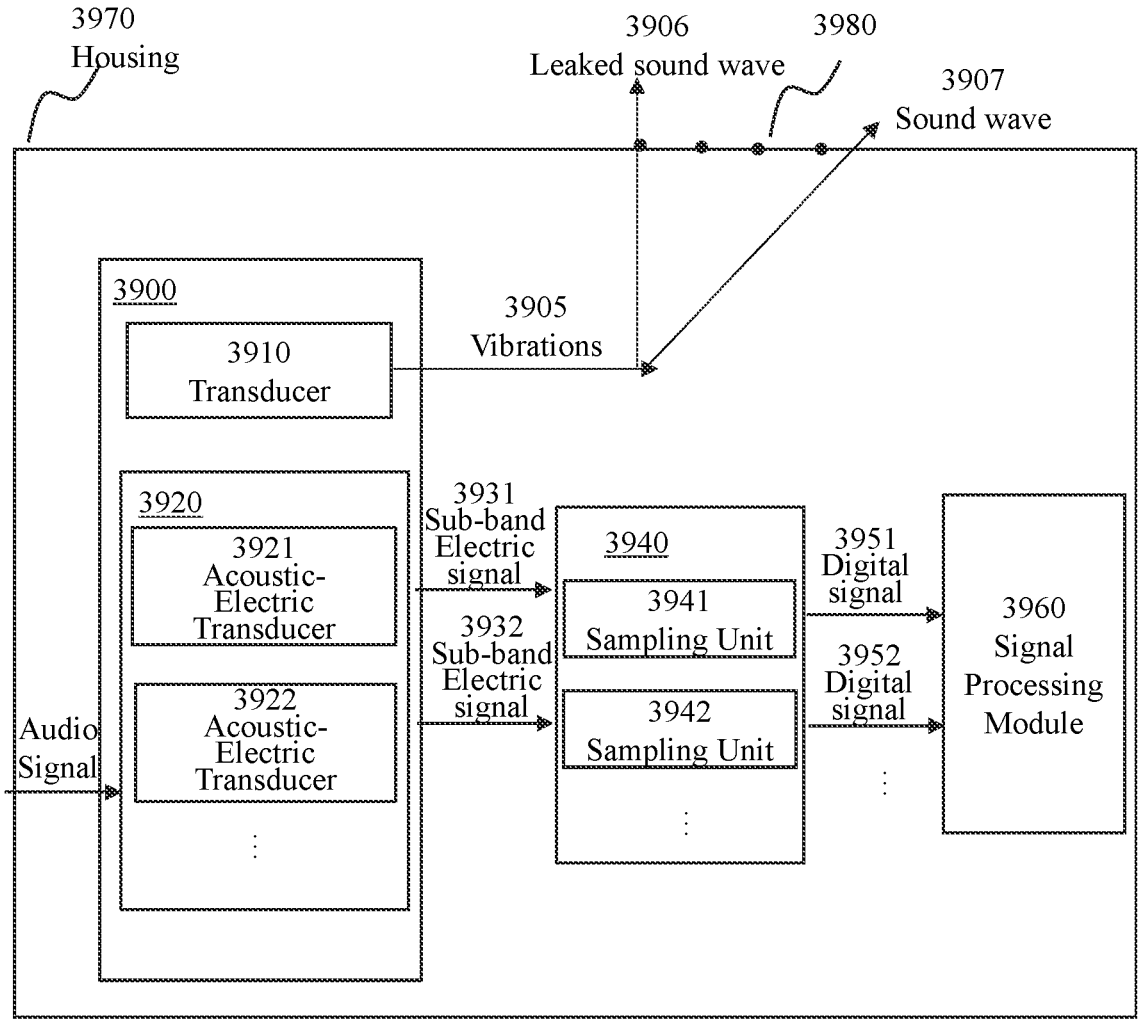
FIG. 39 is a schematic diagram illustrating some components of an exemplary speaker according to some embodiments of the present disclosure.

In some embodiments, a speaker as described elsewhere in the present disclosure (e.g., the speaker as shown FIG. 4A through FIG. 13B or the speaker as shown in FIG. 39) may include a housing (e.g., the housing 10 or housing 3970), a plurality of transducers (e.g., transducers 3900 as shown in FIG. 39) residing inside the housing (e.g., the housing 3970 as shown in FIG. 39), and at least one sound guiding hole (e.g., the sound guiding holes 3980 as shown in FIG. 39) configured on the housing. The plurality of transducers may include a first portion and a second portion. For example, the first portion of the plurality of transducers (e.g., the transducer 22 as shown in FIGS. 4A and 4B or the transducer 3910 in FIG. 39) may be configured to generate vibrations (e.g., vibrations 3905 as shown in FIG. 39). The vibrations may produce a sound wave (e.g., sound wave 3907 as shown in FIG. 39) inside the housing and cause a leaked sound wave (e.g., leaked sound wave 3906 as shown in FIG. 39) spreading outside the housing from a portion of the housing. The at least one sound guiding hole may be configured to guide the sound wave inside the housing through the at least one sound guiding hole to an outside of the housing. The at least one sound guiding hole may include a damping layer configured to adjust the phase of the guided sound wave in the target region. The guided sound wave may have a phase different from a phase of the leaked sound wave. The guided sound wave may interfere with the leaked sound wave in a target region. In some embodiments, the guided sound wave may include at least two sound waves having different phases. A sound pressure level of the at least a portion of the leaked sound wave may be reduced by more than 10 dB on average. More descriptions of the first portion of the plurality of transducers may be found elsewhere in the present disclosure, for example, FIGS. 4A-13B and relevant descriptions thereof. In some embodiments, the second portion of the plurality of transducers (e.g., the acoustic-electric transducing module 1510 as shown in FIG. 15 or 39) may include a plurality of acoustic-electric transducers (e.g., acoustic-electric transducers 3921 and 3922 as shown in FIG. 39) that have different frequency responses. The plurality of acoustic-electric transducers may detect an audio signal and generate a plurality of sub-band signals (e.g., sub-band electric signal 3931 and 3932) accordingly. The plurality of sub-band signals (e.g., the sub-band electric signal 3931 and 3932) may be sampled by a sampling module (e.g., sampling module 3940 illustrated in FIG. 39) that may include a plurality of sampling units (e.g., sampling units 3941 and 3942 illustrated in FIG. 39) to generate digital signals (e.g., digital signals 3951 and 3952 illustrated in FIG. 39). A signal processing module (e.g., signal processing module 3960 illustrated in FIG. 39) may process the digital signals transmitted from the sampling units in the sampling module. The speaker uses inherent properties of the acoustic-electric transducers to generate the sub-band signals, which spares the processing of digital signals and is thus time-saving. Merely by way of example, the second portion of the plurality of transducers may include a first acoustic-electric transducer having a first frequency response and a second acoustic-electric transducer having a second frequency response. The second frequency response may be different from the first frequency response. The first acoustic-electric transducer may be configured to detect the audio signal, and generate a first sub-band signal according to the detected audio signal by the first acoustic-electric transducer. The second acoustic-electric transducer may be configured to detect the audio signal, and generate a second sub-band signal according to the detected audio signal by the second acoustic-electric transducer. More descriptions regarding the acoustic-electric transducers may be found in the following descriptions (e.g., FIGS. 14-39 and relevant descriptions thereof).

Figure 14:
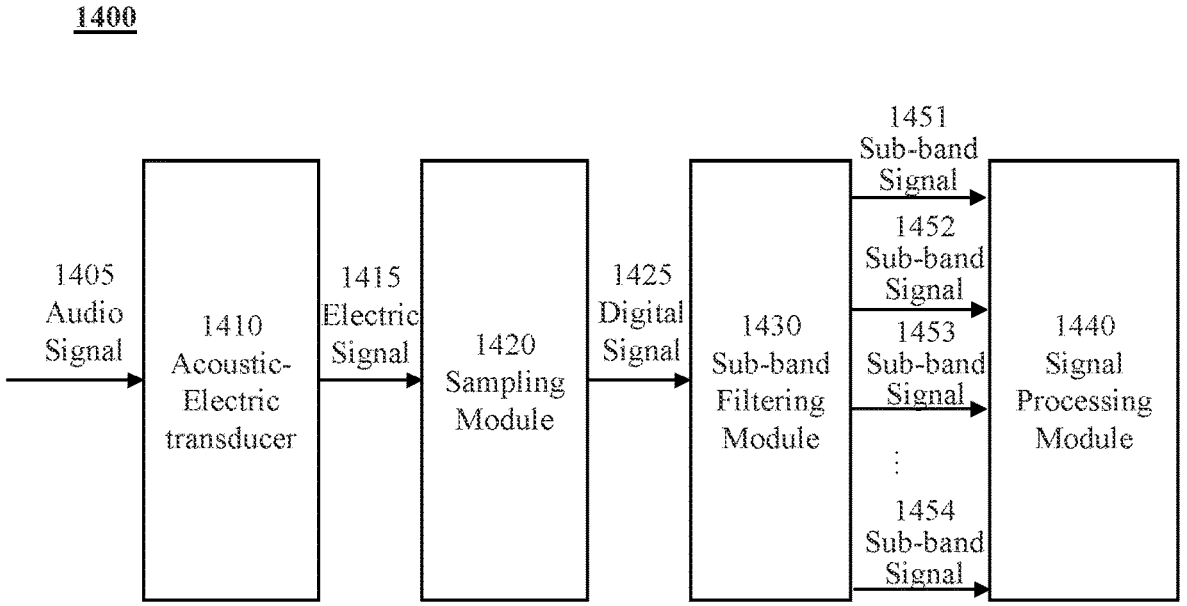
FIG. 14 illustrates a conventional signal processing device.
Figure 15:
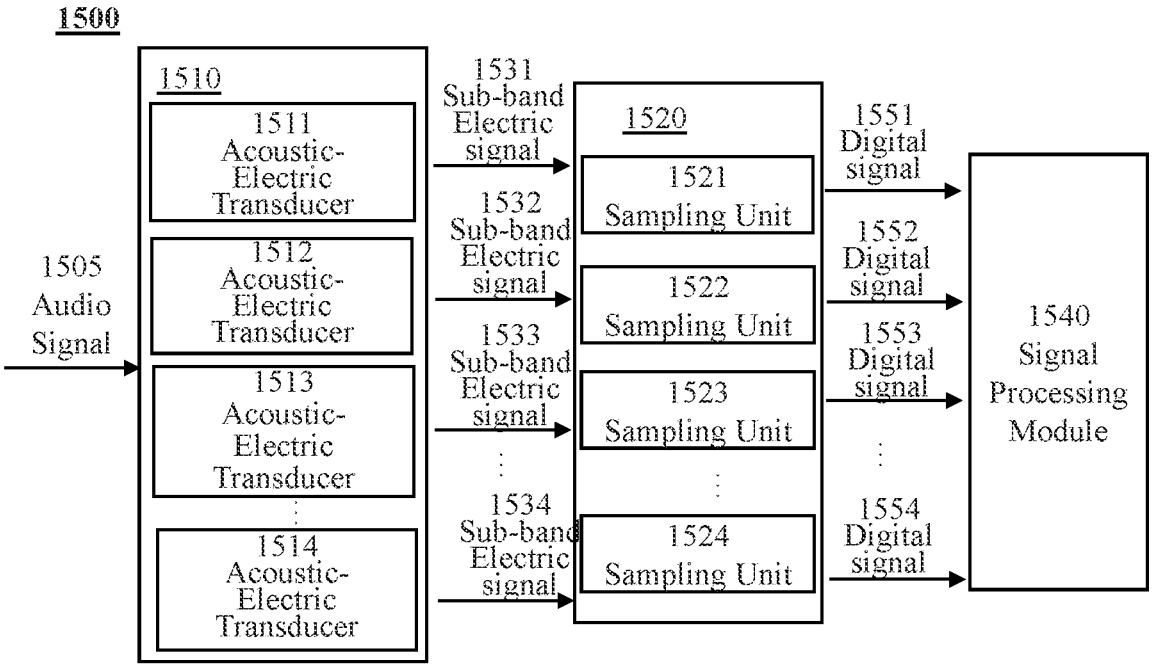
FIG. 15 illustrates an exemplary signal processing device according to some embodiments of the present disclosure.

FIG. 14 illustrates a conventional signal processing device. The conventional signal processing device 1400 may include an acoustic-electric transducer 1410, a sampling module 1420, a sub-band filtering module 1430, and a signal processing module 1440. An audio signal 1405 may be converted into an electric signal 1415 by the acoustic-electric transducer 1410. The sampling module 1420 may convert the electric signal 1415 into a digital signal 1425 for processing. The sub-band filtering module 1430 may decompose the digital signal 1425 into a plurality of sub-band signals (e.g., sub-band signals 1451, 1452, 1453, . . . , 1454). The signal processing module 1440 may further process the sub-band signals.

In one respect, to sample an electric signal 1415 with a wider bandwidth, the sampling module 1420 may request a higher sampling frequency. In another respect, to generate a plurality of sub-band signals, filter circuits of the sub-band filtering module 1430 need to be relatively complex and have a relatively high order. Also, to generate a plurality of sub-band signals, the sub-band filtering module 1430 may perform a digital signal processing process through a software program, which may be time-consuming and may introduce noise during the digital signal processing process. Thus, there is need to provide a system and method to generate sub-band signals.

FIG. 15 illustrates an exemplary signal processing device 1500 according to some embodiments of the present disclosure. As shown in FIG. 15, the signal processing device 1500 may include an acoustic-electric transducing module 1510, a sampling module 1520, and a signal processing module 1540.

The acoustic-electric transducing module 1510 may include a plurality of acoustic-electric transducers (e.g., acoustic-electric transducers 1511, 1512, 1513, . . . , 1514 illustrated in FIG. 15). The acoustic-electric transducers may be connected in parallel. For example, the acoustic-electric transducers may be connected electrically in parallel. As another example, the acoustic-electric transducers may be connected topologically in parallel.

An acoustic-electric transducer (e.g., acoustic-electric transducer 1511, 1512, 1513, and/or 1514) of the acoustic-electric transducing module 1510 may be configure to convert audio signals into electric signals. In some embodiments, one or more parameters of the acoustic-electric transducer 1511 may change in response to the detection of an audio signal (e.g., the audio signal 1505). Exemplary parameters may include capacitance, charge, acceleration, light intensity, or the like, or a combination thereof. In some embodiments, the changes in one or more parameters may correspond to the frequency of the audio signal and may be converted to corresponding electric signals. In some embodiments, an acoustic-electric transducer of the acoustic-electric transducing module 1510 may be a microphone, a hydrophone, an acoustic-optical modulator, or the like, or a combination thereof.

In some embodiments, the acoustic-electric transducer may be a first-order acoustic-electric transducer or a multi-order (e.g., second-order, fourth-order, sixth-order, etc.) acoustic-electric transducer. In some embodiments, the frequency response of a high-order acoustic-electric transducer may have a steeper edge.

In some embodiments, the acoustic-electric transducers in the acoustic-electric transducing module 1510 may include one or more piezoelectric acoustic-electric transducers (e.g., a microphone) and/or one or more piezo-magnetic acoustic-electric transducers. Merely by way of example, each of the acoustic-electric transducers may be a microphone. In some embodiments, the acoustic-electric transducers may include one or more air-conduction acoustic-electric transducers and/or one or more bone-conduction acoustic-electric transducers. In some embodiments, the plurality of acoustic-electric transducers may include one or more high-order wideband acoustic-electric transducers and/or one or more high-order narrow-band acoustic-electric transducers. As used herein, a high-order wideband acoustic-electric transducer may refer to a wideband acoustic-electric transducer having an order larger than 1. As used herein, a high-order narrow-band acoustic-electric transducer may refer to a narrow-band acoustic-electric transducer having an order larger than 1. Detailed descriptions of a wideband acoustic-electric transducer and/or a narrow-band acoustic-electric transducer may be apparent to those in the art, and may not be repeated herein.

Figure 24A:
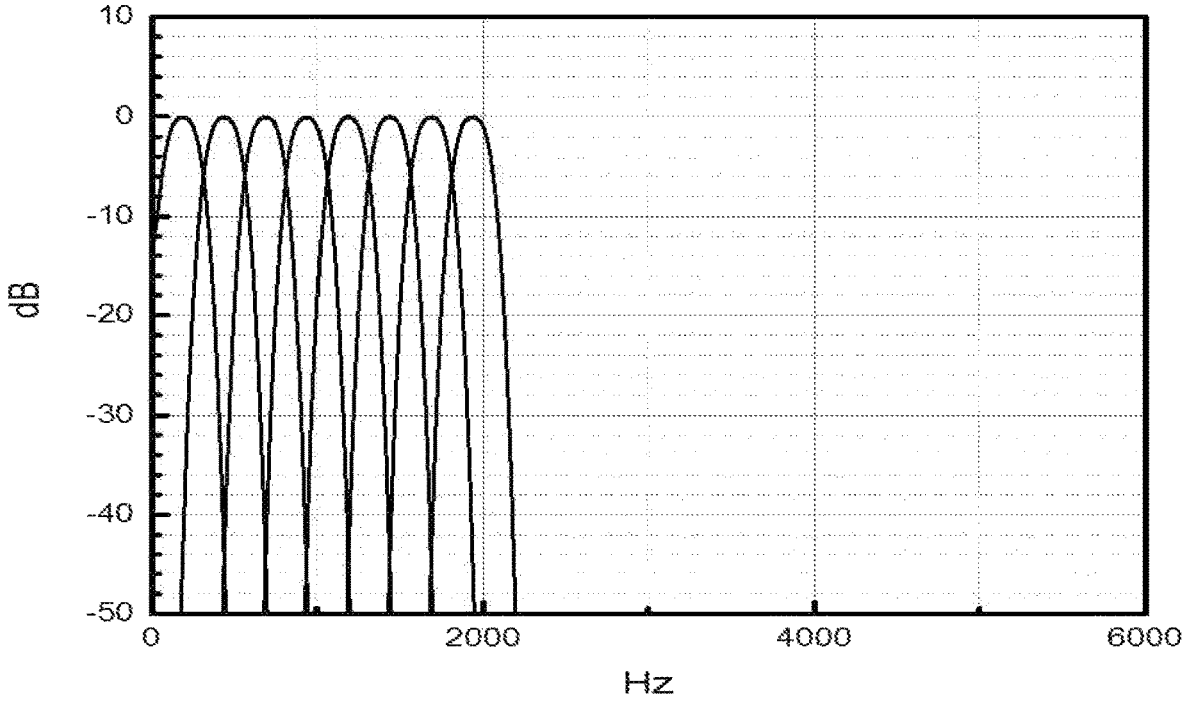
FIG. 24A illustrates an exemplary frequency response of an acoustic-electric transducing module according to some embodiments of the present disclosure.
Figure 24B:
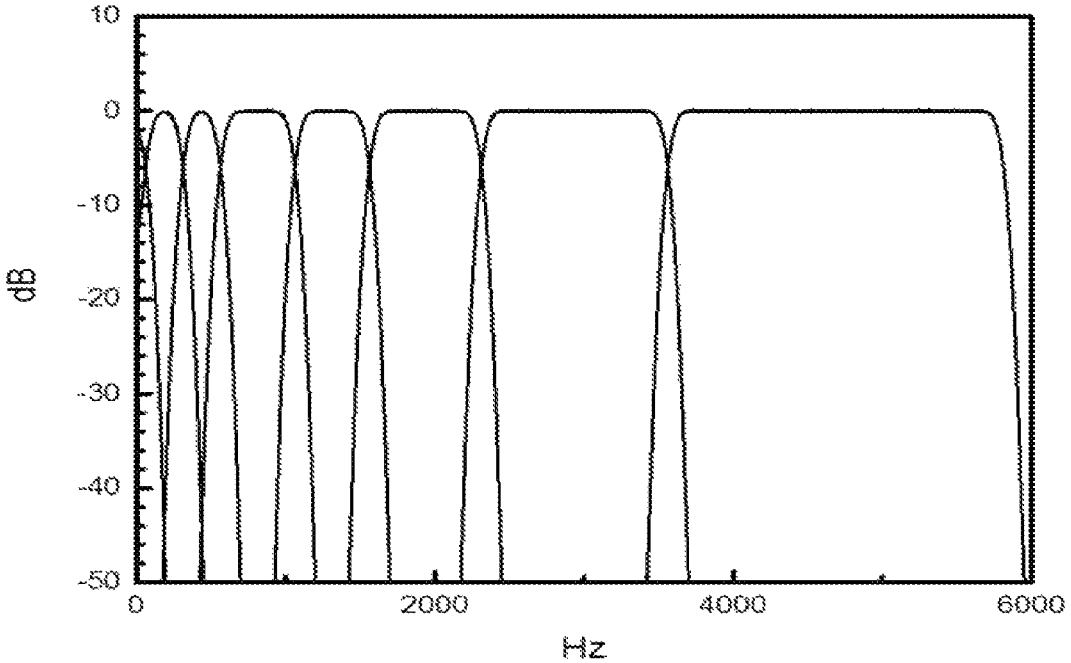
FIG. 24B illustrates an exemplary frequency response of an acoustic-electric transducing module according to some embodiments of the present disclosure.

In some embodiments, at least two of the plurality of acoustic-electric transducers may have different frequency responses, which may have different center frequencies and/or frequency bandwidths (or referred to as frequency width). For example, the acoustic-electric transducers 1511, 1512, 1513, and 1514 may have a first frequency response, a second frequency response, a third frequency response, and a fourth frequency response, respectively. In some embodiments, the first frequency response, the second frequency response, the third frequency response, and the third frequency response may be different from each other. Alternatively, the first frequency response, the second frequency response, and the third frequency response may be different from each other, while the fourth frequency response may be the same as the third frequency response. In some embodiments, the acoustic-electric transducers in an acoustic-electric transducing module 1510 may have same frequency bandwidth (as illustrated in FIG. 24A and the descriptions thereof) or different frequency bandwidths (as illustrated in FIG. 24B and the descriptions thereof). FIG. 24A illustrates the frequency response of an exemplary acoustic-electric transducing module (or referred to as a first acoustic-electric transducing module). FIG. 24B illustrates the frequency response of another exemplary acoustic-electric transducing module (or referred to as a second acoustic-electric transducing module) different from the frequency response of the acoustic-electric transducing module shown in FIG. 24A. As illustrated in FIG. 24A and FIG. 24B, the first acoustic-electric transducing module or the second acoustic-electric transducing module may include 8 acoustic-electric transducers. In some embodiments, the overlap ranges between frequency responses of the acoustic-electric transducers may be adjusted by adjusting structure parameters of the acoustic-electric transducers to change the center frequency and/or the bandwidth of one or more of these acoustic-electric transducers. In some embodiments, the first acoustic-electric transducing module or the second acoustic-electric transducing module may include certain number of acoustic-electric transducers such that the frequency bands of the sub-band signals generated by the acoustic-electric transducers may cover the frequency band to be processed. In some embodiments, acoustic-electric transducers in the second acoustic-electric transducing module may have different center frequencies. In some embodiments, at least one acoustic-electric transducer with a narrow frequency bandwidth may be set to generate sub-band signals of a certain frequency band. In some embodiments, the acoustic-electric transducer with a higher center frequency response may be set to have a higher frequency bandwidth.

In some embodiments, an acoustic-electric transducer that has a center frequency higher than that of another acoustic-electric transducer may have a larger frequency bandwidth than that of the another acoustic-electric transducer.

The acoustic-electric transducers in the acoustic-electric transducing module 1510 may detect an audio signal 1505. The audio signal 1505 may be from an acoustic source capable of generating an audio signal. The acoustic source may be a living object such as a user of the signal processing device 1500 and/or a non-living object such as a CD player, a television, or the like, or a combination thereof. In some embodiments, the audio signal may also include ambient sound. The audio signal 1505 may have a certain frequency band. For example, the audio signal 1505 generated by the user of the signal processing device 1500 may have a frequency band of 10-30,000 HZ. The acoustic-electric transducers may generate, according to the audio signal 1505, a plurality of sub-band electric signals (e.g., sub-band electric signals 1531, 1532, 1533, . . . , and 1534 illustrated in FIG. 15). A sub-band electric signal (also referred to as a sub-band signal) generated according to the audio signal 1505 refers to the signal having a frequency band narrower than the frequency band of the audio signal 1505. The frequency band of the sub-band signal may be within the frequency band of the corresponding audio signal 1505. For example, the audio signal 1505 may have a frequency band of 10-30,000 HZ, and the frequency band of the sub-band audio signal may be 100-200 HZ, which is within the frequency band of the audio signal 1505, i.e., 10-30,000 HZ. In some embodiments, an acoustic-electric transducer may detect the audio signal 1505 and generate one sub-band signal according to the audio signal detected. For example, the acoustic-electric transducers 1511, 1512, 1513, and 1514 may detect the audio signal 1505 and generate a sub-band electric signal 1531, a sub-band electric signal 1532, a sub-band electric signal 1533, and a sub-band electric signal 1534, respectively, according to their respectively detected audio signal. In some embodiments, at least two of the plurality of sub-band signals generated by the acoustic-electric transducers may have different frequency bands. As illustrated above, at least two of the acoustic-electric transducers may have different frequency responses, which may result in two different sub-band signals according to the detections of the same audio signal 1505 by two different acoustic-electric transducers. The acoustic-electric transducing module 1510 may transmit the generated sub-band signals to the sampling module 1520. The acoustic-electric transducing module 1510 may transmit the sub-band signals through one or more transmitters (not shown). Exemplary transmitter may be a coaxial cable, a communication cable (e.g., a telecommunication cable), a flexible cable, a spiral cable, a non-metallic sheath cable, a metal sheath cable, a multi-core cable, a twisted-pair cable, a ribbon cable, a shielded cable, a double-strand cable, an optical fiber, or the like, or a combination thereof. In some embodiments, the sub-band signals may be transmitted to the sampling module 1520 via a signal transmitter. In some embodiments, the sub-band signals may be transmitted to the sampling module 1520 via a plurality of sub-band transmitters connected in parallel. Each of the plurality of sub-band transmitters may connect to an acoustic-electric transducer in the acoustic-electric transducing module 1510 and transmit the sub-band signal generated by the acoustic-electric transducer to the sampling module 1520. For example, the sub-band transmitters may include a first sub-band transmitter connected to the acoustic-electric transducer 1511 and a second sub-band transmitter connected to the acoustic-electric transducer 1512. The first sub-band transmitter and the second sub-band transmitter may be connected in parallel. The first sub-band transmitter and the second sub-band transmitter may transmit the sub-band electric signal 1531 and the sub-band electric signal 1532 to the sampling module 1520, respectively.

Figure 23A:
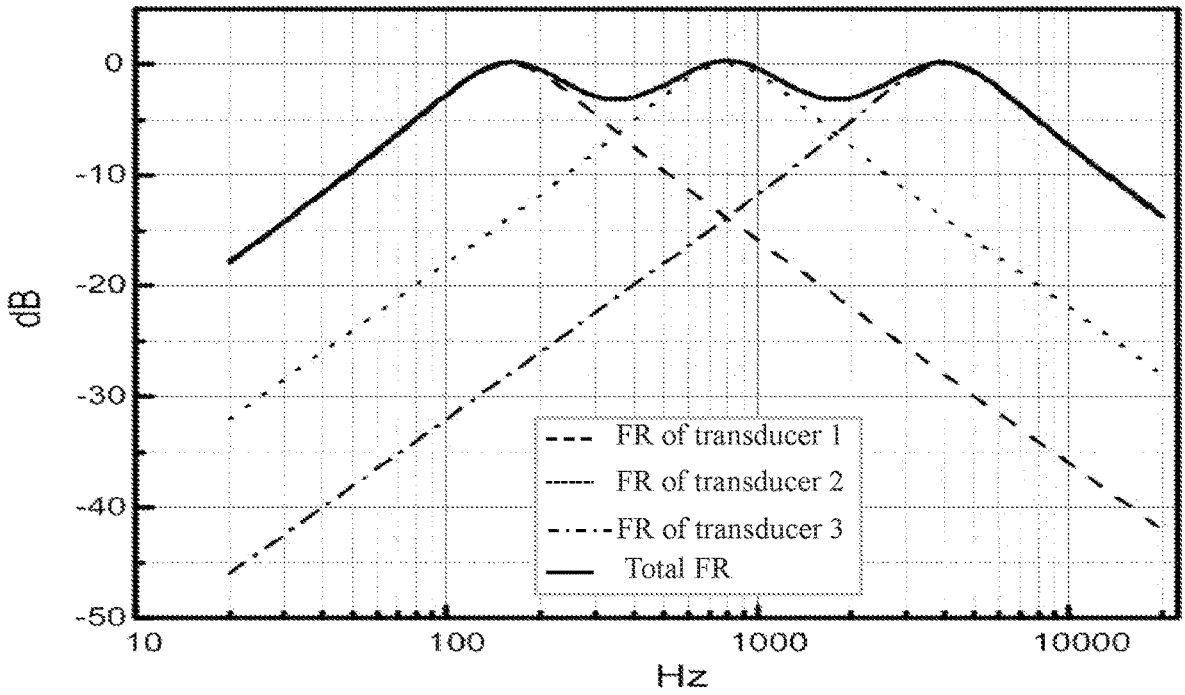
FIG. 23A illustrates an exemplary frequency response of an acoustic-electric transducing module according to some embodiments of the present disclosure.
Figure 23B:
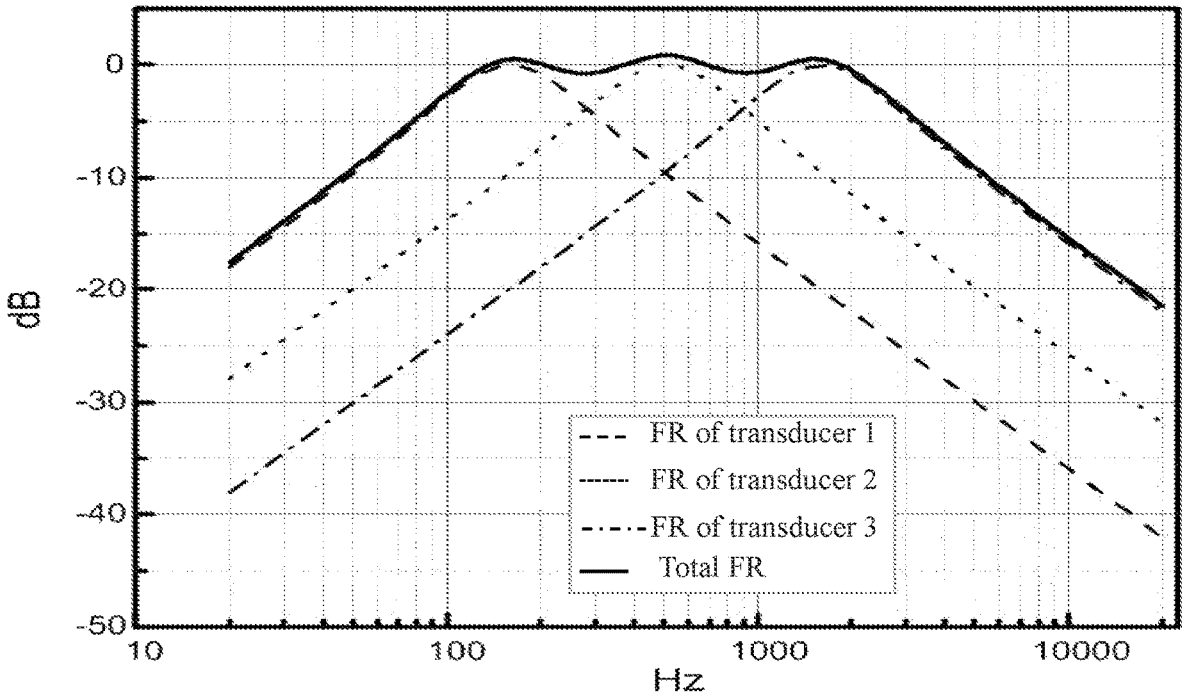
FIG. 23B illustrates an exemplary frequency response of an acoustic-electric transducing module according to some embodiments of the present disclosure.
Figure 23C:
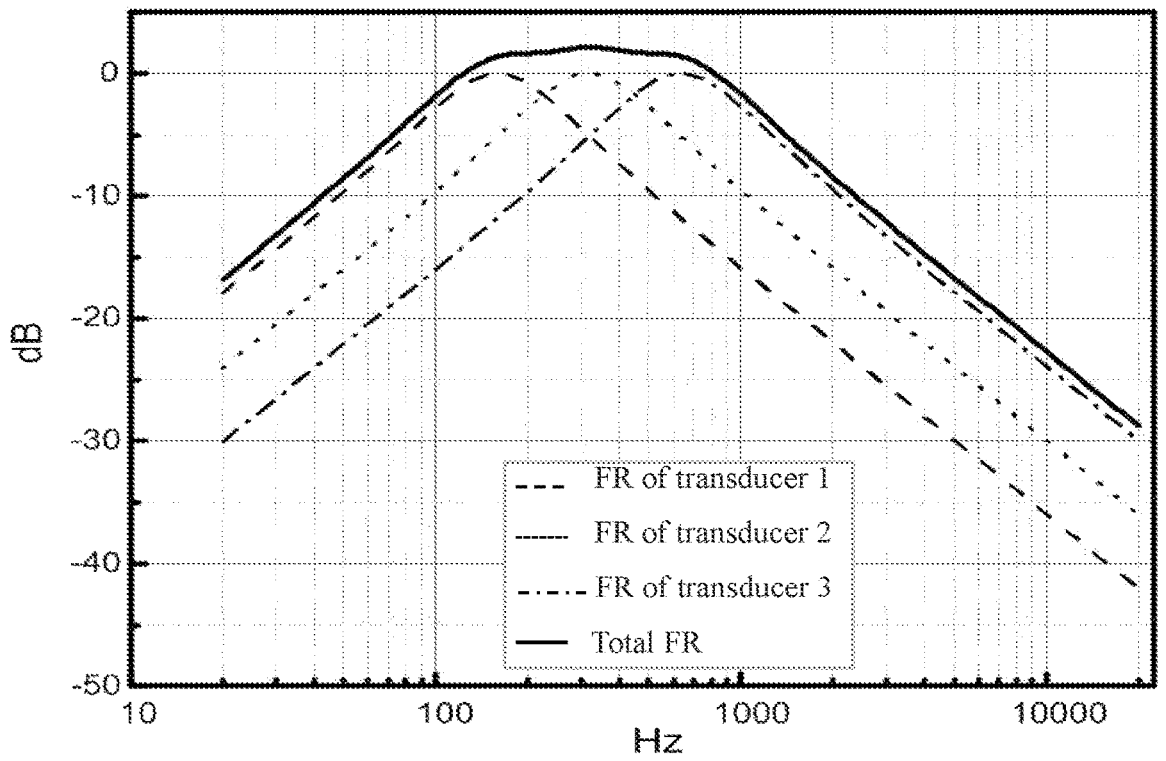
FIG. 23C illustrates an exemplary frequency response of an acoustic-electric transducing module according to some embodiments of the present disclosure.

The frequency response of an acoustic-electric transducing module 1510 may depend on the frequency responses of the acoustic-electric transducers included in the acoustic-electric transducing module 1510. For example, the flatness of the frequency response of an acoustic-electric transducing module 1510 may be related to where the frequency response of the acoustic-electric transducers in the acoustic-electric transducing module 1510 intersect with each other. As illustrated in FIGS. 23A-23C (and the descriptions thereof below), when the frequency responses of acoustic-electric transducers intersect near or at the half-power point(s), the frequency response of the acoustic-electric transducing module 1510 that includes the acoustic-electric transducers may be flatter than that of the acoustic-electric transducing module 1510 when the acoustic-electric transducers therein do not intersect near nor at the half-power point(s). As used herein, the half power point of a certain frequency response refers to frequency point(s) with a power level of −3 dB. As used herein, two frequency responses may be considered to intersect near a half-power point when they intersect at a frequency point that is near the half-power point. As used herein, a frequency point may be considered to be near a half-power point when the power level difference between the frequency point and the half-power point is no larger than 2 dB. In some embodiments, when the frequency response of the acoustic-electric transducers in the acoustic-electric transducing module 1510 intersect with each other at a frequency point (e.g., a one-quarter-power point, or a one-eighths-power point, etc.) with a power level which is more than 2 dB lower than that of the half-power point, the overlap range between frequency responses of adjacent acoustic-electric transducers may be relatively small, causing the frequency response of a combination of the adjacent acoustic-electric transducers to decrease within the overlap range, thus affecting the quality of the sub-band signals output by the adjacent acoustic-electric transducers. In some embodiments, when the frequency response of the acoustic-electric transducers in the acoustic-electric transducing module 1510 intersect with each other at a frequency point (e.g., a three-quarters-power point, or a seven-eighths-power point, etc.) with a power level 1 dB higher than the half-power point, the overlap range between frequency responses of adjacent acoustic-electric transducers may be relatively high, causing a relatively high interference range between the sub-band signals output by the acoustic-electric transducers.

Figure 26A:
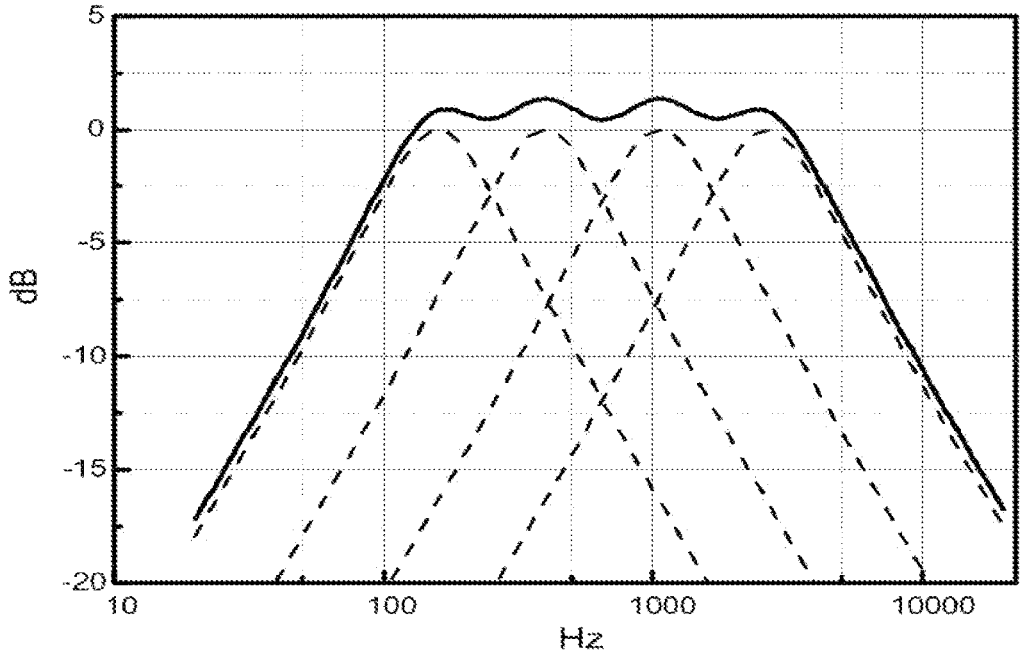
FIG. 26A illustrates an exemplary frequency response of an acoustic-electric transducing module according to some embodiments of the present disclosure.
Figure 26B:
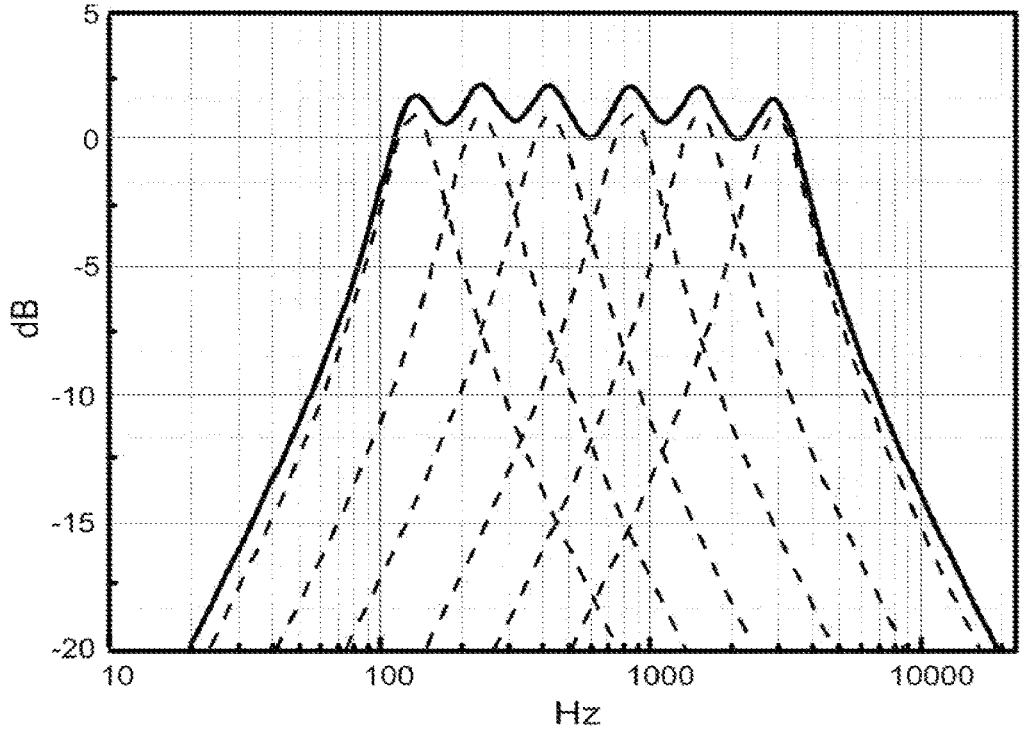
FIG. 26B illustrates an exemplary frequency response of an acoustic-electric transducing module according to some embodiments of the present disclosure.

In some embodiments, for a certain frequency band, a limited number of acoustic-electric transducers may be allowed in an acoustic-electric transducing module 1510. More acoustic-electric transducers may be included in an acoustic-electric transducing module 1510 when the acoustic-electric transducers are under-damped ones rather than non-underdamping ones. Merely by way of example, FIG. 26A illustrates the frequency response of the acoustic-electric transducing module 1510 that includes four (the four dashed lines being the frequency responses of the four individual non-underdamping acoustic-electric transducers if they operate separately; and the solid line being the frequency response of the combination of the four non-underdamping acoustic-electric transducers). In some embodiments, more acoustic-electric transducers may be allowed to be in the acoustic-electric transducing module 1510, when one or more of the acoustic-electric transducers are in under-damped state. For example, the acoustic-electric transducing module 1510 may include six or more under-damped acoustic-electric transducers. Merely by way of example, FIG. 26B illustrates the frequency response of the acoustic-electric transducing module 1510 having six under-damped acoustic-electric transducers.

The sampling module 1520 may include a plurality of sampling units (e.g., sampling units 1521, 1522, 1523, . . . , and 1524 illustrated in FIG. 15). The sampling units may be connected in parallel.

A sampling unit (e.g., the sampling unit 1521, the sampling unit 1522, the sampling unit 1523, or the sampling unit 1524) in the sampling module 1520 may communicate with an acoustic-electric transducer and be configured to receive and sample the sub-band signal generated by the acoustic-electric transducer. The sampling unit may communicate with the acoustic-electric transducer via a sub-band transmitter. Merely by way of example, the sampling unit 1521 may be connected to the first sub-band transmitter and configured to sample the sub-band electric signal 1531 received therefrom, while the sampling unit 1522 may be connected to second sub-band transmitter and configured to sample the sub-band electric signal 1532 received therefrom.

In some embodiments, a sampling unit (e.g., sampling unit 1521, sampling unit 1522, sampling unit 1523, or sampling unit 1524) in the sampling module may sample the sub-band signal received and generate a digital signal based on the sampled sub-band signal. For example, the sampling unit 1521, the sampling unit 1522, the sampling unit 1523, and the sampling unit 1524 may sample the sub-band signals and generate a digital signal 1551, a digital signal 1552, a digital signal 1553, and a digital signal 1554, respectively.

In some embodiments, the sampling unit may sample a sub-band signal using a band pass sampling technique. For example, a sampling unit may be configured to sample a sub-band signal using band pass sampling with a sampling frequency according to the frequency band of the sub-band signal. Merely by way of example, the sampling unit may sample a sub-band signal with a frequency band that is no less than two times the bandwidth of the frequency band of the sub-band signal. In some embodiments, the sampling unit may sample a sub-band signal with a frequency band that is no less than two times the bandwidth of the frequency band of the sub-band signal and no greater than four times the bandwidth of the frequency band of the sub-band signal. In some embodiments, by using a band pass sampling technique rather than a bandwidth sampling technique or a low-pass sampling technique, a sampling unit may sample a sub-band signal with a relative low sampling frequency, reducing the difficulty and cost of the sampling process. Also, by using bandpass sampling technique, little noise or signal distortion may be introduced in the sampling process. As described in connection with FIG. 14, the signal processing system 1400 (e.g., the sub-band filtering module 1430) may perform a digital signal processing process through a software program to generate sub-band signals, which may introduce signal distortions due to factors including the algorithms used in the signal processing process, sampling methods used in the sampling process, and structures of the components in the signal processing system 1400 (e.g., the acoustic-electric transducer 1410, the sampling module 1420, and/or the sub-band filtering module 1430). As compared to sub-band filtering module 1430, the signal processing system 1500 may generate sub-band signals based on structures and characteristics of the acoustic-electric transducers.

The sampling unit may transmit the generated digital signal to the signal processing module 1540. In some embodiments, the digital signals may be transmitted via parallel transmitters. In some embodiments, the digital signals may be transmitted via a transmitter according to a certain communication protocol. Exemplary communication protocol may include AES3 (audio engineering society), AES/EBU (European broadcast union)), EBU (European broadcast union), ADAT (Automatic Data Accumulator and Transfer), I2S (Inter-IC Sound), TDM (Time Division Multiplexing), MIDI (Musical Instrument Digital Interface), Cobra Net, Ethernet AVB (Ethernet Audio/Video Bridging), Dante, ITU (Tnternational Telecommunication Union)-T G.728, ITU-T G.711, ITU-T G.722, ITU-T G.722.1, ITU-T G.722.1 Annex C, AAC (Advanced Audio Coding)-LD, or the like, or a combination thereof. The digital signal may be transmitted in a certain format including a CD (Compact Disc), WAVE, AIFF (Audio Interchange File Format), MPEG (Moving Picture Experts Group)-1, MPEG-2, MPEG-3, MPEG-4, MIDI (Musical Instrument Digital Interface), WMA (Windows Media Audio), RealAudio, VQF (Transform-domain Weighted Nterleave Vector Quantization), AMR (Adaptive Multi-Rate), APE, FLAC (Free Lossless Audio Codec), AAC (Advanced Audio Coding), or the like, or a combination thereof.

The signal processing module 1540 may process the data received from other components in the signal processing device 1500. For example, the signal processing module 1540 may process the digital signals transmitted from the sampling units in the sampling module 1520. The signal processing module 1540 may access information and/or data stored in the sampling module 1520. As another example, the signal processing module 1540 may be directly connected to the sampling module 1520 to access stored information and/or data. In some embodiments, the signal processing module 1540 may be implemented by a processor such as a microcontroller, a microprocessor, a reduced instruction set computer (RISC), an application specific integrated circuits (ASICs), an application-specific instruction-set processor (ASIP), a central processing unit (CPU), a graphics processing unit (GPU), a physics processing unit (PPU), a microcontroller unit, a digital signal processor (DSP), a field programmable gate array (FPGA), an advanced RISC machine (ARM), a programmable logic device (PLD), any circuit or processor capable of executing one or more functions, or the like, or any combinations thereof.

It should be noted that the above descriptions of the signal processing device 1500 is merely provided for the purposes of illustration, and not intended to limit the scope of the present disclosure. For a person having ordinary skill in the art, multiple variations and modifications may be made under the teaching of the present disclosure. However, those variations and modifications do not depart from the scope of the present disclosure. For example, the signal processing device 1500 may further include a storage to store the signals received from other components in the signal processing device 1500 (e.g., the acoustic-electric transducing module 1510, and/or the sampling module 1520). Exemplary storage may include a mass storage, removable storage, a volatile read-and-write memory, a read-only memory (ROM), or the like, or a combination thereof. As another example, one or more transmitters may be omitted. The plurality of sub-band signals may be transmitted by media of wave such as infrared wave, electromagnetic wave, sound wave, or the like, or a combination thereof. As a further example, the acoustic-electric transducing module 1510 may include 2, 3, or 4 acoustic-electric transducers.

Figure 16:
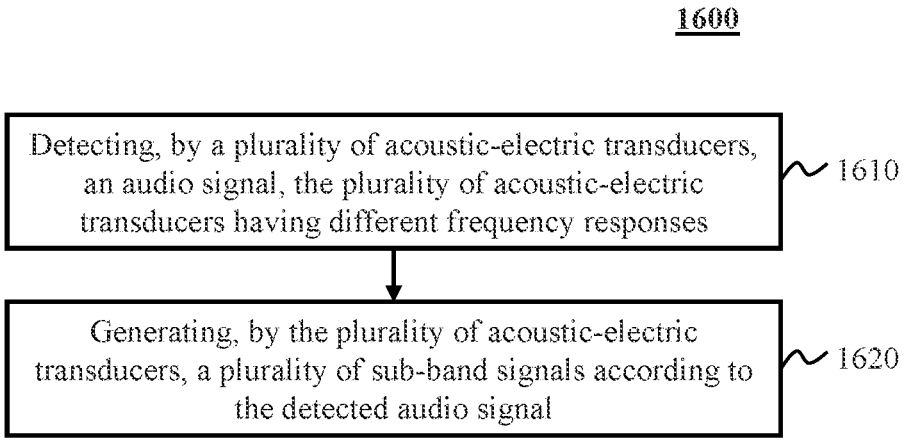
FIG. 16 is a flowchart of an exemplary process for processing an audio signal according to some embodiments of the present disclosure.

FIG. 16 is a flowchart illustrating an exemplary process for processing an audio signal according to some embodiments of the present disclosure. At least a portion of process 300 may be implemented on the signal processing device 1500 as illustrated in FIG. 15.

In 1610, an audio signal 1505 may be detected. The audio signal 1505 may be detected by a plurality of acoustic-electric transducers. In some embodiments, the acoustic-electric transducers may have different frequency responses. The plurality of acoustic-electric transducers may be arranged in the same signal processing device 1500 as illustrated in FIG. 15. The audio signal 1505 may have a certain frequency band.

In 1620, a plurality of sub-band signals may be generated according to the audio signal 1505. The plurality of sub-band signals may be generated by the plurality of acoustic-electric transducers. At least two of the generated sub-band signals may have different frequency bands. Each sub-band signal may have a frequency band that is within the frequency band of the audio signal 1505.

It should be noted that the above description regarding the process 1600 is merely provided for the purposes of illustration, and not intended to limit the scope of the present disclosure. For a person having ordinary skill in the art, multiple variations and modifications may be made under the teachings of the present disclosure. However, those variations and modifications do not depart from the scope of the present disclosure. In some embodiments, one or more operations in process 1600 may be omitted, or one or more additional operations may be added. For example, the process 1600 may further include an operation for sampling the sub-band signals after operation 1620.

Figure 17:
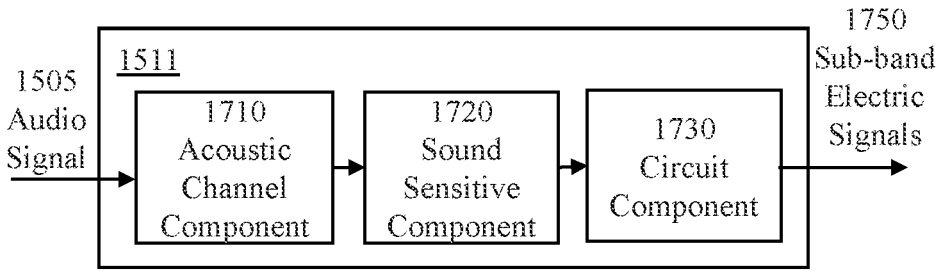
FIG. 17 is a schematic diagram of an exemplary acoustic-electric transducer according to some embodiments of the present disclosure.

FIG. 17 is a schematic diagram of an exemplary acoustic-electric transducer according to some embodiments of the present disclosure. The acoustic-electric transducer 1511 may be configured to convert an audio signal to an electric signal. The acoustic-electric transducer 1511 may include an acoustic channel component 1710, a sound sensitive component 1720, and a circuit component 1730.

The acoustic channel component 1710 may affect the path through which an audio signal is transmitted to the sound sensitive component 1720 by the acoustic channel component 1710's acoustic structure, which may process the audio signal before the audio signal reaches the sound sensitive component 1720. In some embodiments, the audio signal may be an air-conduction-sound signal, and the acoustic structure of the acoustic channel component 1710 may be configured to process the air-conduction-sound signal. Alternatively, the audio signal may be a bone-conduction-sound signal, and the acoustic structure of the acoustic channel component 1710 may be configured to process the bone-conduction-sound signal. In some embodiments, the acoustic structure may include one or more chamber structures, one or more pipe structures, or the like, or a combination thereof.

In some embodiments, the acoustic impedance of an acoustic structure may change according to the frequency of a detected audio signal. In some embodiments, the acoustic impedance of an acoustic structure may change within a certain range. Thus, in some embodiments, the frequency band of an audio signal may cause corresponding changes in the acoustic impedance of an acoustic structure. In other words, the acoustic structure may function as a filter that processes a sub-band of a detected audio signal. In some embodiments, an acoustic structure mainly including a chamber structure may function as a high-pass filter, while an acoustic structure mainly including a pipe structure may function as a low-pass filter.

In some embodiments, the acoustic impedance of an acoustic structure which mainly includes a chamber structure may be determined according to Equation (14) as follows:

$$Z = \frac{1}{j\omega C_a} = \frac{\rho_0 c_0}{j\omega V_0}, \tag{14}$$

where Z refers to the acoustic impedance, ω refers to the angular frequency (e.g., the chamber structure), j refers to a unit imaginary number $C_a$ refers to the sound capacity, $\rho_0$ refers to the density of air, $c_0$ refers to the speed of sound, and $V_0$ refers to the equivalent volume of the chamber.

In some embodiments, the acoustic impedance of an acoustic structure which mainly includes a pipe structure may be determined according to Equation (15) as follows:

$$Z = j\omega M_a = j\omega \frac{\rho_0 l_0}{S}, \tag{15}$$

where Z refers to the acoustic impedance, $M_a$ refers to the acoustic mass, ω refers to the angular frequency of the acoustic structure (e.g., the pipe structure), $\rho_0$ refers to the density of air, $l_0$ refers to the equivalent length of the pipe, and S refers to the cross-sectional area of the orifice.

A chamber-pipe structure is a combination of the sound capacity and the acoustic mass in serial, for example, a Helmholtz resonator, and an inductor-capacitor (LC) resonance circuit may be formed. The acoustic impedance of a chamber-pipe structure may be determined according to Equation (16) as follows:

$$Z = j\left(\omega M_a - \frac{1}{\omega C_a}\right). \quad (16)$$

According to Equation (16), a chamber-pipe structure may function as a bandpass filter. The center frequency of the bandpass filter may be determined according to Equation (17) as follows:

$$\omega_0 = \sqrt{M_a C_a}. \quad (17)$$

If an acoustic resistance material is used in the chamber-pipe structure, a resistor-inductor-capacitor (RLC) series loop may be formed, and the acoustic impedance of the RLC series loop may be determined according to Equation (18) as follows:

$$Z = R_a + j\left(\omega M_a - \frac{1}{\omega C_a}\right), \quad (18)$$

where $R_a$ refers to the acoustic resistance of the RLC series loop. The chamber-pipe structure may also function as a band pass filter. The adjustment of the acoustic resistance $R_a$ may change the bandwidth of the band pass filter. The center frequency of the bandpass filter may be determined according to Equation (19) as follows:

$$\omega_0 = \sqrt{M_a C_a}. \quad (19)$$

The sound sensitive component 1720 may convert the audio signal transmitted by the acoustic-channel component to an electric signal. For example, the sound sensitive component 1720 may convert the audio signal into changes in electric parameters, which may be embodied as an electric signal. The structure of the sound sensitive component 1720 may include diaphragms, plates, cantilevers, etc. In some embodiments, the sound sensitive component 1720 may include one or more diaphragms. Details regarding the structure of a sound sensitive component 1720 including a diaphragm may be found elsewhere in this disclosure (e.g., FIGS. 19A and 19B and the descriptions thereof). Details regarding the structure of a sound sensitive component 1720 including multiple diaphragms may be found elsewhere in this disclosure (e.g., FIGS. 20A and 21A and the descriptions thereof). The diaphragms included in the sound sensitive component 1720 may be connected in parallel (e.g., as illustrated in FIG. 20A) or series (e.g., as illustrated in FIG. 21A). In some embodiments, referring to FIGS. 20B and 20C and the descriptions thereof, the bandwidth of the frequency response of a sound sensitive component 1720 having multiple diaphragms that are connected in parallel may be wider and flatter than the bandwidth of the frequency response of the sound sensitive component 1720 having a diaphragm. In some embodiments, referring to FIG. 21B and the descriptions thereof, the bandwidth of the frequency response of a sound sensitive component 1720 having multiple diaphragms that are connected in series may have a sharper edge than the bandwidth of the frequency response of the sound sensitive component 1720 having a diaphragm. The material of the sound sensitive component 1720 may include plastics, metals, composites, piezoelectric materials, etc. More detailed descriptions about the sound sensitive component 1720 may be found elsewhere in the present disclosure (e.g., FIGS. 19A-22D and the descriptions thereof).

As described in connection with the acoustic channel component 1710, the acoustic channel component 1710 or the sound sensitive component 1720 may function as a filter. A structure including an acoustic channel component 1710 and a sound sensitive component 1720 may also function as a filter. Detailed description of the structure may be found in FIG. 22A and FIG. 22B and the descriptions thereof.

In some embodiments, by modifying parameter(s) (e.g., structure parameters) of an acoustic channel component 1710 and/or a sound sensitive component 1720, the frequency response of the combination of the acoustic channel component 1710 and the sound sensitive component 1720 may be adjusted accordingly. For example, FIG. 22C illustrates exemplary frequency responses of two combination structures according to some embodiments of the present disclosure. Dotted line 2231 represents the frequency response of a combination of an acoustic channel component and a sound sensitive component (or referred to as a first combination structure). One or more parameters (e.g., structural parameters) of the acoustic channel component or the sound sensitive component may be modified, resulting in a second combination structure that is different from the first combination structure. Solid line 2233 may indicate the frequency response of the second combination structure. As illustrated by FIG. 22C, the frequency response of the second combination structure (i.e., solid line 2233) may be flatter than the frequency response of the first combination structure (i.e., dotted line 2231), in the frequency band 20 Hz-20,000 Hz.

In some embodiments, the frequency response of a combination of an acoustic channel component 1710 and a sound sensitive component 1720 may be related to the frequency response of the acoustic channel component 1710 and/or the frequency response of the sound sensitive component 1720. For example, the steepness of the edges of the frequency response of the combination of the acoustic channel component 1710 and the sound sensitive component 1720 may be related to the extent to which the cutoff frequency of the frequency response of the acoustic channel component 1710 is close to the cutoff frequency of the frequency response of the sound sensitive component 1720. The edges of the frequency response of the combination of the acoustic channel component 1710 and the sound sensitive component 1720 may be steeper, when the cutoff frequency of the frequency response of the acoustic channel component 1710 and the cutoff frequency of the frequency response of the sound sensitive component 1720 is closer to each other. For example, FIG. 22D illustrates an exemplary frequency response of a combination structure according to some embodiments of the present disclosure. Dashed line 2241 represents the frequency response of a sound sensitive component. Dotted line 2243 represents the frequency response of an acoustic channel component, and solid line 2245 may indicate the frequency response of a combination of the acoustic channel component and the sound sensitive component. As illustrated by FIG. 22D, the corner frequency (also referred to as cutoff frequency) of the acoustic channel component (i.e., dotted line 2243) may be close to or the same as the corner frequency of the sound sensitive component (i.e., dashed line 2241), which may result in the frequency of the combination of the acoustic channel component and the sound sensitive component (i.e., solid line 2245) to have a steeper edge.

In some embodiments, one or more structure parameters of the acoustic channel component 1710 and/or the sound sensitive component 1720 may be modified or adjusted. For example, the spacing between different elements in the acoustic channel component 1710 and/or the sound sensitive component 1720 may be adjusted by a motor, which is driven by the feedback module illustrated elsewhere in the present disclosure. As another example, the current flowing through the sound sensitive component 1720 may be adjusted under instructions sent, e.g., by the feedback module. The adjustment of one or more structure parameters of the acoustic channel component 1710 and/or the sound sensitive component 1720 may result in changes in the filtering characteristic of thereof.

The circuit component 1730 may detect the changes in electric parameters (e.g., an electric signal). In some embodiments, the circuit component 1730 may perform one or more functions on electric signals for further processing. Exemplary functions may include amplification, modulation, simple filtering, or the like, or a combination thereof. In some embodiments, via adjusting one or more parameters of the circuit component 1730, sensitivity of corresponding pass-bands may be adjusted to match each other. In some embodiments, the circuit components 1730 may adjust the sensitivity of one or more pass-bands according to conditions such as a preset instruction, a feedback signal, or a control signal transmitted by a controller, or the like, or a combination thereof. In some embodiments, the circuit components 1730 may adjust the sensitivity of one or more pass-bands automatically.

Figure 18A:
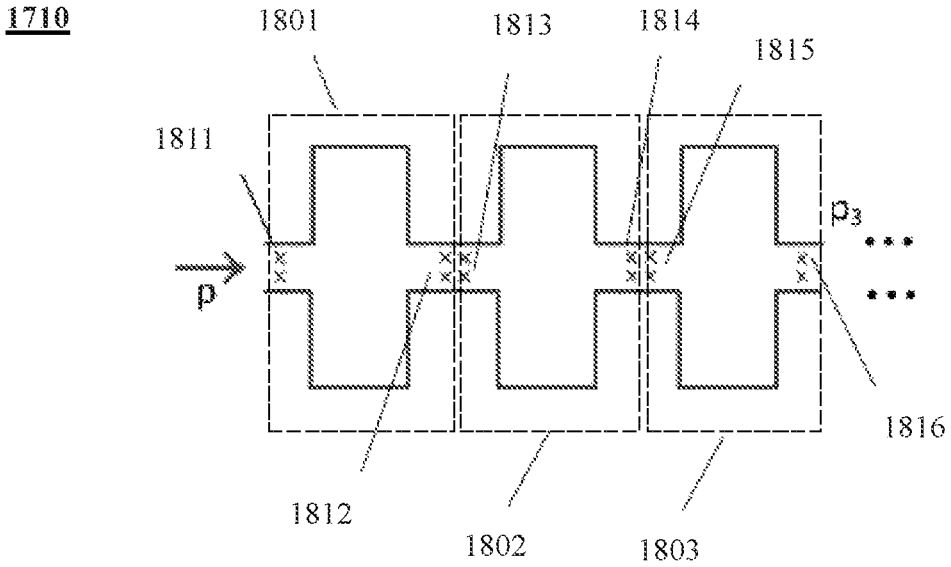
FIG. 18A illustrates an exemplary acoustic channel component according to some embodiments of the present disclosure.

FIG. 18A illustrates an exemplary acoustic channel component 1710 according to some embodiments of the present disclosure. The acoustic channel component 1710 may include one or more pipe structures. FIG. 18A depicts three exemplary pipe structures, namely, a first pipe structure 1801, a second pipe structure 1802, and a third pipe structure 1803. Each pipe structure may include a front acoustic resistance material to detect or receive an audio signal, and an end acoustic resistance material to output a signal according to the audio signal. For example, the first pipe structure 1801 may include a front acoustic resistance material 1811 and an end acoustic resistance material 1812. The second pipe structure 1802 may include a front acoustic resistance material 1813, and an end acoustic resistance material 1814. The third pipe structure 1803 may include a front acoustic resistance material 1815, and an end acoustic resistance material 1816. When sound pressure P passes the first pipe structure 1801, the second pipe structure 1802, and the third pipe structure 1803 successively, the sound pressure P may become sound pressure $P_3$. An exemplary circuit corresponding to the acoustic channel component 1710 (or referred to as an acoustic filtering network) may be illustrated in FIG. 18B.

Figure 18B:
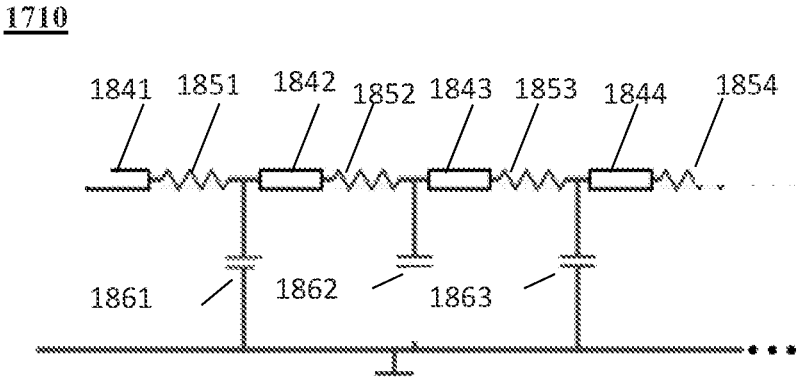
FIG. 18B illustrates an exemplary equivalent circuit model of the acoustic channel component shown in FIG. 18A according to some embodiments of the present disclosure.

FIG. 18B illustrates an exemplary equivalent circuit model of the acoustic channel component 1710 shown in FIG. 18A according to some embodiments of the present disclosure. The circuit may include a first resistor 1841, a second resistor 1842, a third resistor 1843, a fourth resistor 1844, a first inductor 1851, a second inductor 1852, a third inductor 1853, a fourth inductor 1854, a first capacitor 1861, a second capacitor 1862, and a third capacitor 1863. A first end of the first capacitor 1861 may connect to a first end of the first inductor 1851, and a first end of the second resistor 1842. A second end of the first inductor 1851 may connect to a first end of the first resistor 1841. A first end of the second capacitor 1862 may connect to a first end of the second inductor 1852, and a first end of the third resistor 1843. A second end of the second inductor 1852 may connect to a second end of the second resistor 1842. A first end of the third capacitor 1863 may connect to a first end of the third inductor 1853, and a first end of the fourth resistor 1844. A second end of the third inductor 1853 may connect to a second end of the third resistor 1843. A first end of the fourth inductor 1854 may connect to a second end of the fourth resistor 1844.

Figure 19A:
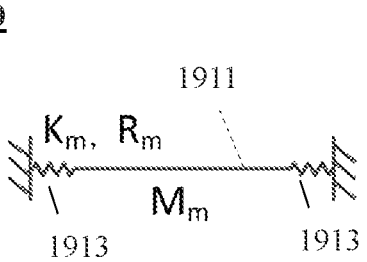
FIG. 19A is a schematic diagram of an exemplary mechanical model of a sound sensitive component according to some embodiments of the present disclosure.
Figure 20A:
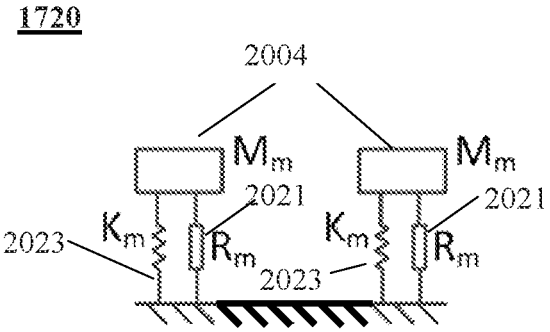
FIG. 20A is a schematic diagram of a mechanical model of an exemplary sound sensitive component according to some embodiments of the present disclosure.

FIG. 19A is a schematic diagram of an exemplary mechanical model of the sound sensitive component 1720 according to some embodiments of the present disclosure. One or more elements in the sound sensitive component 1720 may vibrate according to an audio signal impinging on it. The audio signal may be transmitted from the acoustic channel component 1710. In some embodiments, the vibration of one or more elements in the sound sensitive component 1720 may lead to changes in electric parameters of the sound sensitive component 1720. Sound sensitive component 1720 may be sensitive to a certain frequency band of an audio signal. The frequency band of an audio signal may cause corresponding changes in electric parameters of the sound sensitive component 1720. In other words, the sound sensitive component 1720 may function as a filter that process a sub-band of the audio signal.

In some embodiments, the sound sensitive component 1720 may be a diaphragm. FIG. 19A illustrates an exemplary diaphragm, which may include a diaphragm 1911, and an elastic component 1913. A first point of the diaphragm 1911 may connect to a first point of the elastic component 1913. A second point of the diaphragm 1911 may connect to and a second point of the elastic component 1913.

Figure 19B:
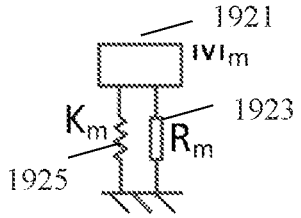
FIG. 19B is a schematic diagram of an exemplary mechanical model of a sound sensitive component according to some embodiments of the present disclosure.

FIG. 19B is a schematic diagram of an exemplary mechanical model of sound sensitive component 1720 according to some embodiments of the present disclosure. The sound sensitive component 1720 may be a diaphragm. As illustrated in FIG. 19B, the diaphragm may include a diaphragm 1921, a damping component 1923, and an elastic component 1925. A first end of the diaphragm 1921 may connect to a first end of the damping component 1923, and a first end of the elastic component 1925 (e.g., a spring). A second end of the damping component 1923 may be fixed. A second end of the elastic component 1925 may be fixed.

Figure 19C:
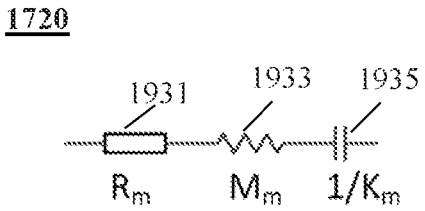
FIG. 19C is a schematic diagram of an exemplary equivalent circuit model corresponding to the mechanical model shown in FIGS. 19A and 19B according to some embodiments of the present disclosure.

FIG. 19C is a schematic diagram of an exemplary equivalent circuit model corresponding to the mechanical model shown in FIGS. 19A and 19B according to some embodiments of the present disclosure. The circuit may include a resistor 1931, an inductor 1933, and a capacitor 1935. A first end of the inductor 1933 may connect to a first end of the resistor 1931. A second end of the inductor 1933 may connect to a first end of the capacitor 1935. The circuit may constitute an RLC series circuit, which may act as a bandpass filter. The center frequency of the bandpass filter may be determined according to Equation (20) as follows:

$$\omega_0 = \sqrt{\frac{K_m}{M_m}}, \tag{20}$$

where $M_m$ refers to the mass of the diaphragm, $K_m$ refers to the elasticity coefficient of the diaphragm, and $R_m$ refers to the damping of the diaphragm. $R_m$ may be adjusted to modify the bandwidth of the filter implemented by the RLC series circuit. In some embodiments, the acoustic structure, which may affect the path through which an audio signal is transmitted to the sound sensitive component 1720, or the sound sensitive component 1720, which may convert the audio signal to an electric signal, may affect the audio signal in both frequency domain and time domain. In some embodiments, one or more characteristics of the sound sensitive component 1720 may be adjusted by adjusting one or more non-linear time-varying characteristics of the materials of the sound sensitive component 1720 to meet certain filtering requirements. Exemplary non-linear time-varying characteristics may include hysteresis delay, creep, non-Newtonian characteristics, or the like, or a combination thereof.

FIG. 20A is a schematic diagram of a mechanical model of an exemplary sound sensitive component 1720 according to some embodiments of the present disclosure. In some embodiments, multiple sound sensitive components may be combined to achieve certain filtering characteristics.

As shown in FIG. 20A, the mechanical model may include a plurality of sound sensitive components. The sound sensitive components may be connected in parallel. The mechanical model corresponding to each sound sensitive component may include a diaphragm 2004, a damping component 2021, and an elastic component 2023. More detailed descriptions about an individual sound sensitive component may be found elsewhere in the present disclosure (e.g., FIGS. 19B and 19C, and the descriptions thereof). In some embodiments, the sound sensitive component 1720 including multiple sound sensitive components may perform multi-peak filtering, multi-center-frequency filtering, or multi-bandpass filtering.

Figure 20B:
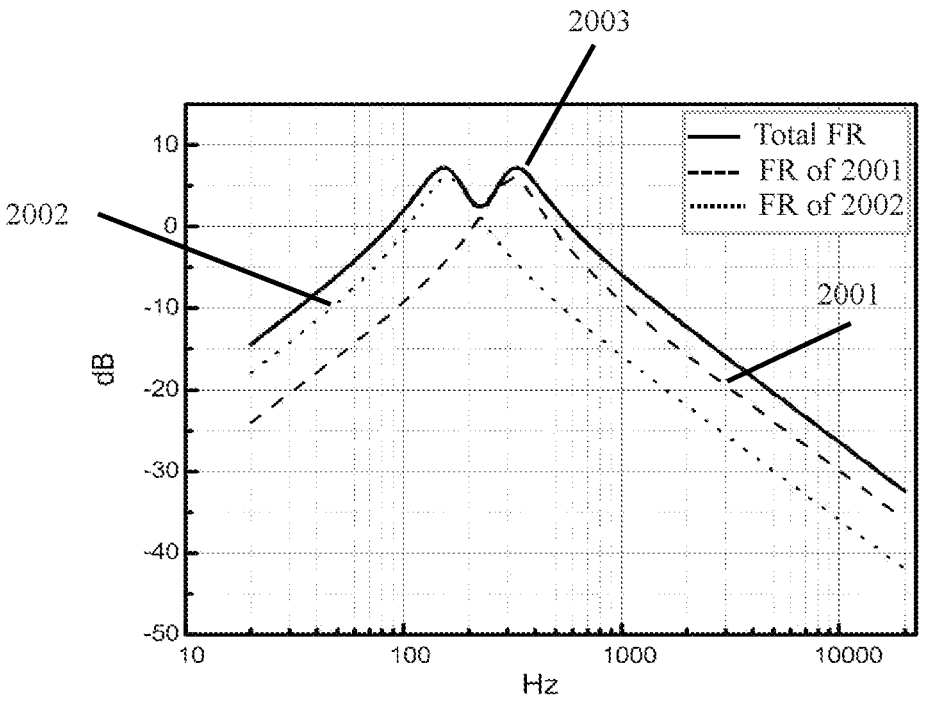
FIG. 20B illustrates exemplary frequency responses corresponding to different sound sensitive components according to some embodiments of the present disclosure.
Figure 21A:
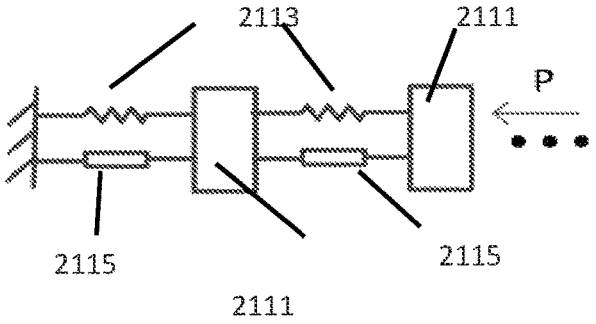
FIG. 21A is a schematic diagram of an exemplary mechanical model corresponding a sound sensitive component according to some embodiments of the present disclosure.

FIG. 20B illustrates exemplary frequency responses corresponding to different sound sensitive components according to some embodiments of the present disclosure. The sound sensitive component 1720 include a first sound sensitive component and a second sound sensitive component. The first sound sensitive component and the second sound sensitive component may be connected in parallel. The center frequency of the first sound sensitive component may be different from the center frequency of the second-sensitive component. For example, as shown in FIG. 20B, dotted line 2001 represents the frequency response of the first sound sensitive component, while dashed line 2002 represent the frequency response of the second sound sensitive component. Solid line 2003 may indicate the frequency response of the combination of the first sound sensitive component and the second sound sensitive component. The bandwidth of the frequency response of the combination of the first sound sensitive component and the second sound sensitive component (i.e., the solid line 2003) is wider and flatter than the frequency response of the first sound sensitive component (i.e., the dotted line 2001) or the frequency response of the second sound sensitive component (i.e., the dashed line 2002).

In some embodiments, the frequency responses of the first sound sensitive component and the second sound sensitive component may intersect with each other. In some embodiments, the frequency responses of the first sound sensitive component and the second sound sensitive component may intersect at a frequency point that is not near the half-power point. As described in connection with FIGS. 23A-23C and the descriptions thereof, when the frequency responses of acoustic-electric transducers intersect near or at the half-power point(s), the frequency response of an acoustic-electric transducing module 1510 which includes the acoustic-electric transducers may be flatter than that of an acoustic-electric transducing module 1510 when the acoustic-electric transducers therein do not intersect near nor at the half-power point(s). However, since the first sound sensitive component and the second sound sensitive component are arranged in the same sound sensitive component 1720, and the overlap of the frequency responses of the first sound sensitive component and the second sound sensitive component may be overlap of vectors, in which the output phases of the first sound sensitive component and the second sound sensitive component should be taken into consideration. Thus, when the frequency response of the first sound sensitive component and the frequency response of the second sound sensitive component intersect at a frequency point that is not near the half-power point, the frequency response of a combination of the first sound sensitive component and the second sound sensitive component may be flatter and wider than that of a combination of two sound sensitive components that have frequency response that intersect at a frequency point near or at the half-power point.

Figure 20C:
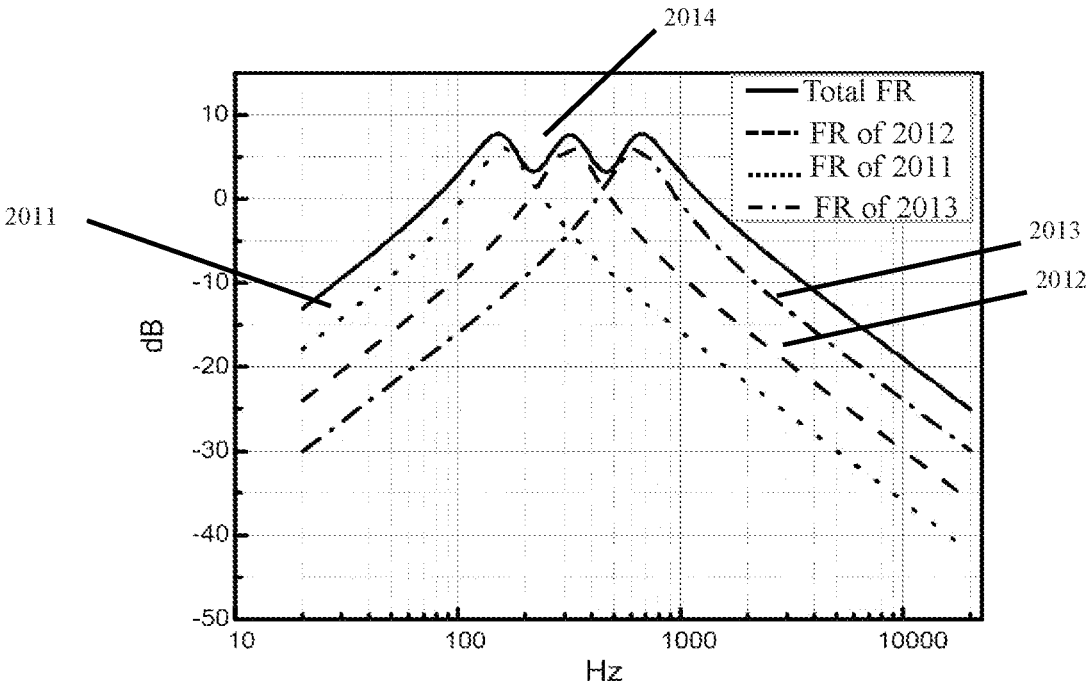
FIG. 20C illustrates exemplary frequency responses of different sound sensitive components according to some embodiments of the present disclosure.

FIG. 20C illustrates exemplary frequency responses of different sound sensitive components according to some embodiments of the present disclosure. As shown in FIG. 20C, the sound sensitive component 1720 may include a first sound sensitive component, a second sound sensitive component, and a third sound sensitive component, which are connected in parallel. The first sound sensitive component, the second sound sensitive component, and the third sound sensitive component may be underdamping sound sensitive components, and may be referred to as a first underdamping sound sensitive component, a second underdamping sound sensitive component, and a third underdamping sound sensitive component, respectively. The center frequency of each sound sensitive component may be different. For example, as shown in FIG. 20C, dotted line 2011, dashed line 2012, and dashed-dotted line 2013 represent the frequency responses of the first sound sensitive component, the second sound sensitive component, and the third sound sensitive component, respectively. Solid line 2014 may indicate the frequency response of the combination of the first sound sensitive component, the second sound sensitive component, and the third sound sensitive component. The bandwidth of the frequency response of the combination of the first sound sensitive component, the second sound sensitive component and the third sound sensitive component (i.e., solid line 2014) is wider and flatter than the frequency response of the first sound sensitive component (i.e., dotted line 2011, or referred to as a fourth frequency response), the frequency response of the second sound sensitive component (i.e., dashed line 2012, or referred to as a fifth frequency response), or the frequency response of the third sound sensitive component (i.e., dashed-dotted line 2013, or referred to as a sixth frequency response).

The center frequency of the second underdamping sound sensitive component (or referred to as a fifth center frequency) is higher than the center frequency of the first underdamping sound sensitive (or referred to as a fourth center frequency), and the center frequency of the third underdamping sound sensitive component (or referred to as a sixth center frequency) is higher than the center frequency of the second underdamping sound sensitive.

In some embodiments, the fourth frequency response and the fifth frequency response intersect at a point which is near a half-power point of the fourth frequency response and a half-power point of the fifth frequency response. That is, the fourth frequency response and the fifth frequency response intersect at a point with a power level no smaller than −5 dB and no larger than −1 dB.

As described in connection with FIG. 20B, when the frequency responses of the first sound sensitive component and the second sound sensitive component, and the third sound sensitive component may intersect at frequency points that are not near the half-power point, the frequency response of the combination of the first sound sensitive component and the second sound sensitive component, and the third sound sensitive component may be flatter and wider than that of a combination of three sound sensitive components that have frequency response that intersect at frequency points near or at the half-power point.

FIG. 21A is a schematic diagram of an exemplary mechanical model corresponding a sound sensitive component 1720 according to some embodiments of the present disclosure. The mechanical model corresponding to the sound sensitive component 1720 may include a plurality of sound sensitive components. The plurality of sound sensitive components may be connected in serial. For example, as illustrated in FIG. 21A, the sound sensitive component 1720 may include two sound sensitive components, each of which may include a diaphragm 2111, a damping component 2115, and an elastic component 2113. An audio signal (the sound pressure being P) may arrive at a diaphragm 2111, and cause the sound sensitive component 1720 to generate an electric signal (not shown). More detailed descriptions of an individual sound sensitive component may be found elsewhere in the present disclosure (e.g., FIGS. 19B and 19C, and the descriptions thereof).

Figure 21B:
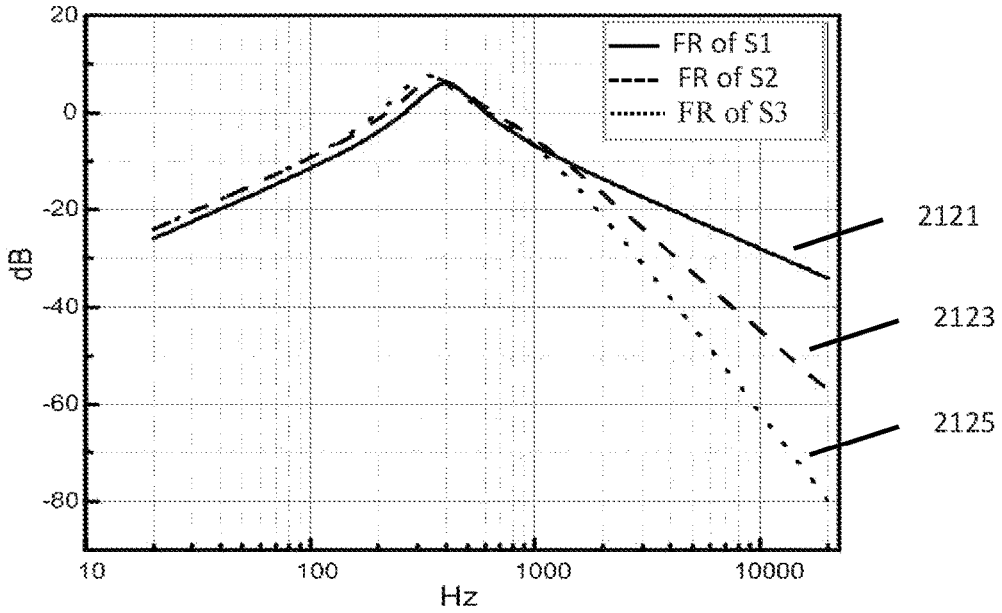
FIG. 21B illustrates exemplary frequency responses corresponding to different sound sensitive components according to some embodiments of the present disclosure.

FIG. 21B illustrates exemplary frequency responses corresponding to different sound sensitive components according to some embodiments of the present disclosure. Solid line 2121 represents the frequency response of one sound sensitive component. Dotted line 2123 represents the frequency response of a combination of two sound sensitive components connected in serial. Dashed line 2125 represents the frequency response of a combination of three sound sensitive components connected in serial. As illustrated by FIG. 21B, the number of sound sensitive components may affect the frequency response of the acoustic-transducing device in which they are arranged. The frequency response of the combination of three sound sensitive components connected in serial (i.e., dashed line 2125) may have a steeper edge than the frequency response of the combination of two sound sensitive components connected in serial (i.e., dashed line 2123). The frequency response of the combination of the two sound sensitive components connected in serial (i.e., dashed line 2123) may have a steeper edge than the frequency response of one sound sensitive component (i.e., solid line 2121). In some embodiments, when more sensitive components are arranged in a same acoustic-transducing device, the order of the acoustic-transducing device may increase.

In some embodiments, three sound sensitive components may be connected in series. As known to those skilled in the art, a sound sensitive component may have a lower cut-off frequency and an upper cut-off frequency. In some embodiments, the center frequency of any of the three sound sensitive components may be larger than the smallest cut-off frequency among the lower cut-off frequencies of the three sound sensitive components, and no larger than the largest cut-off frequency among the upper cut-off frequencies of the three sound sensitive components.

Figure 22A:
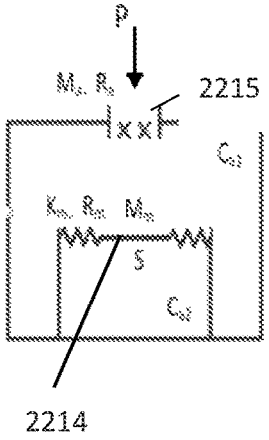
FIG. 22A illustrates a structure of a combination of an acoustic channel component and a sound sensitive component according to some embodiments of the present disclosure.

FIG. 22A illustrates a structure of a combination of an acoustic channel component and a sound sensitive component according to some embodiments of the present disclosure. The structure may be embodied as a diaphragm microphone with a front chamber and a rear chamber. As shown in FIG. 22A, an audio signal (the sound pressure being P) may first arrive at a sound hole 2215 of an acoustic channel component, which may include an acoustic resistance material, and then arrive at a diaphragm 2214 and a rear chamber of a sound sensitive component. P is the sound pressure on the microphone caused by an audio signal, and S is the effective area of the diaphragm. More detailed descriptions about the acoustic channel component may be found elsewhere in the present disclosure (e.g., FIGS. 18A and 18B and the descriptions thereof). More detailed descriptions about the sound sensitive component may be found elsewhere in the present disclosure (e.g., FIGS. 19A-19C and the descriptions thereof).

Figure 22B:
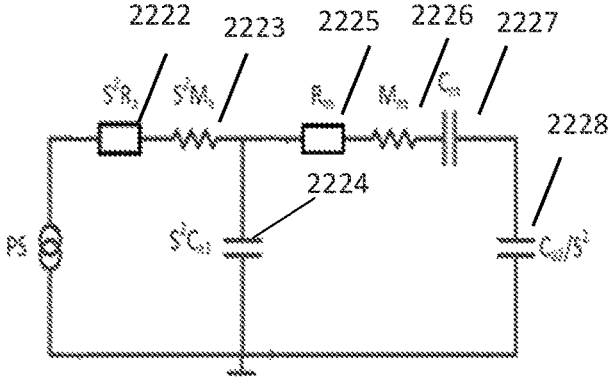
FIG. 22B is a schematic diagram of an exemplary equivalent circuit of the combination structure shown in FIG. 22A according to some embodiments of the present disclosure.
Figure 22C:
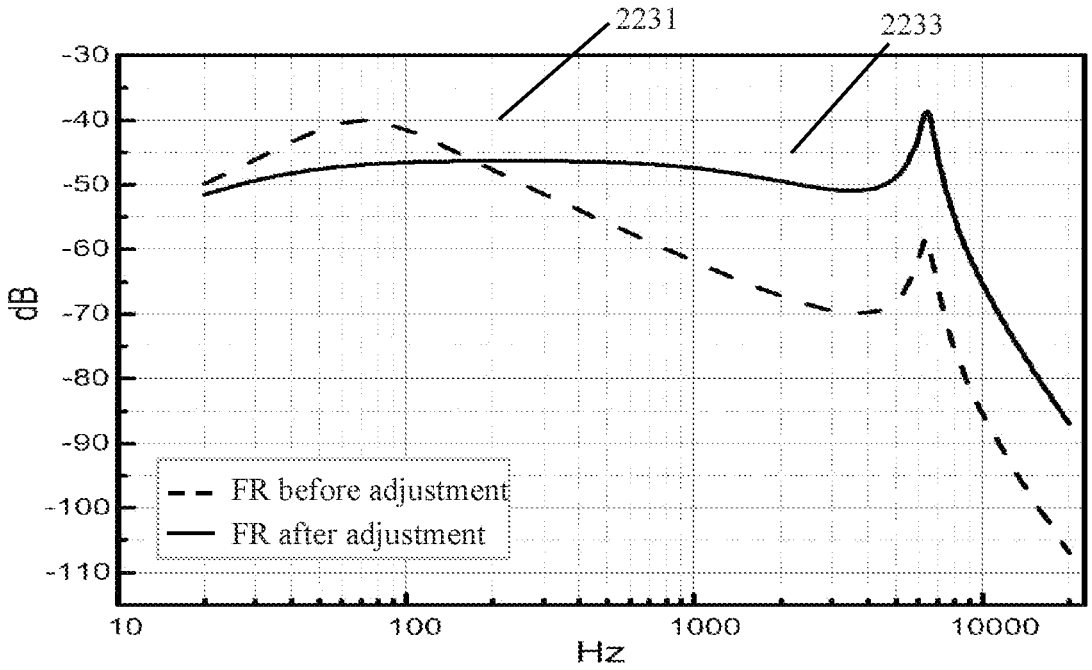
FIG. 22C illustrates exemplary frequency responses of two combination structures according to some embodiments of the present disclosure.
Figure 22D:
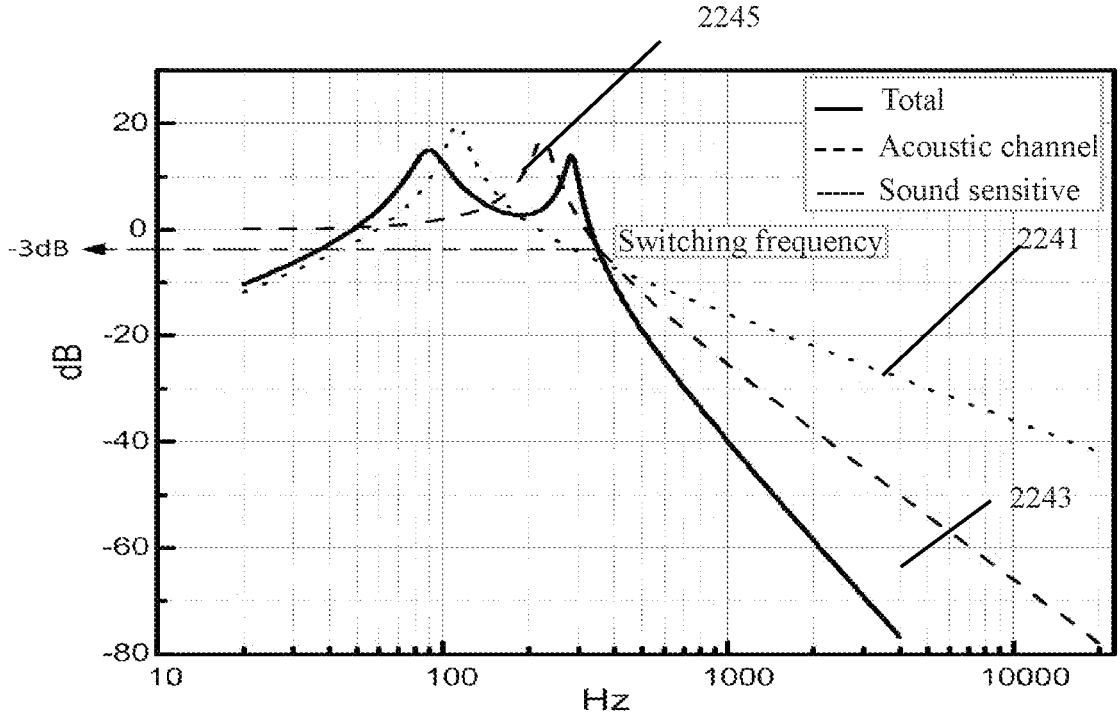
FIG. 22D illustrates an exemplary frequency response of a combination structure according to some embodiments of the present disclosure.

FIG. 22B is a schematic diagram of an exemplary circuit of the combination structure shown in FIG. 22A according to some embodiments of the present disclosure.

In the circuit, a resistor 2222 (with a resistance $S^2R_a$) and an inductor 2223 (with an inductance $S^2M_a$) may indicate the acoustic resistance and the acoustic mass of the sound hole. A capacitor 2224 (with a capacitance $S^2C_{a1}$) may indicate the acoustic capacitance of the front chamber. A capacitor 2228 (with a capacitance $C_{a2}/S^2$) may indicate the acoustic capacitance of the rear chamber. A resistor 2225 (with a resistance $R_m$), an inductor 2226 (with an inductance $M_m$), and a capacitor 2227 (with a capacitance $C_m$) may indicate the resistance of the diaphragm, the mass of the diaphragm, and the elasticity coefficient of the diaphragm, respectively.

FIGS. 23A-23C illustrates frequency responses of different acoustic-electric transducing modules according to some embodiments of the present disclosure. FIG. 23A, FIG. 23B, FIG. 23C illustrate the frequency response of a first acoustic-electric transducing module, a second acoustic-electric transducing module, and a third acoustic-electric transducing module, respectively. Each of the first acoustic-electric transducing module, the second acoustic-electric transducing module, and the third acoustic-electric transducing module may include three acoustic-electric transducers. As illustrated in FIG. 23A, the first acoustic-electric transducing module may include a transducer 1, a transducer 2, and a transducer 3. The frequency response of the transducer 1 intersects with the frequency response of the transducer 2 at a frequency point that is not near the half-power point, and the frequency response of the transducer 2 intersects with the frequency response of the transducer 3 at a frequency point that is not near the half-power point. As illustrated in FIG. 23B, the first acoustic-electric transducing module may include a transducer 4 (e.g., the first acoustic-electric transducer), a transducer 5 (e.g., the second acoustic-electric transducer), and a transducer 6 (e.g., the third acoustic-electric transducer). The transducer 4 has a first frequency bandwidth, and the transducer 5 has a second frequency bandwidth different from the first frequency bandwidth. The second frequency bandwidth is larger than the first frequency bandwidth, and the center frequency of the transducer 5 is higher than the center frequency of the transducer 4. The center frequency of the transducer 6 is higher than the center frequency of the transducer 5.

The frequency response of the transducer 4 intersects with the frequency response of the transducer 5 at a frequency point near the half-power point, and the frequency response of the transducer 5 intersects with the frequency response of the transducer 6 at a frequency point near the half-power point. For example, the frequency response of the transducer 4 and the frequency response of the transducer 5 intersect at a point which is near a half-power point of the frequency response of the transducer 4 and a half-power point of the frequency response of the transducer 5. As illustrated, the frequency response of the transducer 4 and the frequency response of the transducer 5 intersect at a point with a power level no smaller than −5 dB and no larger than −1 dB.

As illustrated in FIG. 23C, the first acoustic-electric transducing module may include a transducer 7, a transducer 8, and a transducer 9. The frequency response of the transducer 7 intersects with the frequency response of the transducer 8 at a frequency point not near the half-power point, and the frequency response of the transducer 8 intersects with the frequency response of the transducer 9 at a frequency point not near the half-power point. As illustrated by FIGS. 23A-23C, the frequency response of the second acoustic-electric transducing module may be flatter than the frequency response of the first acoustic-electric transducing module, and the frequency response of the third acoustic-electric transducing module indicate more interferences from adjacent channels than the frequency response of the second acoustic-electric transducing module. Descriptions illustrated below may be provided to illustrate the relationship between the frequency response of an acoustic-electric transducing module and where the acoustic-electric transducers in the acoustic-electric transducing module intersect with each other.

Frequency responses of the acoustic-electric transducers may intersect with each other at certain frequency points, resulting in a certain overlap range between the frequency responses. As used herein, an overlap range relates to the frequency point at which the frequency responses intersect with each other. The overlap of the frequency responses of acoustic-electric transducers may cause interferences in adjacent channels that are configured to output electric signals generated by the acoustic-electric transducers in the acoustic-electric transducing module 1510. In some cases, the larger overlap range, more interference may be. The center frequencies and bandwidths of the response frequencies of the acoustic-electric transducers may be adjusted to obtain a narrower overlap range among frequency responses of the acoustic-electric transducers.

For example, the acoustic-electric transducing module 1510 may include multiple first-order acoustic-electric transducers. The center frequency of each of the acoustic-electric transducers may be adjusted by adjusting structure parameters thereof, to achieve certain overlap ranges. The overlap range between two frequency responses of two adjacent acoustic-electric transducers may relate to the interference range between the sub-band signals output by the acoustic-electric transducers. In an ideal scenario, no overlap range between two frequency responses of two adjacent acoustic-electric transducers. In practice, however, a certain overlap range may exist between two frequency responses of two adjacent acoustic-electric transducers, which may affect the quality of the sub-band signals output by the two acoustic-electric transducers. If a relatively small overlap range between two frequency responses of two adjacent acoustic-electric transducers, the frequency response of a combination of the two adjacent acoustic-electric transducers may decrease within the overlap range. The decrease in the frequency response in a certain frequency band may indicate the decrease of power level in the frequency band. As used herein, the overlap range between two frequency responses may be deemed relatively small when the frequency responses intersect at a frequency point with a power level smaller than −5 dB. If a relatively large overlap band exists between two frequency responses of two adjacent acoustic-electric transducers, the frequency response of a combination of the two adjacent acoustic-electric transducers may increase within the overlap range. The increase in the frequency response in a certain frequency band may indicate a higher power level in the frequency band compared with that in other frequency ranges. The overlap range between two frequency responses may be deemed relatively small when the frequency responses intersect at a frequency point with a power level larger than −1 dB. When the frequency responses of two adjacent acoustic-electric transducers intersect near or at half-power point, the frequency response of each acoustic-electric transducer may contribute to the frequency response of a combination of the two adjacent acoustic-electric transducers in a such a manner that there is no loss nor repetition of energies in certain frequency bands, which may result in a proper overlap band between the frequency responses of two adjacent acoustic-electric transducers. The frequency responses of two adjacent acoustic-electric transducers may be deemed to intersect near or at half-power point when the frequency responses intersect at a frequency point with a power level no smaller than −5 dB and no larger than −1 dB. In some embodiments, via adjusting structure parameters of at least one acoustic-electric transducer of the two adjacent acoustic-electric transducers, the center frequency and the frequency bandwidth of the at least one acoustic-electric transducer of the two adjacent acoustic-electric transducers may be adjusted, resulting in adjusted overlap regions among the acoustic-electric transducers accordingly.

Figure 25:
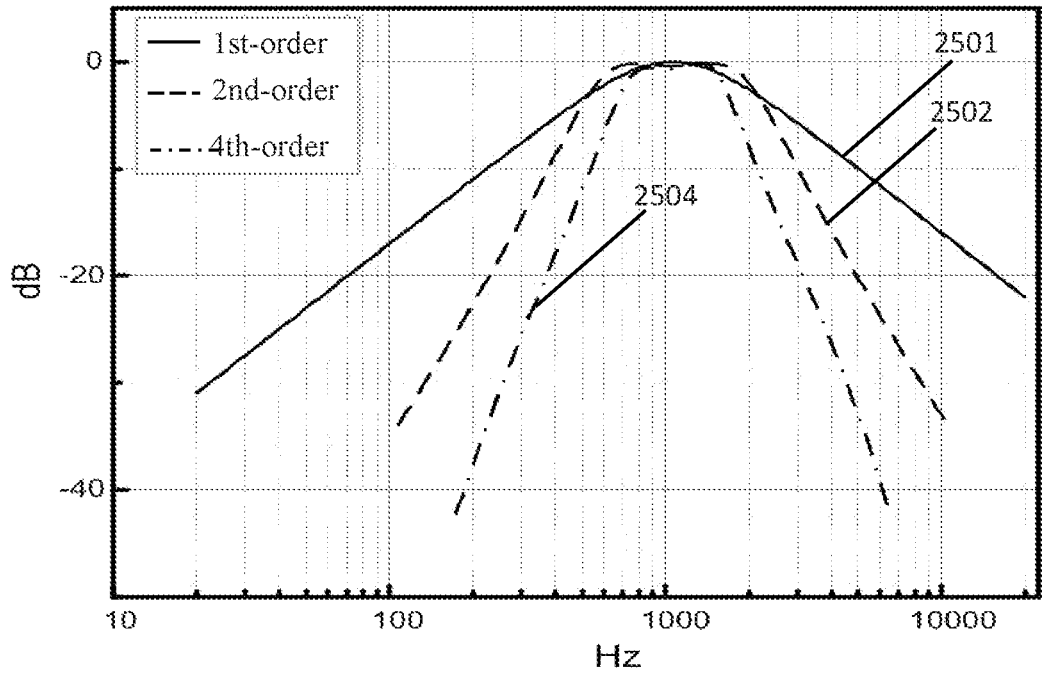
FIG. 25 illustrates the frequency responses of acoustic-electric transducers of different orders according to some embodiments of the present disclosure.

FIG. 25 illustrates the frequency responses of acoustic-electric transducers of different orders according to some embodiments of the present disclosure. The acoustic-electric transducing module 1510 includes a plurality of acoustic-electric transducers. The frequency responses of the acoustic-electric transducers may overlap, introducing interference between adjacent signal processing channels in the acoustic-electric transducing module 1510. As illustrated in FIG. 25, sold line 2501 represents the frequency response of a first-order acoustic-electric transducer, dotted line 1202 represents the frequency response of a second-order acoustic-electric transducer, while dashed-dotted line 2504 represents the frequency response of a fourth-order acoustic-electric transducer. The bandpass edge of the frequency response of the fourth-order acoustic-electric transducer (i.e., dashed-dotted line 2504) may be steeper than that of the second-order acoustic-electric transducer (i.e., dotted line 2502). The bandpass edge of the frequency response of the second-order acoustic-electric transducer (i.e., dotted line 2502) may be steeper than that of the first-order acoustic-electric transducer (i.e., sold line 2501). In some embodiments, the higher order of an acoustic-electric transducer, the greater the slope of the bandpass edge of the acoustic-electric transducer may be. According to the theoretical analysis, the slope of the bandpass edge of a first-order acoustic-electric transducer may be 6 dB/oct, and when the order of an acoustic-electric transducer increased by every 1 order, the slope of the bandpass edge may increase by 6 dB/oct. Thus, employing multi-order acoustic-electric transducer in acoustic-electric transducer module 1510 may allow more acoustic-electric transducer to be included therein, which is usually desirable to ensure a wider coverage of the frequency band of an audio signal detected.

In some embodiments, the acoustic-electric transducers in the acoustic-electric transducing module 1510 may be underdamping bandpass acoustic-electric transducers. In some embodiments, an underdamping bandpass acoustic-electric transducer may have a steeper slope than a non-underdamping bandpass acoustic-electric transducer, near the resonance peak in the frequency response of the acoustic-electric transducer. In some embodiments, the maximum number of acoustic-electric transducers allowed in a certain frequency band may be determined according to the filtering characteristics of the bandpass acoustic-electric transducers. For example, given that the frequency responses of the acoustic-electric transducers intersect with each other at half-power points, for a certain frequency range, the maximum number of the acoustic-electric transducers of certain order that may be allowed to be included in one acoustic-electric transducing module 1510 may be shown in table 1:

TABLE 1

| The numbers of acoustic-electric transducers to be included | | | |
|---|---|---|---|
| | Frequency band | | |
| Order | 20 Hz-20 kHz | 100 Hz-8 kHz | 300 Hz-4000 Hz |
| 1 | 10 | 7 | 4 |
| 2 | 20 | 13 | 8 |
| 3 | 30 | 19 | 12 |
| 4 | 40 | 26 | 15 |

For example, for the frequency band 20 Hz-20 kHz, an acoustic-electric transducing module 1510 may include no more than 10 first-order acoustic-electric transducers. In some embodiments, via adjusting of one or more acoustic-electric transducers in an acoustic-electric transducing module 1510 to an under-damped state, the acoustic-electric transducing module 1510 may have a larger order. It is to be expressly understood, however, that Table 1 is for the purpose of illustration and description only and are not intended to limit the scope of the present disclosure. In some embodiments, various alterations, improvements, and modifications may occur and are intended to those skilled in the art, though not expressly stated herein. These alterations, improvements, and modifications are intended to be suggested by this disclosure and are within the spirit and scope of the exemplary embodiments of this disclosure. In some embodiments, the acoustic-electric transducing module 1510 may include a plurality of first acoustic-electric transducers. In some embodiments, the acoustic-electric transducing module 1510 includes no more than 10 first-order acoustic-electric transducers, wherein each first-order acoustic-electric transducer corresponds to a frequency band whose width is no larger than 20 kHz. In some embodiments, the acoustic-electric transducing module 1510 includes no more than 20 second-order acoustic-electric transducers, wherein each second-order acoustic-electric transducer corresponds to a frequency band whose width is no larger than 20 kHz. In some embodiments, the acoustic-electric transducing module 1510 includes no more than 30 third-order acoustic-electric transducers, wherein each third-order acoustic-electric transducer corresponds to a frequency band whose width is no larger than 20 kHz. In some embodiments, the acoustic-electric transducing module 1510 includes no more than 40 fourth-order acoustic-electric transducers, wherein each fourth-order acoustic-electric transducer corresponds to a frequency band whose width is no larger than 20 kHz. In some embodiments, the acoustic-electric transducing module 1510 includes no more than 8 first-order acoustic-electric transducers, wherein each first-order acoustic-electric transducer corresponds to a frequency band whose width is no larger than 8 kHz. In some embodiments, the acoustic-electric transducing module 1510 includes no more than 13 second-order acoustic-electric transducers, wherein each second-order acoustic-electric transducer corresponds to a frequency band whose width is no larger than 8 kHz. In some embodiments, the acoustic-electric transducing module 1510 includes no more than 19 third-order acoustic-electric transducers, wherein each third-order acoustic-electric transducer corresponds to a frequency band whose width is no larger than 8 kHz. In some embodiments, the acoustic-electric transducing module 1510 includes no more than 26 fourth-order acoustic-electric transducers, wherein each fourth-order acoustic-electric transducer corresponds to a frequency band whose width is no larger than 8 kHz. In some embodiments, the acoustic-electric transducing module 1510 includes no more than 4 first-order acoustic-electric transducers, wherein each first-order acoustic-electric transducer corresponds to a frequency band whose width is no larger than 4 kHz. In some embodiments, the acoustic-electric transducing module 1510 includes no more than 8 second-order acoustic-electric transducers, wherein each second-order acoustic-electric transducer corresponds to a frequency band whose width is no larger than 4 kHz. In some embodiments, the acoustic-electric transducing module 1510 includes no more than 12 third-order acoustic-electric transducers, wherein each third-order acoustic-electric transducer corresponds to a frequency band whose width is no larger than 4 kHz. In some embodiments, the acoustic-electric transducing module 1510 includes no more than 15 fourth-order acoustic-electric transducers, wherein each fourth-order acoustic-electric transducer corresponds to a frequency band whose width is no larger than 4 kHz.

FIGS. 26A and 26B illustrate the frequency responses of exemplary acoustic-electric transducing modules according to some embodiments of the present disclosure. FIG. 26A illustrates the frequency response of a first-order bandpass acoustic-electric transducing module (referred to as first-order bandpass acoustic-electric transducing module 1). FIG. 26B illustrates frequency responses of a first-order bandpass acoustic-electric transducing module (referred to as first-order bandpass acoustic-electric transducing module 2). The acoustic-electric transducer(s) in the first-order bandpass acoustic-electric transducing module 1 are non-underdamping acoustic-electric transducers, while the acoustic-electric transducer(s) in the first-order bandpass acoustic-electric transducing module 1 are underdamping acoustic-electric transducers. As can be seen from FIG. 26A and FIG. 26B, more acoustic-electric transducers may be included in an acoustic-electric transducing module when the acoustic-electric transducers are underdamping ones rather than non-underdamping ones. The first-order bandpass acoustic-electric transducing module 1 and the first-order bandpass acoustic-electric transducing module 2 includes 4 first-order bandpass acoustic-electric transducers and 6 first-order bandpass acoustic-electric transducers, respectively. The solid line in FIG. 26A represents the frequency response of the first-order bandpass acoustic-electric transducing module 1. The 4 dotted lines in FIG. 26A represent the frequency responses of the 4 acoustic-electric transducers respectively. The solid line in FIG. 26B represents the frequency response of the first-order bandpass acoustic-electric transducing module 2. The 6 dotted lines in FIG. 26B represent the frequency responses of the 6 acoustic-electric transducers respectively.

In some embodiments, the acoustic-electric transducing module may be regarded as a filter configured to achieve a designated filtering effect. In some embodiments, the filter may be a first-order filter or a multi-order filter. In some embodiments, the filter may be a linear or non-linear filter. In some embodiments, the filter may be a time-varying or non-time-varying filter. The filter may include a resonance filter, a Roex function filter, a Gammatone filter, a Gammachirp filter, etc.

In some embodiments, acoustic-electric transducing module may be a Gammatone filter. Specifically, bandwidths of the frequency responses of acoustic-electric transducers in the acoustic-electric transducing module may be different. Further, the acoustic-electric transducer having a higher center frequency may be set to have a larger bandwidth. Further, in some embodiments, the center frequency $f_c$ of an acoustic-electric transducer may be determined according to Equation (21) as follows:

$$f_c = (f_H + 228.7)\exp\left(-\frac{\alpha}{9.26}\right) - 228.7, \tag{21}$$

where $f_H$ refers to the cutoff frequency, and a refers to the overlap factor.

The bandwidth B of the acoustic-electric transducer may be set according to Equation (22) as follows:

$$B = 24.7 \times \left(4.37 \times \frac{f_c}{1000} + 1\right). \tag{22}$$

Figure 27A:
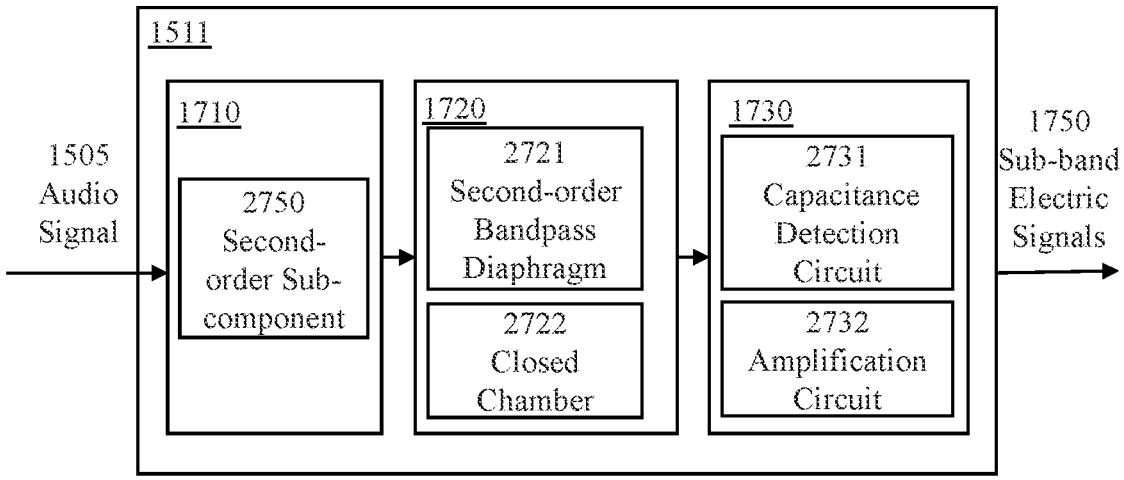
FIG. 27A is a schematic diagram of an exemplary acoustic-electric transducer according to some embodiments of the present disclosure.

FIG. 27A is a schematic diagram of an exemplary acoustic-electric transducer 1511 according to some embodiments of the present disclosure. The acoustic-electric transducer 1511 may include an acoustic channel component 1710, a sound sensitive component 1720, and a circuit component 1730.

The acoustic channel component 1710 may include a second-order component 2750. The sound sensitive component 1720 may include a second-order bandpass diaphragm 2721, and a closed chamber 2722. The circuit component 1730 may include a capacitance detection circuit 2731, and an amplification circuit 2732.

The acoustic-electric transducer 1511 may be an air-conduction acoustic-electric transducer with two cavities. A diaphragm of the second-order bandpass diaphragm 2721 may be used to convert a change of sound pressure caused by an audio signal on the diaphragm surface into a mechanical vibration of the diaphragm. The capacitance detection circuit 2731 may be used to detect the change of a capacitance between the diaphragm and a plate caused by the vibration of the diaphragm. The amplification circuit 2732 may be used to adjust the amplitude of the output voltage. A sound hole may be provided in a first chamber, and the sound hole may be provided with an acoustic resistance material as needed. A second chamber may be closed. The acoustic impedance of the sound hole and the surrounding air may be inductive. The resistive material may have acoustic impedance. The first chamber may have capacitive acoustic impedance. The second chamber may have capacitive acoustic impedance. As used herein, the first chamber may also be referred to as a front chamber, and the second chamber may be referred to as a rear chamber.

Figure 27B:
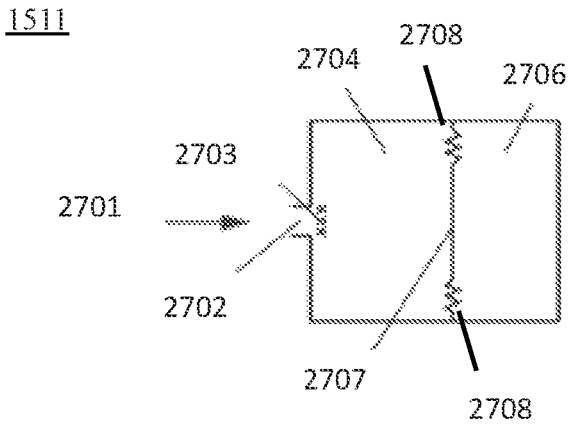
FIG. 27B is a schematic diagram of an exemplary acoustic force generator of the acoustic-electric transducer shown in FIG. 27A according to some embodiments of the present disclosure.

FIG. 27B is a schematic diagram of an exemplary acoustic force generator of the acoustic-electric transducer shown in FIG. 27A according to some embodiments of the present disclosure.

The acoustic force generator may detect an audio signal 2701, and may include a first chamber 1404 and a second chamber 2706. The first chamber 1404 may include a sound hole 2702 and a sound resistance material 2703 embedded in the sound hole 2702. The first chamber 2704 and the second chamber 2706 may be separated by a diaphragm 2707. The diaphragm 2707 may connect an elastic component 2708.

Figure 27C:
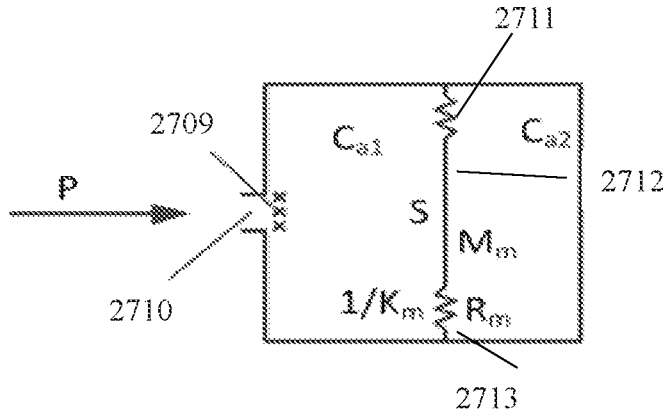
FIG. 27C is a schematic diagram of an exemplary structure of the acoustic force generator shown in FIG. 27B according to some embodiments of the present disclosure.

FIG. 27C is a schematic diagram of an exemplary structure of the acoustic force generator shown in FIG. 27B according to some embodiments of the present disclosure. As shown in FIG. 27C, sound pressure P may pass through an acoustic resistance material 2709 embedded in a sound hole 2710. The sound pressure P may be converted into a vibration of a diaphragm 2712. Prefers to the sound pressure arriving at the microphone, $R_{a1}$ refers to the sound resistance of the acoustic material 2709, $M_{a1}$ refers to the mass near the sound hole 2710, $C_{a1}$ refers to the sound capacity of the first chamber, S is an effective area of the diaphragm 2712, $R_m$ refers to damping of the diaphragm 2712, $M_m$ refers to the mass of the diaphragm 2712, $K_m$ refers to the elastic modulus of the diaphragm 2712, and $C_{a2}$ refers to the sound capacity of the first chamber.

Figure 27D:
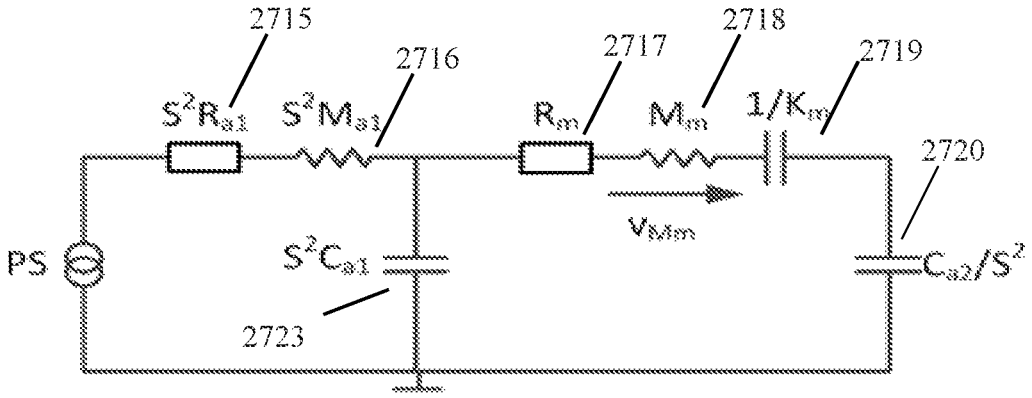
FIG. 27D is a schematic diagram of an equivalent circuit of the structure shown in FIG. 27C according to some embodiments of the present disclosure.

FIG. 27D is a schematic diagram of an exemplary circuit of the structure shown in FIG. 27B and FIG. 27C according to some embodiments of the present disclosure. In the circuit, a resistor 2715 (with a resistance $S^2R_a$) and an inductor 2716 (with an inductance $S^2M_a$) may indicate the acoustic resistance and the acoustic mass of the sound hole 2710. A capacitor 2723 (with a capacitance $S^2C_{a1}$) may indicate the acoustic capacitance of the first chamber 2704. A capacitor 2720 (with a capacitance $C_{a2}/S^2$) may indicate the acoustic capacitance of the second chamber 2706. A resistor 2717 (with a resistance $R_m$), an inductor 2718 (with an inductance $M_m$), and a capacitor 2719 (with a capacitance $C_m$) may indicate the resistance of the diaphragm 2707, the mass of the diaphragm 2707, and the elasticity coefficient of the diaphragm 2707, respectively.

In the circuit, circuit current corresponds to a vibration velocity of the diaphragm 2712. The vibration velocity $v_{Mm}$ may be determined according to Equation (23) as follows:

$$v_{Mm} = PS \cdot \frac{Z_2}{Z_1 + Z_2} \cdot \frac{1}{A} = P \cdot \frac{1}{(R_{a1} + j\omega M_{a1})(j\omega C_{a1} \cdot A + 1) + A}, \tag{23}$$

where ω refers to the angular frequency of the acoustic structure (e.g., the acoustic force structure illustrated in FIG. 27C), j refers to an unit imaginary number, $Z_1$ refers to the acoustic impedance of the resistor 2715 and the inductor 2716, $Z_2$ refers to the acoustic impedance of the resistor 2717, the inductor 2718, the capacitor 2719, and the capacitor 2720, the descriptions of P, S, $R_{a1}$, $M_{a1}$, and $C_{a1}$ may be found in FIG. 27C and descriptions thereof, and A may be determined according to Equation (24) as follows:

$$A = R_m + j\omega M_m + \frac{K_m + \frac{1}{C_{a2}}}{j\omega}, \tag{24}$$

where ω refers to the angular frequency of the acoustic structure (e.g., the acoustic force structure illustrated in FIG. 27C), j refers to a unit imaginary number, and the descriptions of $R_m$, $M_m$, $K_m$, and $C_{a2}$ may be found in FIG. 27C and descriptions thereof.

Further, a capacitance change output by the system is related to a distance between the diaphragm and the plate, and the distance between the diaphragm and the plate is related to deformation of the diaphragm (displacement of the diaphragm). Therefore, the displacement of the diaphragm may be determined according to Equation (25) as follows:

$$\begin{aligned} S_{Mm}(t) &= \int v_{Mm}(t)dt \\ &= \frac{1}{(R_{a1} + j\omega M_{a1})(j\omega C_{a1} \cdot A + 1) + A} \cdot e^{j\omega t} dt \\ &= PSe^{j\omega t} \cdot \frac{1}{j\omega} \cdot \frac{1}{(R_{a1} + j\omega M_{a1})(j\omega C_{a1} \cdot A + 1) + A}, \end{aligned} \tag{25}$$

wherein the descriptions of P, S, $R_{a1}$, $M_{a1}$, and $C_{a1}$ may be found in FIG. 27C and descriptions thereof.

A transfer function of the system may be determined according to Equation (26) as follows:

$$\frac{S_{Mm}}{PSe^{j\omega t}} = \frac{1}{j\omega} \cdot \frac{1}{(R_{a1} + j\omega M_{a1})(j\omega C_{a1} \cdot A + 1) + A}, \tag{26}$$

where ω refers to the angular frequency of the acoustic structure (e.g., the acoustic force structure illustrated in FIG. 27C), j refers to a unit imaginary number, and the descriptions of $R_{a1}$, $M_{a1}$, and $C_{a1}$ may be found in FIG. 27C and descriptions thereof.

By performing a Laplace transform, the transfer function may be expressed as follows:

$$G(s) = \frac{1}{a_4 s^4 + a_3 s^3 + a_2 s^2 + a_1 s + a_0}, \tag{27}$$

$$a_0 = K_m + \frac{S^2}{C_{a2}}, \tag{28}$$

$$a_1 = R_m + S^4 R_{a1} K_m C_{a1} + \frac{S^6 R_{a1} C_{a1}}{C_{a2}} + S^2 R_{a1}, \tag{29}$$

$$a_2 = M_m + S^4 R_{a1} R_m C_{a1} + S^4 M_{a1} K_m C_{a1} + \frac{S^6 M_{a1} C_{a1}}{C_{a2}} + S^2, \tag{30}$$

$$a_3 = S^4 M_m R_{a1} C_{a1} + S^4 M_{a1} R_m C_{a1}, \tag{31}$$

$$a_4 = S^4 M_{a1} M_m C_{a1}. \tag{32}$$

As a result, a combination of the first chamber corporate with a sound hole may function as a multi-order bandpass filter (e.g., a second-order bandpass filter), and a combination of the second chamber, which a closed-chamber and the diaphragm may function as a second-order bandpass filter. The diaphragm, which may function as an acoustic-sensitive element, may convert the audio signal into a change of a capacitance between the diaphragm and the plate. In some embodiments, a fourth-order system may be formed by combining the acoustic channel component and the acoustic-sensitive component.

An acoustic-electric transducer constructed in accordance with the above-described configuration may function as a bandpass filter. A plurality of the acoustic-electric transducers with different filtering characteristics may be set in the acoustic-electric transducing module 1510 to form a filter group, which may generate a plurality of sub-band signals according to the audio signal. In some embodiments, the acoustic-electric transducer may be adjusted to a non-underdamping state through adjustment of damping of the acoustic resistance material and the diaphragm of the acoustic-electric transducer. A frequency bandwidth of each acoustic-electric transducer may be set to increase as a center frequency increases.

Figure 28:
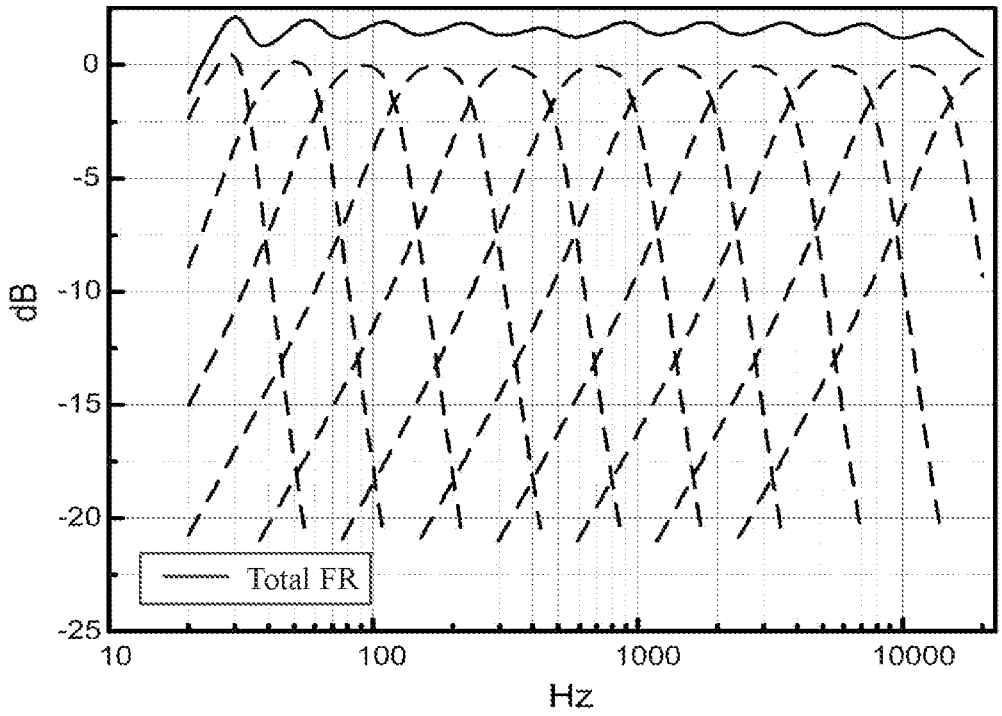
FIG. 28 illustrates an exemplary frequency response of an acoustic-electric transducing module according to some embodiments of the present disclosure.

FIG. 28 illustrates an exemplary frequency response of an acoustic-electric transducing module according to some embodiments of the present disclosure. The acoustic-electric transducing module may include 11 acoustic-electric transducers. 11 dotted lines in FIG. 28 represent the frequency responses of the individual 11 acoustic-electric transducers. The solid line in FIG. 28 may indicate the frequency response of the acoustic-electric transducing module. As illustrated above, multiple acoustic-electric transducers, each of which may function as a bandpass filter for an audio signal, may be arranged in the same acoustic-electric transducing module, and generate sub-band signals according to an audio signal. As shown in FIG. 28, frequency responses of the eleven acoustic-electric transducers may cover the audible frequency band of the human ear 20 Hz-20 kHz, only the frequency band 20 Hz-10 kHz is shown in FIG. 28. The frequency responses of the 11 acoustic-electric transducers may intersect at frequency points with energies that range from −1 dB to −5 dB, and the frequency response of the acoustic-electric transducing module may have a power level fluctuation within 1 dB.

Figure 29A:
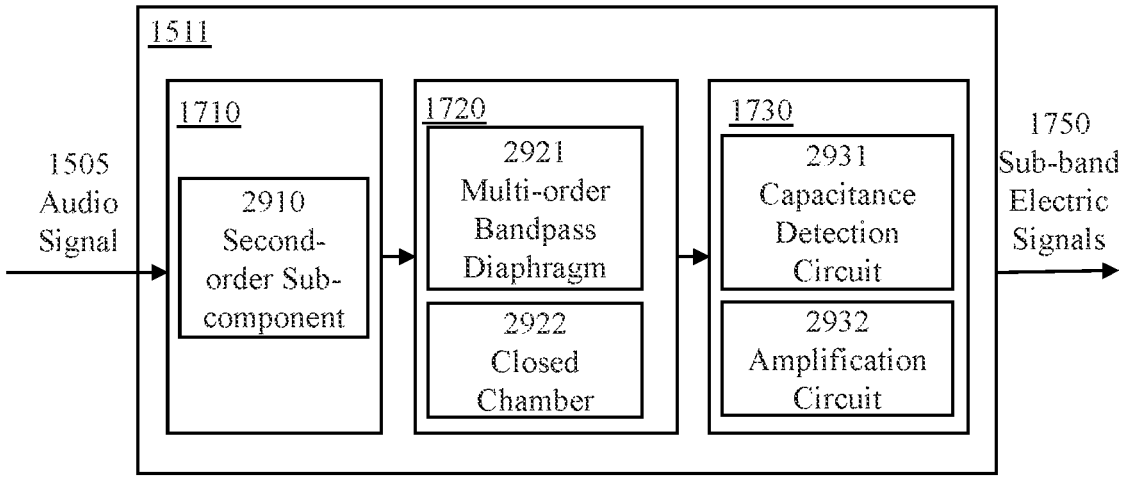
FIG. 29A is a schematic diagram of an exemplary acoustic-electric transducer according to some embodiments of the present disclosure.

FIG. 29A is a schematic diagram of an exemplary acoustic-electric transducer 1511 according to some embodiments of the present disclosure. The acoustic-electric transducer 1511 may include an acoustic channel component 1710, a sound sensitive component 1720, and a circuit component 1730. The acoustic channel component 1710 may include a second-order component 2910. The sound sensitive component 1720 may be a multi-order bandpass diaphragm 2921, and a closed chamber 2922. The circuit component 1730 may include a capacitance detection circuit 2931, and an amplification circuit 2932.

The acoustic-electric transducer 1511 may be an air-conduction acoustic-electric transducer with two cavities. A diaphragm of the multi-order bandpass diaphragm 2921 may be used to convert sound pressure change caused by an audio signal 1505 on the diaphragm surface into a mechanical vibration of the diaphragm. The capacitance detection circuit 2931 may be used to detect a change of a capacitance between the diaphragm and a plate caused by the vibration of the diaphragm. The amplification circuit 2932 may be used to adjust an output voltage to a suitable amplitude. A sound hole may be provided in a first chamber, and the sound hole may be provided with an acoustic resistance material as required. A second chamber may be closed.

Figure 29B:
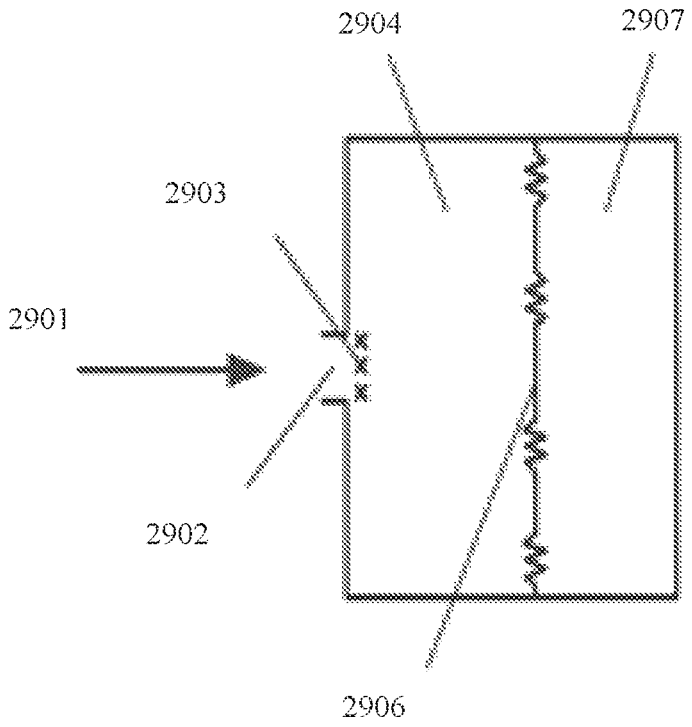
FIG. 29B is a schematic diagram of an exemplary acoustic force generator of the acoustic-electric transducer shown in FIG. 29A according to some embodiments of the present disclosure.

FIG. 29B is a schematic diagram of an exemplary acoustic force generator of the acoustic-electric transducer shown in FIG. 29A according to some embodiments of the present disclosure.

As described in connection with FIG. 27A, the first chamber with the sound hole may function as a second-order bandpass filter. In some embodiments, the diaphragm is configured as a composed vibration system. A system including the diaphragm and the second chamber (or referred to as the closed chamber) may function as a high-order (larger than second-order) bandpass filter. In some embodiments, the acoustic-electric transducer illustrated in FIG. 29B may have a higher order than the acoustic-electric transducer illustrated in FIG. 27A.

Figure 30:
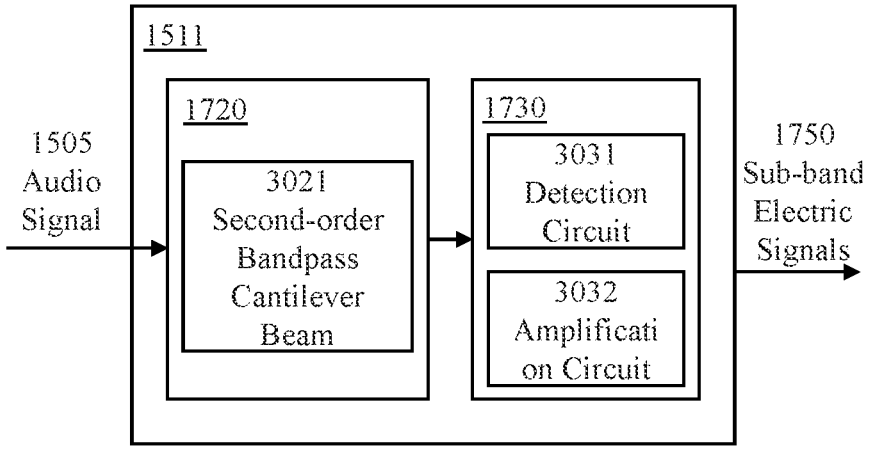
FIG. 30 is a schematic diagram of an exemplary acoustic-electric transducer according to some embodiments of the present disclosure.

FIG. 30 is a schematic diagram of an exemplary acoustic-electric transducer according to some embodiments of the present disclosure.

The acoustic-electric transducer 1511 may include a sound sensitive component 1720, and a circuit component 1730. The sound sensitive component 1720 may include a second-order bandpass cantilever 3021. The circuit component 1730 may include a detection circuit 3031, and an amplification circuit in 3032.

A cantilever may obtain audio signals transmitted to the cantilever, and cause changes of electric parameters of a cantilever material. The audio signal may include an air-conduction signal, a bone-conduction signal, a hydro audio signal, a mechanical vibration signal, or the like, or a combination thereof. The cantilever material may include a piezoelectric material. The piezoelectric material may include a piezoelectric ceramic or piezoelectric polymers. The piezoelectric ceramic may include PZT. The detection circuit 3031 may detect changes of electric signals of the cantilever material. The amplification circuit 3032 may adjust the amplitudes of the electric signals.

According to a circuit corresponding to the cantilever (which is similar to the circuit corresponding to the diaphragm in FIG. 19C), an impedance of the cantilever may be determined according to Equation (33) as follows:

$$Z = R + j\left(\omega M - \frac{K}{\omega}\right), \tag{33}$$

where Z refers to the impedance of the cantilever, ω refers to the angular frequency of the acoustic structure (e.g., the cantilever), j refers to a unit imaginary number, R refers to damping of the cantilever, M refers to the mass of the cantilever, and K refers to then elasticity coefficient of the cantilever.

In some embodiments, the cantilever may function as a second-order system, and an angular frequency may be determined according to Equation (31) as follows:

$$\omega_0 = \sqrt{\frac{K}{M}}, \tag{34}$$

where $\omega_0$ refers to the angular frequency, M refers to the mass of the cantilever, and K refers to then elasticity coefficient of the cantilever.

Cantilever vibration may have a resonant peak at its angular frequency. Thus, the audio signal may be filtered using the cantilever. Further, when a filter bandwidth is calculated at a half-power point, corresponding cutoff frequencies may be determined according to Equation (35) and Equation (36) as follows:

$$\omega_1 = \frac{\sqrt{R^2 + 4MK} - R}{2M}, \tag{35}$$

$$\omega_2 = \frac{\sqrt{R^2 + 4MK} \mp R}{2M}, \tag{36}$$

where R refers to damping of the cantilever, M refers to the mass of the cantilever, and K refers to then elasticity coefficient of the cantilever.

A quality factor of the cantilever filtering (referred as Q below) may be determined according to Equation (37) as follows:

$$Q = \frac{\omega_0}{\omega_2 - \omega_1} = \frac{\sqrt{MK}}{R}, \tag{37}$$

where R refers to damping of the cantilever, M refers to the mass of the cantilever, and K refers to then elasticity coefficient of the cantilever.

It can be seen that, after the angular frequency (center frequency) of the cantilever filter is determined, the quality factor Q of the cantilever filtering may be changed by adjusting the damping R. The smaller the damping R is, the larger the quality factor R is, the narrower the filter bandwidth is, and the sharper a filter frequency response curve is.

Figure 31:
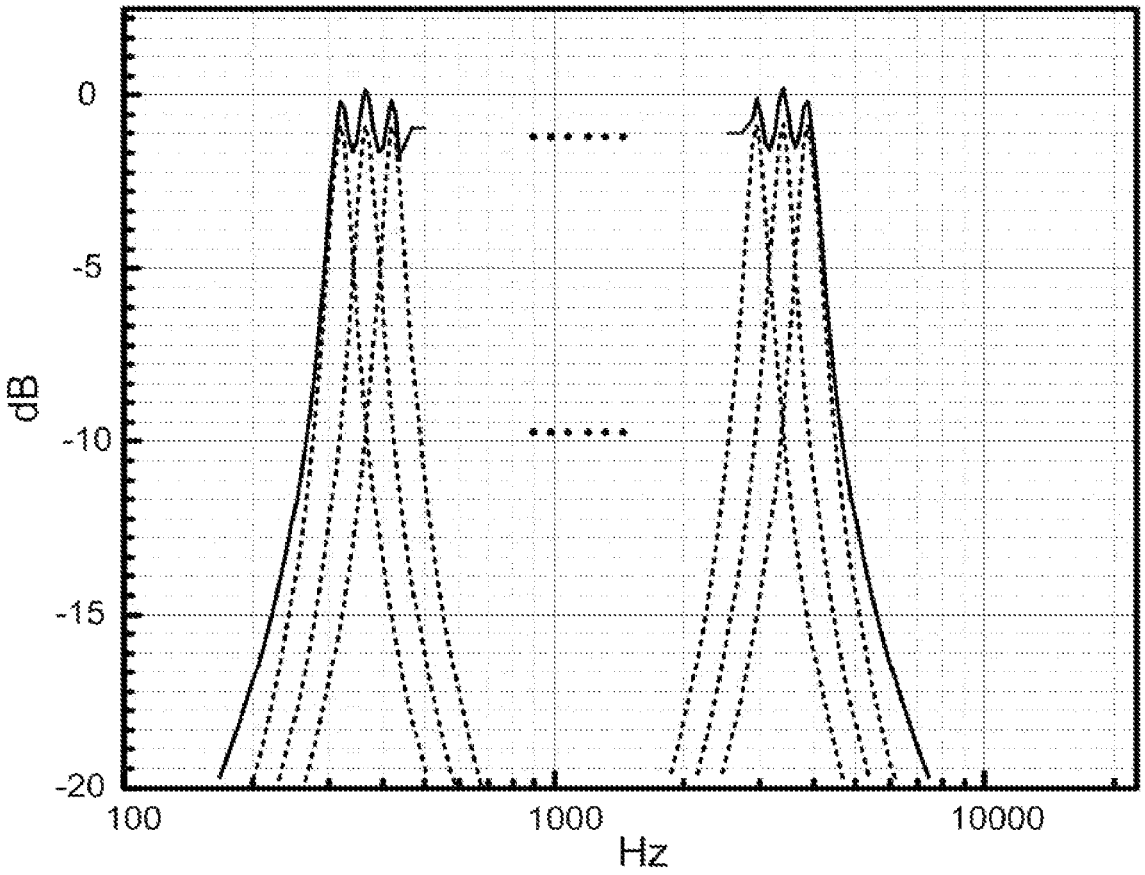
FIG. 31 illustrates an exemplary frequency response of an acoustic-electric transducing module according to some embodiments of the present disclosure.

FIG. 31 illustrates an exemplary frequency response of the acoustic-electric transducing module according to some embodiments of the present disclosure.

The acoustic-electric transducing module may include 19 acoustic-electric transducers. 19 dashed lines in FIG. 31 may represent the frequency responses of the 19 acoustic-electric transducers respectively. The solid line in FIG. 31 may indicate the frequency response of the acoustic-electric transducing module. As illustrated above, multiple acoustic-electric transducers, each of which may function as a bandpass filter for an audio signal, may be arranged in a same acoustic-electric transducing module, and generate sub-band signals according to an audio signal. As shown in FIG. 31, frequency responses of the 19 acoustic-electric transducers may cover a frequency band of 300 Hz-4000 Hz. The frequency response of the acoustic-electric transducing module may have a power level fluctuation within +1 dB.

Figure 32A:
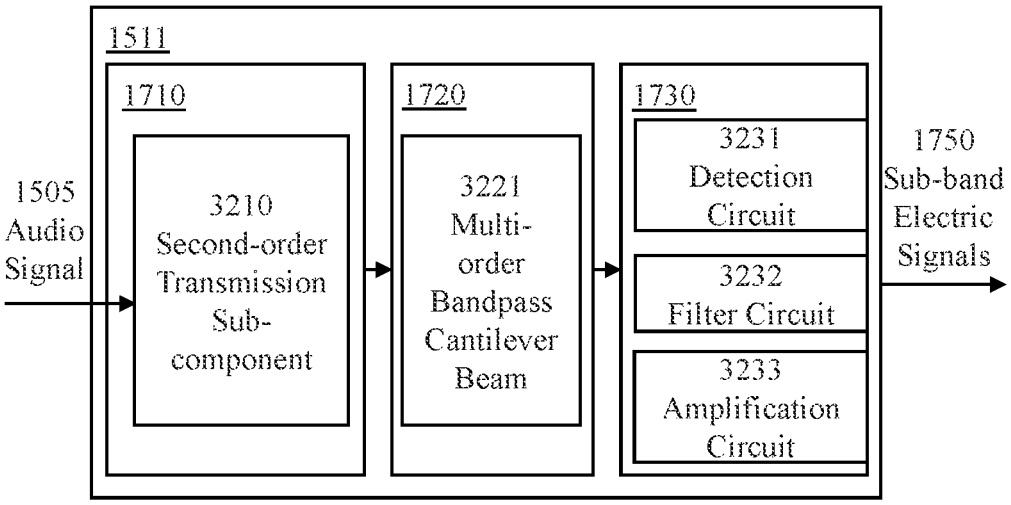
FIG. 32A is a schematic diagram of an exemplary acoustic-electric transducer according to some embodiments of the present disclosure.

FIG. 32A is a schematic diagram of an exemplary acoustic-electric transducer according to some embodiments of the present disclosure. The acoustic-electric transducer 1511 may include an acoustic channel component 1710, a sound sensitive component 1720, and a circuit component 1730. The acoustic channel component 1710 may include a second-order transmission sub-component 3210. The sound sensitive component 1720 may a multi-order bandpass cantilever 3221. The circuit component 1730 may include a detection circuit 3231, a filter circuit 3232, and an amplification circuit 3233.

A cantilever may obtain an audio signal, and cause changes of electric parameters of a cantilever material. The audio signal may include an air-conduction signal, a bone-conduction signal, a hydro audio signal, a mechanical vibration signal, etc. The cantilever material may include a piezoelectric material. The piezoelectric material may include a piezoelectric ceramic or piezoelectric polymers. The piezoelectric ceramic may include PZT. The detection circuit 3231 may detect changes of electric signals of the cantilever material. The amplification circuit 3233 may adjust the amplitude of the electric signals. In some embodiments, the suspension structure is connected with a base through an elastic member, and vibration of bone conduction audio signals acts on the suspension structure. The suspension structure and the corresponding elastic member may transmit the vibration to the cantilever and constitute an acoustic channel for transmitting the audio signal, which may function as a second-order bandpass filter. The cantilever attached to the suspension structure may also function as a second-order bandpass filter.

Figure 32B:
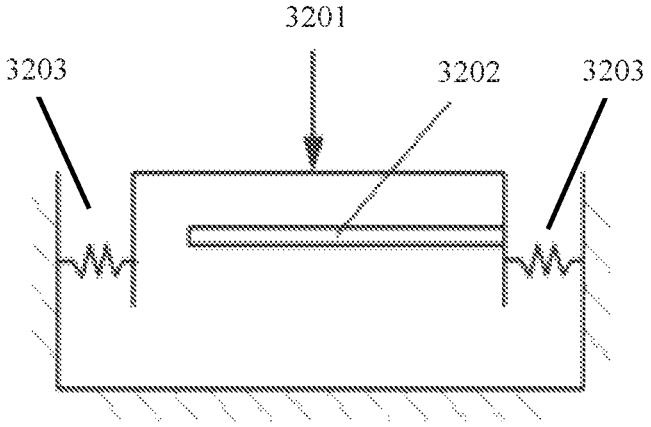
FIG. 32B is a schematic diagram of an exemplary cantilever according to some embodiments of the present disclosure.

FIG. 32B is a schematic diagram of an exemplary cantilever according to some embodiments of the present disclosure. As shown in FIG. 32B, a cantilever 3202 may connect to an elastic component 3203. An audio signal arriving at the elastic component (e.g., the elastic component 3203) may cause vibrations of the elastic component. The elastic component may transmit the vibrations to the cantilever 3202. The elastic component and the cantilever 3202 may be arranged in a same acoustic-electric transducing module 1510, which may function as a second-order bandpass filter. The cantilever can obtain an audio signal 3200 and cause changes in electric parameters of a cantilever material.

Figure 32C:
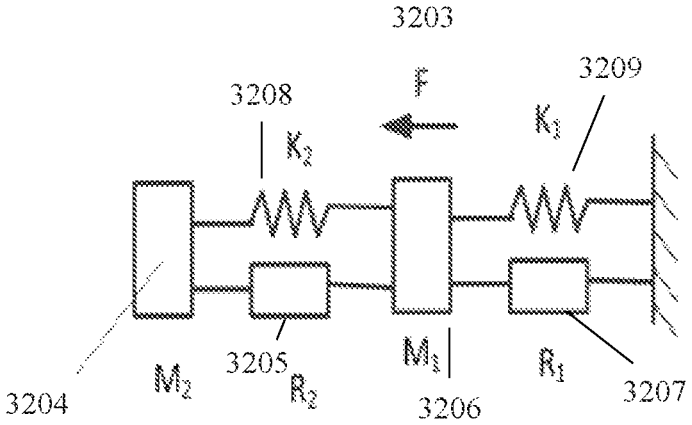
FIG. 32C is a schematic diagram of an exemplary mechanical model corresponding to the sound sensitive component according to some embodiments of the present disclosure.

FIG. 32C is a schematic diagram of an exemplary mechanical model corresponding to the sound sensitive component 1720 according to some embodiments of the present disclosure. The mechanical model may include a first cantilever 3202, a second cantilever 3201, a first elastic component 3208, a second elastic component 3209, a first damping component 3205, and a second damping component 3207. An end of the second elastic component 3209 may be fixed. An end of the second damping component 3207 may be fixed.

Figure 32D:
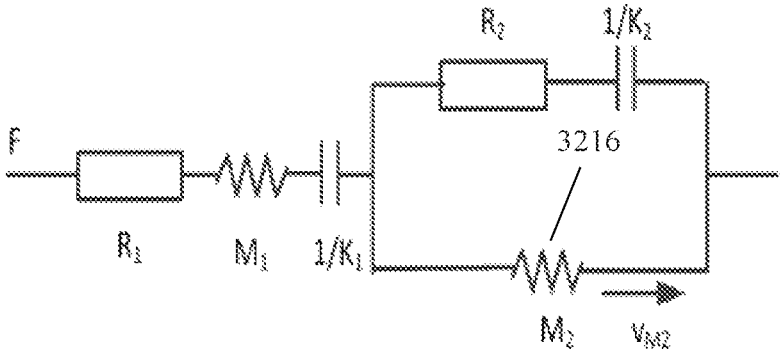
FIG. 32D is a schematic diagram of an exemplary equivalent circuit of the mechanical model shown in FIG. 32C according to some embodiments of the present disclosure.

FIG. 32D is a schematic diagram of an exemplary circuit of the mechanical model shown in FIG. 32C according to some embodiments of the present disclosure.

An impedance of the system (referred to as Z below) to the inputted signal may be determined according to Equation (38) as follows:

$$Z = Z_1 + Z_2 = R_1 + j\left(\omega M_1 - \frac{K_1}{\omega}\right) + \frac{j\omega M_2 R_2 + M_2 K_2}{R_2 + \left(\omega M_2 - \frac{K_2}{\omega}\right)}, \tag{38}$$

where ω refers to the angular frequency of the acoustic structure (e.g., the cantilever), j refers to an unit imaginary number, $Z_1$ refers to the impedance of the second cantilever 3201, $Z_2$ refers to the impedance of the first cantilever 3202, $R_1$ refers to the acoustic resistance of the second cantilever 3201, $R_2$ refers to the acoustic resistance of the first cantilever 3202, $M_1$ refers to the mass of the second cantilever 3201, $M_2$ refers to the mass of the first cantilever 3202, $K_1$ refers to the elastic modulus of the second cantilever 3201, and $K_2$ refers to the elastic modulus of the first cantilever 3202.

The amplitude of the current in the circuit may correspond to a vibration velocity of the cantilever $M_2$, therefore, the vibration velocity $v_{M2}$ of the cantilever $M_2$ may be determined according to Equation (39) and Equation (40) as follows:

$$v_{M2} = F \cdot \frac{\frac{Z_2}{Z_1 + Z_2}}{j\omega M_2}, \tag{39}$$

$$= F \cdot \frac{R_2 + \frac{K_2}{j\omega}}{\left[\left[R_1 + j\left(\omega M_1 - \frac{K_1}{\omega}\right)\right]\left[R_2 + j\left(\omega M_2 - \frac{K_2}{\omega}\right)\right] + j\omega M_2 R_2 + M_2 K_2\right]}, \tag{40}$$

where F refers to the sound force of an audio signal received, ω refers to the angular frequency of the acoustic structure (e.g., the cantilever), j refers to an unit imaginary number, $Z_1$ refers to the acoustic impedance of the second cantilever 3201, $Z_2$ refers to the acoustic impedance of the first cantilever 3202, $R_1$ refers to the acoustic resistance of the second cantilever 3201, $R_2$ refers to the acoustic resistance of the first cantilever 3202, $M_1$ refers to the mass of the second cantilever 3201, $M_2$ refers to the mass of the second cantilever 3201, $K_1$ refers to the elastic modulus of the second cantilever 3201, and $K_2$ refers to the elastic modulus of the first cantilever 3202.

In some embodiments, the displacement $S_{M2}$ of the cantilever under the audio signal may be determined according to Equation (41) and Equation (42) as follows:

$$S_{M2} = \int v_{M2} \cdot e^{j\omega t}\, dt = \frac{1}{j\omega} \cdot v_{M2} \cdot e^{j\omega t}, \tag{41}$$

$$F \cdot e^{j\omega t} \cdot \frac{\left(R_2 + \frac{K_2}{j\omega}\right) \cdot \frac{1}{j\omega}}{\left[\left[R_1 + j\left(\omega M_1 - \frac{K_1}{\omega}\right)\right]\left[R_2 + j\left(\omega M_2 - \frac{K_2}{\omega}\right)\right] + j\omega M_2 R_2 + M_2 K_2\right]}, \tag{42}$$

where F refers to the sound force of an audio signal received, ω refers to the angular frequency of the acoustic structure (e.g., the cantilever), j refers to an unit imaginary number, $R_1$ refers to the acoustic resistance of the second cantilever 3201, $R_2$ refers to the acoustic resistance of the first cantilever 3202, $M_1$ refers to the mass of the second cantilever 3201, $M_2$ refers to the mass of the second cantilever 3201, $K_1$ refers to the elastic modulus of the second cantilever 3201, and $K_2$ refers to the elastic modulus of the first cantilever 3202.

By performing a Laplace transform, the transfer function may be expressed as follows:

$$G(s) = \frac{R_2 s + K_2}{a_4 s^4 + a_3 s^3 + a_2 s^2 + a_1 s + a_0}, \tag{43}$$

and where $$a_0 = K_1 K_2, \tag{44}$$

$$a_1 = R_1 K_2 + R_2 K_1, \tag{45}$$

$$a_2 = R_1 R_2 + M_1 K_2 + M_2 K_1 + M_2 K_2, \tag{46}$$

$$a_3 = R_1 M_2 + R_2 M_1 + M_2 R_2, \tag{47}$$

$$a_4 = M_1 M_2. \tag{48}$$

It can be known from the transfer function that it is a fourth-order system, and an order of the band-pass filter can be increased by the above setting method. In addition, the filter circuit 3232 may be added in the circuit component 1730 so that corresponding electric signal may be filtered. The above setting may cause a slope of the filtering frequency response edge of the sound-electric transducer to the audio signal to be larger, and filtering effect to be better.

Figure 33A:
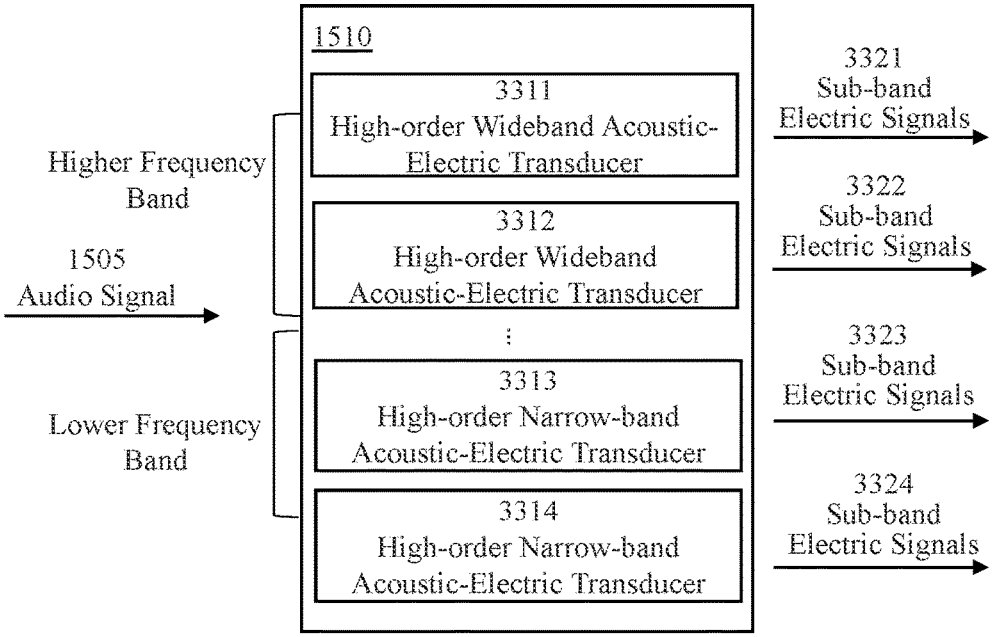
FIG. 33A is a schematic diagram of an exemplary acoustic-electric transducing module according to some embodiments of the present disclosure.

FIG. 33A is a schematic diagram of an exemplary acoustic-electric transducing module 1510 according to some embodiments of the present disclosure.

The acoustic-electric transducing module 1510 may generate sub-band signals according to an audio signal using a plurality of acoustic-electric transducers. The acoustic-electric transducers may function as bandpass filters. For different frequency bands to be processed, corresponding acoustic-electric transducers may be set to have a different frequency response. In some embodiments, the bandwidths of the acoustic-electric transducers in the acoustic-electric transducing module 1510 may be different. The bandwidth of the acoustic-electric transducer may be set to increase with its center frequency. In some embodiments, the acoustic-electric transducer may be a high-order acoustic-electric transducer. In some embodiments, for a low-middle frequency band, the corresponding acoustic-electric transducer may be high-order narrow-band. In a middle-high frequency band, the acoustic-electric transducer may be high-order wideband.

As shown in FIG. 33A, the acoustic-electric transducing module 1510 may include one or more high-order wideband acoustic-electric transducers (e.g., a high-order wideband acoustic-electric transducer 3311, 3312, etc.) in a middle-high frequency band, and one or more high-order narrow-band acoustic-electric transducers (e.g., a high-order narrow-band acoustic-electric transducer 3313, 3314, etc.) in a low-middle frequency band.

The acoustic-electric transducing module 1510 may obtain an audio signal 1505, and output a plurality of sub-band electric signals, e.g., sub-band electric signals 3321, 3322, 3323, . . . , 3324.

Figure 33B:
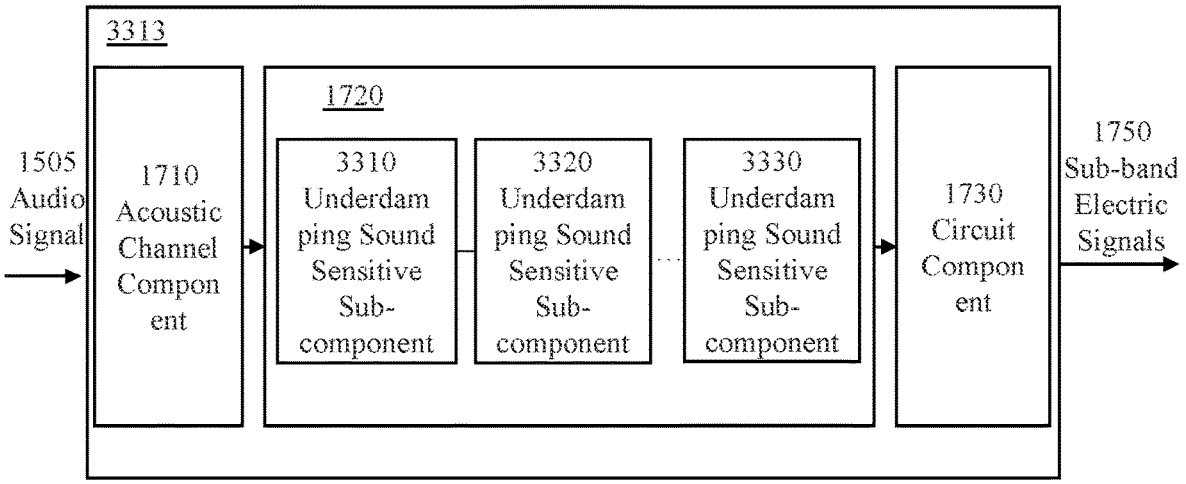
FIG. 33B is a schematic diagram of an exemplary high-order narrow-band acoustic-electric transducer according to some embodiments of the present disclosure.

FIG. 33B is a schematic diagram of an exemplary high-order narrow-band acoustic-electric transducer according to some embodiments of the present disclosure.

As shown in FIG. 33B, the high-order narrow-band acoustic-electric transducer 3313 may include an acoustic channel component 1710, a sound sensitive component 1720, and a circuit component 1730.

The sound sensitive component 1720 may include a plurality of underdamping sound-sensitive sub-components (e.g., underdamping sound-sensitive sub-components 3310, 3330, . . . , 3350). The plurality of underdamping sound-sensitive sub-components may be connected in series. Center frequencies of the underdamping sound-sensitive sub-components may be the same or close to each other. Multiple underdamping sound-sensitive sub-components being connected in series may increase the order of filtering characteristics of the sound sensitive component 1720. Each underdamping sound-sensitive sub-component may reduce bandwidth and achieve narrow-band filtering. In some embodiments, the transducer may function as a high-order narrow-band acoustic-electric transducer. As shown in FIG. 33B, the high-order narrow-band acoustic-electric transducer 3313 may obtain an audio signal 1505 and output a sub-band electric signal 1750 based on the audio signal 1505.

Figure 33C:
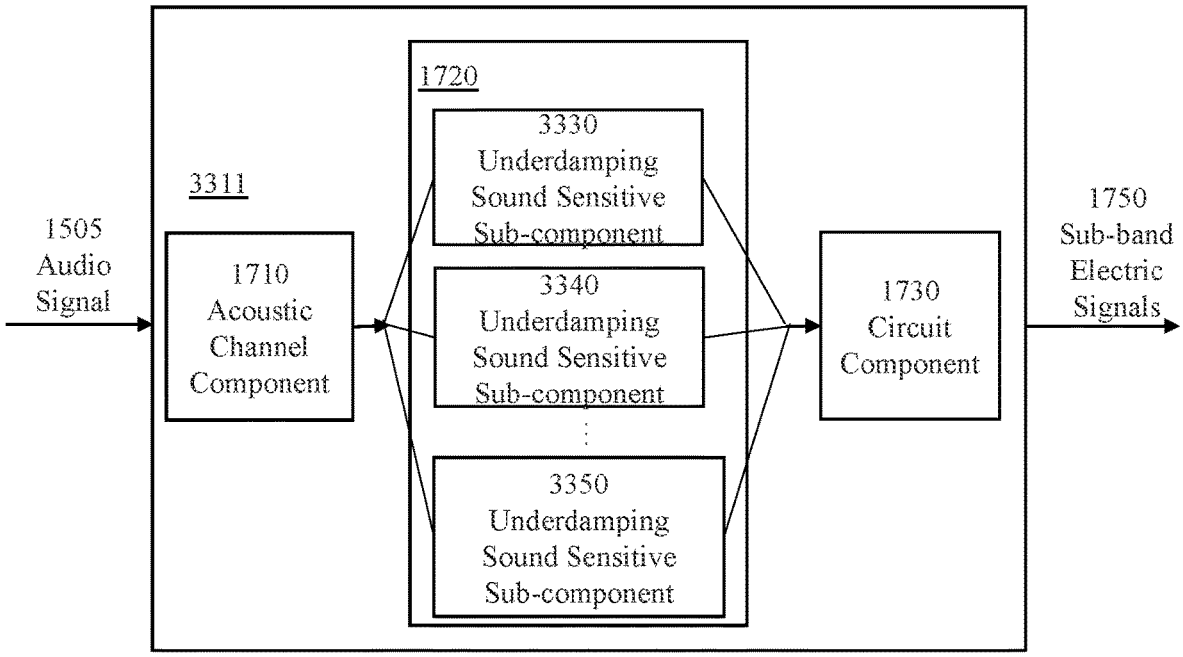
FIG. 33C is a schematic diagram of an exemplary high-order wideband acoustic-electric transducer according to some embodiments of the present disclosure.

FIG. 33C is a schematic diagram of an exemplary high-order wideband acoustic-electric transducer according to some embodiments of the present disclosure.

As shown in FIG. 33C, the high-order wideband acoustic-electric transducer 3311 may include an acoustic channel component 1710, a sound sensitive component 1720, and a circuit component 1730. The sound sensitive component 1720 may include a plurality of underdamping sound-sensitive sub-components (e.g., an underdamping sound-sensitive sub-component 3320, 3340, . . . , 3350). The plurality of underdamping sound-sensitive sub-components may be connected in parallel. Center frequencies of underdamping sound-sensitive sub-components may be different. The parallel connection of multiple underdamping sound-sensitive sub-components may broaden a bandwidth of the sound sensitive component 1720. In some embodiments, the high-order narrow-band acoustic-electric transducer 3311 may function as a high-order wideband acoustic-electric transducer. As shown in FIG. 33C, the high-order narrow-band acoustic-electric transducer 3311 may obtain an audio signal 1505 and output a sub-band electric signal 1750 accordingly.

Figure 34A:
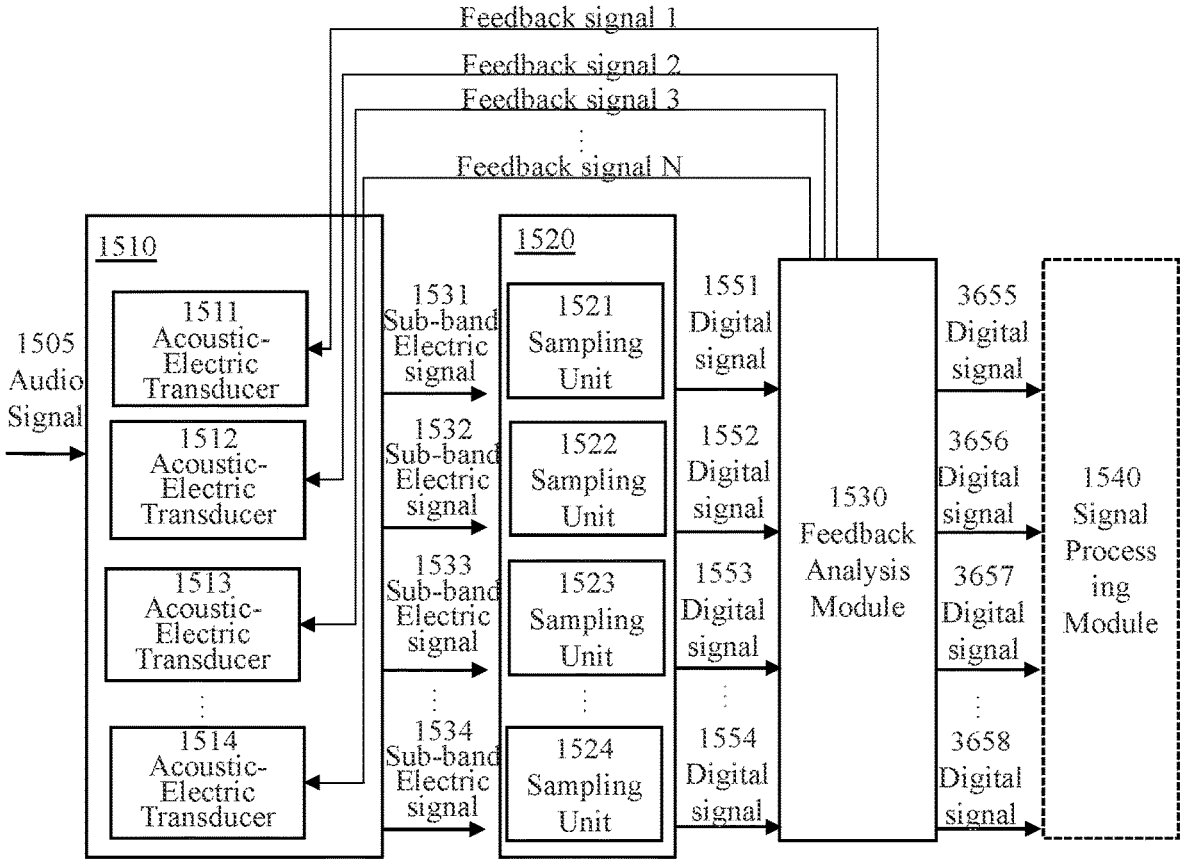
FIG. 34A is a schematic diagram of an exemplary signal processing device according to some embodiments of the present disclosure.

FIG. 34A is a schematic diagram of an exemplary signal processing device 3400 according to some embodiments of the present disclosure. The signal processing device 3400 may include an acoustic-electric transducing module 1510, a plurality of sampling modules (e.g., sampling units 1521, 1522, 1523, . . . , 1524), a feedback analysis module 1530 (or referred to as a feedback module), and a signal processing module 1540. The acoustic-electric transducing module 1510 may include a plurality of acoustic-electric transducers, (e.g., an acoustic-electric transducer 1511, 1512, 1513, . . . , 1514).

As shown in FIG. 34A, the acoustic-electric transducing module 1510 may obtain an audio signal 1505, and output a plurality of sub-band electric signals (e.g., sub-band electric signals 15151, 15152, 1533, . . . , 1534).

Each of the plurality of acoustic-electric transducer may convert the audio signal 1505 into a sub-band electric signal and output a corresponding sub-band electric signal.

Each of the plurality of sampling modules may sample a corresponding sub-band electric signal, convert the sub-band electric signal into a digital signal, and output the digital signal.

The feedback analysis module 1530 may obtain a plurality of digital signals transmitted by the plurality of sampling modules. The feedback analysis module 1530 may analyze each digital signal corresponding to the sub-band electric signal, output a plurality of feedback signals (e.g., feedback signals 1, 2, 3, . . . , N) and transmit each feedback signal to a corresponding acoustic-electric transducer. The corresponding acoustic-electric transducer may adjust its parameters based on the feedback signal.

The signal processing module 1540 may obtain a plurality of digital signals (e.g., digital signals 3655, 3656, 3657, 3658) transmitted by the feedback analysis module 1530. A transmission mode of digital signals may be separately output through different parallel lines or may share one line according to a specific transmission protocol.

Figure 34B:
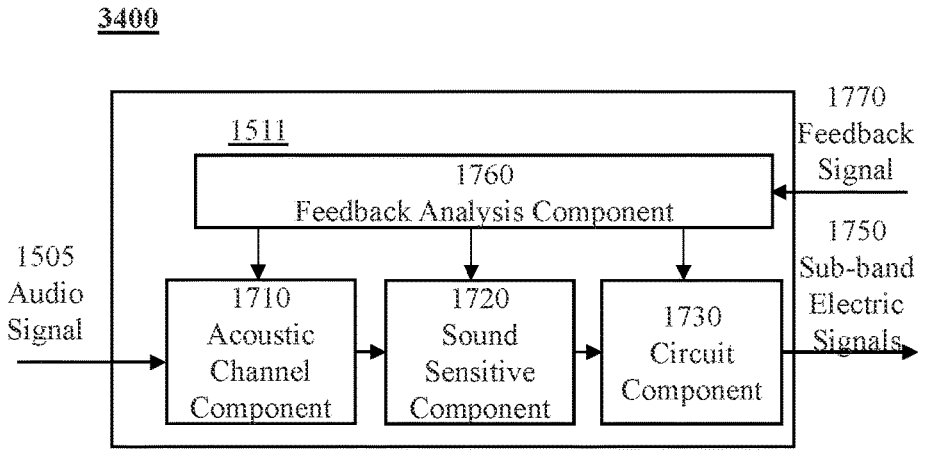
FIG. 34B is a schematic diagram of an exemplary acoustic-electric transducer according to some embodiments of the present disclosure.

FIG. 34B is a schematic diagram of an exemplary acoustic-electric transducer 1511 according to some embodiments of the present disclosure. The acoustic-electric transducer 1511 may include an acoustic channel component 1710, a sound sensitive component 1720, a circuit component 1730, and a feedback processing component 1760.

The feedback processing component 1760 may be configured to obtain a feedback signal 1770 from the feedback analysis module 1530 and adjust parameters of the acoustic-electric transducer 1511.

In some embodiments, the feedback processing component 1760 may adjust at least one of the acoustic channel component 1710, the sound sensitive component 1720, and the circuit component 1730.

In some embodiments, the feedback processing component 1760 may adjust parameters (e.g., size, position, and connection manner) of the acoustic channel component to adjust filtering characteristics of the acoustic channel component 1710 using electromechanical control systems. Exemplary electromechanical control systems may include pneumatic mechanisms, motor-driven mechanisms, hydraulic actuators, or the like, or a combination thereof.

In some embodiments, the feedback processing component 1760 may adjust parameters (e.g., size, position, or connection manner) of the sound sensitive component 1720 to adjust filtering characteristics of the sound sensitive component using electromechanical control systems.

In some embodiments, the feedback processing component 1760 may include a feedback circuit that is directly coupled to the circuit component 1730 to adjust the circuit component 1730.

Figure 35:
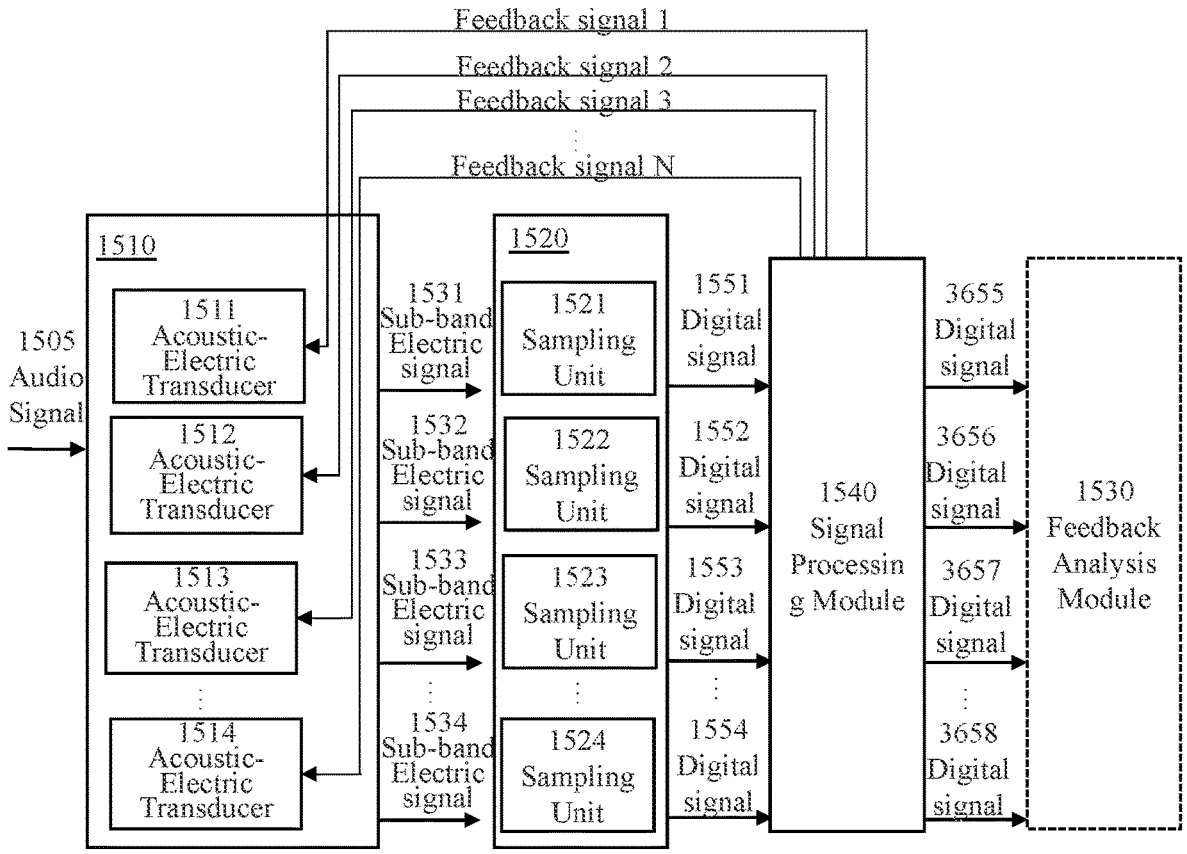
FIG. 35 is a schematic diagram of an exemplary signal processing device according to some embodiments of the present disclosure.

FIG. 35 is a schematic diagram of an exemplary signal processing device 3500 according to some embodiments of the present disclosure. The signal processing device 3500 may include an acoustic-electric transducing module 1510, a plurality of sampling units (e.g., sampling units 1521, 1522, 1522, . . . , and 1524), a feedback analysis module 1530, and a signal processing module 1540.

The acoustic-electric transducing module 1510 may include a plurality of acoustic-electric transducers, (e.g., acoustic-electric transducers 1511, 1512, 1513, . . . , 1514).

As shown in FIG. 35, the acoustic-electric transducing module 1510 may obtain an audio signal 1505 and output a plurality of sub-band electric signals (e.g., sub-band electric signals 15151, 1532, 1533, . . . , 1534).

Each of the plurality of acoustic-electric transducer may convert the audio signal 1505 into a corresponding sub-band electric signal output the corresponding sub-band electric signal. Each of the plurality of sampling units may sample a corresponding sub-band electric signal, convert the sub-band electric signal into a digital signal, and output the digital signal.

The signal processing module 1540 may obtain the plurality of digital signals (e.g., digital signals 1551, 1552, 1553, 1554) transmitted by the plurality of sampling units. Digital signals may be separately output through different parallel lines or may share one line according to a specific transmission protocol.

The feedback analysis module 1530 may obtain a plurality of digital signals (e.g., digital signals 3655, 3657, 3658) transmitted by the signal processing module 1540. The feedback analysis module 1530 may analyze each digital signal corresponding to a sub-band electric signal, output a plurality of feedback signals (e.g., feedback signals 1, 2, 3, . . . , N) and transmit each feedback signal to a corresponding acoustic-electric transducer. The corresponding acoustic-electric transducer may adjust its parameters based on the feedback signal.

The acoustic-electric transducer 1511 in the signal processing device 3500 may be similar to the acoustic-electric transducer 1511 in the signal processing device 3400. More detailed descriptions about the acoustic-electric transducer 1511 in the signal processing device 3500 may be found elsewhere in the present disclosure (e.g., FIG. 34B and the descriptions thereof).

Figure 36:
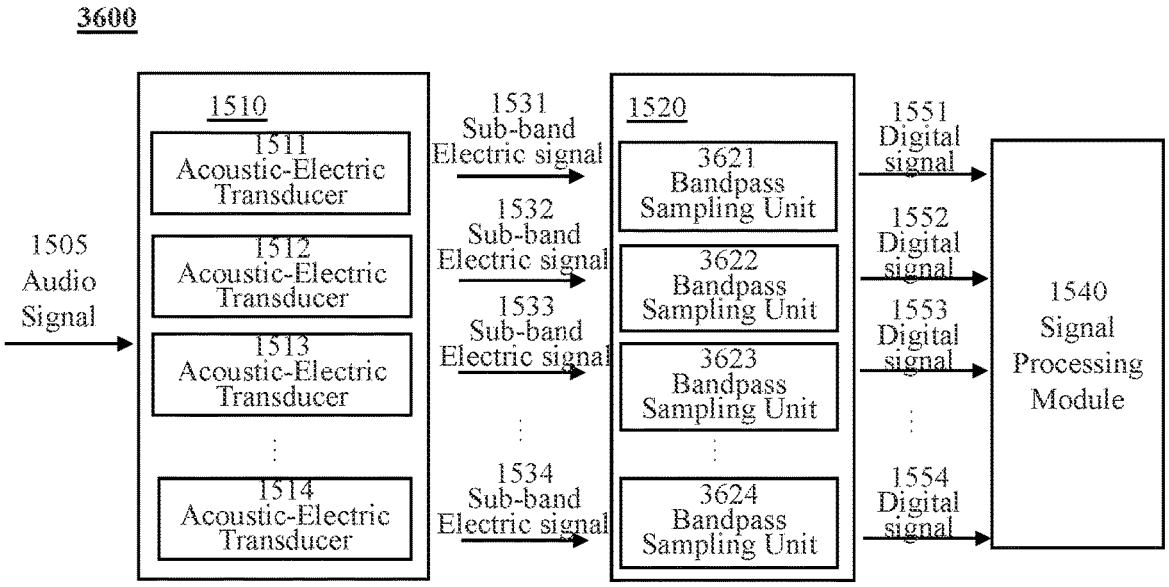
FIG. 36 is a schematic diagram of an exemplary signal processing device according to some embodiments of the present disclosure.

FIG. 36 is a schematic diagram of an exemplary signal processing device 15300 according to some embodiments of the present disclosure. The signal processing device 15300 may include an acoustic-electric transducing module 1510, a plurality of bandpass sampling modules (e.g., bandpass sampling modules 3621, 3622, 3623, . . . , 3624), and a signal processing module 1540.

The acoustic-electric transducing module 1510 may include a plurality of acoustic-electric transducers (e.g., acoustic-electric transducers 1511, 1512, 1513, . . . , 1514).

As shown in FIG. 36, the acoustic-electric transducing module 1510 may obtain an audio signal 1505 and output a plurality of sub-band electric signals. Each of the plurality of acoustic-electric transducer may convert the audio signal 1505 into a corresponding sub-band electric signal output the corresponding sub-band electric signal. Each of the plurality of bandpass sampling modules may sample a corresponding sub-band electric signal, convert the sub-band electric signal into a digital signal, and output the digital signal. The signal processing module 1540 may obtain a plurality of digital signals transmitted by the plurality of bandpass sampling modules.

Figure 37:
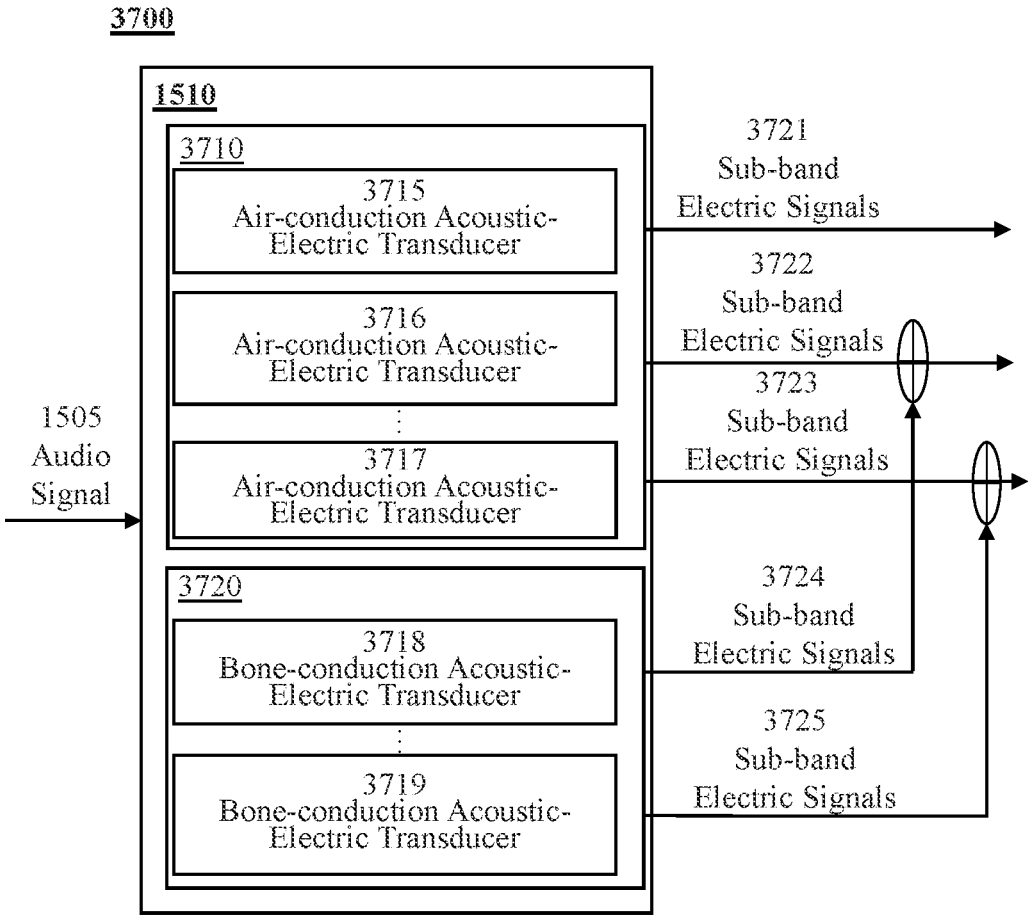
FIG. 37 is a schematic diagram of an exemplary signal processing device according to some embodiments of the present disclosure.

FIG. 37 is a schematic diagram of an exemplary signal processing device 3700 according to some embodiments of the present disclosure. The acoustic-electric transducing module 1510 may include one or more air-conduction acoustic-electric transducer 3710 (e.g., air-conduction acoustic-electric transducers 3715, 3716, and/or 3717) and one or more bone-conduction acoustic-electric transducers 3720 (e.g., bone-conduction acoustic-electric transducer 3718, 3719). An air-conduction acoustic-electric transducer may decompose the audio signal detected to one or more sub-band electric signals. A bone-conduction acoustic-electric transducer may decompose the detected audio signal into one or more sub-band electric signals.

Air-conduction acoustic-electric transducers may detect the audio signal and output a plurality of sub-band electric signals. Each air-conduction acoustic-electric transducer may output a corresponding sub-band electric signal. For example, the air-conduction acoustic-electric transducer 3715, 2517, 3718 may detect the audio signal respectively, and correspondingly output sub-band electric signals 3721, 3722, 3723.

Bone-conduction acoustic-electric transducers may detect the audio signal and output a plurality of sub-band electric signals. Each bone-conduction acoustic-electric transducer may output a corresponding sub-band electric signal. For example, the bone-conduction acoustic-electric transducer 3718 and 3719 may detect the audio signal respectively, and correspondingly output the sub-band electric signals 3724 and 3715.

In some embodiments, at the same frequency band, the sub-band electric signal output by the bone-conduction acoustic-electric transducer may be used to enhance the signal-to-noise ratio (SNR) of the sub-band electric signals output by the air-conduction acoustic-electric transducer. For example, the sub-band electric signal 3722 generated by the air-conduction acoustic-electric transducer 3716 may superpose the sub-band electric signal 3724 generated by the bone-conduction acoustic-electric transducer 3718. The sub-band electric signal 3724 may have higher SNR with respect to the sub-band electric signal 3722. The sub-band electric signal 3723 output by the air-conduction acoustic-electric transducer 3717 may superpose the sub-band electric signal 3725 output by the bone-conduction acoustic-electric transducer 3719. The sub-band electric signal 3725 may have a higher SNR than that of the sub-band electric signal 3723.

In some embodiments, the air-conduction acoustic-electric transducer 2401 may be used to supplement a frequency band that cannot be covered by the sub-band electric signals output by the bone-conduction acoustic-electric transducer 2402.

FIG. 38 is a schematic diagram illustrating exemplary signal modulation process according to some embodiments of the present disclosure. As shown in FIG. 38, a sub-band electric signal may include a frequency domain envelope 3801.

Each sub-band electric signal may be considered as a signal (or referred as a modulation signal) having a frequency domain envelope (which is the same as the frequency domain envelope 3801) that is modulated by a corresponding center frequency signal as a carrier to the center frequency 3802. That is, the sub-band electric signal may include two parts. One part is a signal having a frequency domain envelope (which is same as the frequency domain envelope 3801) as a modulation signal, and the other part is a signal having a center frequency (which is the same as the center frequency 3802) as a carrier.

Main information of the sub-band electric signal is concentrated in the frequency domain envelope. Therefore, when the sub-band electric signal is sampled, it is necessary to ensure that the frequency domain envelope is effectively sampled, and a sampling frequency is not less than 2 times a bandwidth of the sub-band electric signal. After sampling, the second signal having a frequency (which is the same as the center frequency 3802) may be used as the carrier to restore the sub-band electric signal. Thus, the sub-band electric signal may be sampled using the bandpass sampling module. Specifically, the sampling frequency may be not less than 2 times the bandwidth and not more than 4 times the bandwidth. The sampling frequency $f_s$ is set according to Equation (49) as follows.

$$f_s=2f_B(r_1/r_2), \tag{49}$$

where $f_B$ refers to the bandwidth of the sub-band electric signal, and $$r_1 = \frac{[f_0 + (f_B/2)]}{f_B}, \quad (50)$$

where $f_0$ refers to the center frequency of the sub-band electric signal, and $r_2$ is a largest integer less than $r_1$.

To implement various modules, units, and their functionalities described in the present disclosure, computer hardware platforms may be used as the hardware platform(s) for one or more of the elements described herein. A computer with user interface elements may be used to implement a personal computer (PC) or any other type of work station or terminal device. A computer may also act as a server if appropriately programmed.

It's noticeable that above statements are preferable embodiments and technical principles thereof. A person having ordinary skill in the art is easy to understand that this disclosure is not limited to the specific embodiments stated, and a person having ordinary skill in the art can make various obvious variations, adjustments, and substitutes within the protected scope of this disclosure. Therefore, although above embodiments state this disclosure in detail, this disclosure is not limited to the embodiments, and there can be many other equivalent embodiments within the scope of the present disclosure, and the protected scope of this disclosure is determined by following claims.

What is claimed is:

1. A speaker, comprising:

a housing;

a plurality of transducers residing inside the housing and a first portion of the plurality of transducers is configured to generate vibrations, the vibrations producing a sound wave inside the housing and causing a leaked sound wave spreading outside the housing from a portion of the housing;

at least one sound guiding hole located on the housing and configured to guide the sound wave inside the housing through the at least one sound guiding hole to an outside of the housing, the guided sound wave having a phase different from a phase of the leaked sound wave, the guided sound wave interfering with the leaked sound wave in a target region, and the interference reducing a sound pressure level of the leaked sound wave in the target region, wherein a second portion of the plurality of transducers includes:

a first acoustic-electric transducer having a first frequency response and a second acoustic-electric transducer having a second frequency response, the second frequency response being different from the first frequency response, wherein the first acoustic-electric transducer is configured to detect an audio signal, and generate a first sub-band signal according to the detected audio signal by the first acoustic-electric transducer; and the second acoustic-electric transducer is configured to detect the audio signal, and generate a second sub-band signal according to the detected audio signal by the second acoustic-electric transducer.

2. The speaker of claim 1, wherein the first acoustic-electric transducer has a first frequency width, and the second acoustic-electric transducer has a second frequency width different from the first frequency width.

3. The speaker of claim 2, wherein the second frequency width is larger than the first frequency width, and a second center frequency of the second acoustic-electric transducer is higher than a first center frequency of the first acoustic-electric transducer.

4. The speaker of claim 2, wherein the first frequency response and the second frequency response intersect at a point near a half-power point of the first frequency response and a half-power point of the second frequency response.

5. The speaker of claim 1, further comprising:

a first sampling module connected to the first acoustic-electric transducer and configured to sample the first sub-band signal to generate a first sampled sub-band signal; and a second sampling module connected to the second acoustic-electric transducer and configured to sample the second sub-band signal to generate a second sampled sub-band signal.

6. The speaker of claim 5, further comprising a feedback module configured to adjust at least one of the first acoustic-electric transducer or the second acoustic-electric transducer.

7. The speaker of claim 6, wherein the feedback module is configured to adjust the at least one of the first acoustic-electric transducer or the second acoustic-electric transducer according to at least one of the first sampled sub-band signal or the second sampled sub-band signal.

8. The speaker of claim 6, further comprising a processing module configured to process the first sampled sub-band signal and the second sampled sub-band signal to generate a first processed sub-band signal and a second processed sub-band signal, respectively, wherein the feedback module is configured to adjust the at least one of the first acoustic-electric transducer or the second acoustic-electric transducer according to the first processed sub-band signal or the second processed sub-band signal.

9. The speaker of claim 1, wherein the first acoustic-electric transducer includes:

a sound sensitive component configured to generate an electric signal according to the audio signal, and an acoustic channel component.

10. The speaker of claim 9, wherein:

the acoustic channel component includes a second-order component; and the sound sensitive component includes a multi-order bandpass diaphragm.

11. The speaker of claim 1, wherein the first acoustic-electric transducer includes a first-order bandpass filter or a multi-order bandpass filter.

12. The speaker of claim 1, wherein the second portion of the plurality of transducers includes at least one of:

no more than 10 first-order acoustic-electric transducers, wherein each first-order acoustic-electric transducer corresponds to a frequency band whose width is no larger than 20 kHz;

no more than 20 second-order acoustic-electric transducers, wherein each second-order acoustic-electric transducer corresponds to a frequency band whose width is no larger than 20 kHz;

no more than 30 third-order acoustic-electric transducers, wherein each third-order acoustic-electric transducer corresponds to a frequency band whose width is no larger than 20 kHz; or no more than 40 fourth-order acoustic-electric transducers, wherein each fourth-order acoustic-electric transducer corresponds to a frequency band whose width is no larger than 20 kHz.

13. The speaker of claim 1, wherein the second portion of the plurality of transducers includes at least one of:

no more than 8 first-order acoustic-electric transducers, wherein each first-order acoustic-electric transducer corresponds to a frequency band whose width is no larger than 8 kHz;

no more than 13 second-order acoustic-electric transducers, wherein each second-order acoustic-electric transducer corresponds to a frequency band whose width is no larger than 8 kHz;

no more than 19 third-order acoustic-electric transducers, wherein each third-order acoustic-electric transducer corresponds to a frequency band whose width is no larger than 8 kHz; or no more than 26 fourth-order acoustic-electric transducers, wherein each fourth-order acoustic-electric transducer corresponds to a frequency band whose width is no larger than 8 kHz.

14. The speaker of claim 1, wherein the first acoustic-electric transducer is a high-order wideband acoustic-electric transducer, and the second acoustic-electric transducer is a high-order narrow-band acoustic-electric transducer.

15. The speaker of claim 14, wherein the high-order wideband acoustic-electric transducer includes a plurality of underdamping sound sensitive components connected in parallel, and the high-order narrow-band acoustic-electric transducer includes a plurality of underdamping sound sensitive components connected in series.

16. The speaker of claim 15, wherein the plurality of underdamping sound sensitive components include a first underdamping sound sensitive component having a fourth frequency response, a second underdamping sound sensitive component having a fifth frequency response, and a third underdamping sound sensitive component having a sixth frequency response, wherein:

a fifth center frequency of the second underdamping sound sensitive component is higher than a fourth center frequency of the first underdamping sound sensitive, and a sixth center frequency of the third underdamping sound sensitive component is higher than the fifth center frequency of the second underdamping sound sensitive, and the fourth frequency response and the fifth frequency response intersect at a point near a half-power point of the fourth frequency response and a half-power point of the fifth frequency response.

17. The speaker of claim 15, wherein the plurality of underdamping sound sensitive components include a first underdamping sound sensitive component having a fourth frequency response, and a second underdamping sound sensitive component having a fifth frequency response, wherein:

the fourth frequency response and the fifth frequency response intersect at a point near a half-power point of the fourth frequency response and a half-power point of the fifth frequency response.

18. The speaker of claim 1, wherein the at least one sound guiding hole includes a damping layer, the damping layer being configured to adjust the phase of the guided sound wave in the target region.

19. The speaker of claim 18, wherein the damping layer includes at least one of a tuning paper, a tuning cotton, a nonwoven fabric, a silk, a cotton, a sponge, or a rubber.

20. The speaker of claim 1, wherein the guided sound wave includes at least two sound waves having different phases.

* * * * *